US010351315B2

(12) United States Patent
Berge

(10) Patent No.: US 10,351,315 B2
(45) Date of Patent: Jul. 16, 2019

(54) CLOSURE WITH TAMPER BAND AND SPOUT

(71) Applicant: Silgan White Cap LLC, Downers Grove, IL (US)

(72) Inventor: Gary Berge, Crystal Lake, IL (US)

(73) Assignee: Silgan White Cap LLC, Downers Grove, IL (US)

( * ) Notice: Subject to any disclaimer, the term of this patent is extended or adjusted under 35 U.S.C. 154(b) by 67 days.

(21) Appl. No.: 15/709,417

(22) Filed: Sep. 19, 2017

(65) Prior Publication Data

US 2019/0084735 A1 Mar. 21, 2019

(51) Int. Cl.
*B65D 47/12* (2006.01)
*B65D 41/34* (2006.01)
(Continued)

(52) U.S. Cl.
CPC ..... *B65D 47/122* (2013.01); *B65D 41/3409* (2013.01); *B65D 55/022* (2013.01);
(Continued)

(58) Field of Classification Search
CPC ..... B65D 41/3428; B65D 41/3409; B65D 41/34; B65D 41/3438; B65D 47/122;
(Continued)

(56) References Cited

U.S. PATENT DOCUMENTS 2,148,864 A 2/1939 Kistner
3,463,341 A 8/1969 Fileds
(Continued)

FOREIGN PATENT DOCUMENTS

CA 157967 7/2015
DE 296 09 596 U1 10/1996
(Continued)

OTHER PUBLICATIONS

U.S. Appl. No. 29/472,406, filed Nov. 12, 2013, Taber et al.
(Continued)

*Primary Examiner* — Paul R Durand
*Assistant Examiner* — Andrew P Bainbridge
(74) *Attorney, Agent, or Firm* — Reinhart Boerner Van Deuren s.c.

(57) ABSTRACT

A tamper evident closure and spout are provided. The closure includes a tamper-indicating band extending from a central wall. Formed about the tamper band are one or more spout engagement structures. Also provided about the tamper band may be one or more knuckles that assist in distorting the tamper band upon initial removal of the closure from a spout so as to increase the ease with which the tamper band can be identified as having been broken upon visual inspection by a user. The spout includes a wall portion and a central channel extending through the wall portion between an inlet opening and an outlet opening. Located about an outer portion of the spout are one or more tamper band engagement structures configured to engage a tamper band and which assist in breaking and distorting a tamper band upon initial removal of a closure from the spout.

5 Claims, 48 Drawing Sheets

(51) Int. Cl.
*B65D 55/02* (2006.01)
*B65D 75/00* (2006.01)
*B65D 75/58* (2006.01)

(52) U.S. Cl.
CPC ..... *B65D 75/008* (2013.01); *B65D 75/5883* (2013.01); *B65D 2101/0038* (2013.01); *B65D 2101/0046* (2013.01)

(58) Field of Classification Search
CPC .... B65D 47/12; B65D 47/06; B65D 75/5883; B65D 75/008; B65D 2101/003; B65D 2101/0046
USPC ..... 222/153.06
See application file for complete search history.

(56) References Cited

U.S. PATENT DOCUMENTS 4,305,516 A 12/1981 Perne
D272,324 S 1/1984 Mumford et al.
D273,368 S 4/1984 Hayes
4,503,986 A 3/1985 Nixdorff et al.
4,505,401 A 3/1985 Berglund
D278,311 S 4/1985 Brown et al.
4,573,601 A 3/1986 Berglund
4,653,657 A 3/1987 Papavasilopoulos
4,805,791 A 2/1989 Begley
4,852,751 A 8/1989 Halfacre
5,040,692 A 8/1991 Julian
5,295,600 A * 3/1994 Kowal ..... B65D 41/3428 215/252
D359,683 S 6/1995 Beach et al.
D361,265 S 8/1995 Doxey
5,823,383 A 10/1998 Hins
5,853,095 A 12/1998 Marshall et al.
5,927,549 A 7/1999 Wood
D445,678 S 7/2001 Malmborg
6,330,959 B1 12/2001 Dark
D454,066 S 3/2002 Trabal
D460,357 S 7/2002 Kras et al.
D467,501 S 12/2002 Tacchella
6,557,714 B2 5/2003 Babcock et al.
D476,565 S 7/2003 Rosén
6,612,466 B1 9/2003 Malin
D489,978 S 5/2004 Brown
6,783,014 B2 8/2004 Luker
6,811,047 B1 11/2004 Hicks et al.
6,860,406 B2 3/2005 Kobetsky et al.
6,958,033 B1 10/2005 Malin
D542,654 S 5/2007 Szczesniak
D542,655 S 5/2007 Szczesniak
D542,656 S 5/2007 Szczesniak
D544,348 S 6/2007 Szczesniak
D547,657 S 7/2007 Tacchella
D551,975 S 10/2007 Gomoll et al.
D552,483 S 10/2007 Rigardo
D564,884 S 3/2008 Rittman
D574,241 S 8/2008 Braukmann et al.
D579,332 S 10/2008 Krivoshein
7,677,422 B2 3/2010 Lee
7,735,666 B2 6/2010 Niwa et al.
7,753,233 B2 7/2010 Umenaka
D631,349 S 1/2011 Arnell et al.
7,882,977 B2 2/2011 Johnson
D633,386 S 3/2011 Taber et al.
D634,199 S 3/2011 Taber et al.
D634,200 S 3/2011 Taber et al.
D646,263 S 10/2011 Yuan et al.
8,105,226 B2 1/2012 Wada
D661,185 S 6/2012 Battat
8,231,020 B2 7/2012 Taber et al.
8,231,025 B2 7/2012 Johnson
D671,187 S 11/2012 Saringer
D672,238 S 12/2012 Aziz et al.
D672,241 S 12/2012 Sawicki et al.
D679,597 S 4/2013 Tamarindo
D682,688 S 5/2013 Murray
8,443,999 B1 5/2013 Reinders
D684,055 S 6/2013 Kwon
D684,056 S 6/2013 Kwon
D684,057 S 6/2013 Kwon
D684,058 S 6/2013 Kwon
D686,495 S 7/2013 Murray
8,528,757 B2 * 9/2013 Bisio ..... B65D 41/3404 215/252
8,528,758 B2 9/2013 Morlot et al.
D693,220 S 11/2013 Luo
8,616,394 B2 12/2013 Kim
D705,061 S 5/2014 Jo et al.
D710,772 S 8/2014 Maiorana et al.
8,807,361 B2 * 8/2014 Luo ..... B65D 55/00 215/252
D712,266 S 9/2014 Römer et al.
D712,743 S 9/2014 Neputy et al.
D712,744 S 9/2014 Neputy et al.
8,950,939 B2 * 2/2015 Last ..... B65D 75/5883 383/5
9,309,032 B2 * 4/2016 Berge ..... B65D 47/122
D756,777 S 5/2016 Berge et al.
D760,081 S 6/2016 Berge
9,533,802 B2 * 1/2017 Berge ..... B65D 47/12
9,617,045 B2 4/2017 Reinders
D790,344 S 6/2017 Neputy et al.
D791,591 S 7/2017 Berge
9,938,050 B2 * 4/2018 Berge ..... B65D 41/3428
2004/0200797 A1 10/2004 Hicks et al.
2004/0245286 A1 12/2004 Lee
2005/0011911 A1 1/2005 Vaughan
2005/0040181 A1 2/2005 Kurosawa et al.
2005/0139607 A1 6/2005 Kobetsky et al.
2005/0205438 A1 9/2005 Hierzer et al.
2008/0124432 A1 5/2008 Ma
2008/0135513 A1 6/2008 Umenaka
2009/0152269 A1 * 6/2009 Pucci ..... B65D 47/0823 220/254.3
2009/0223963 A1 9/2009 Bisio
2010/0213213 A1 * 8/2010 Albers ..... B65D 41/3409 222/153.05
2011/0210122 A1 9/2011 Benoit-Gonin et al.
2012/0211460 A1 8/2012 Tamarindo
2012/0325769 A1 12/2012 Essebaggers et al.
2013/0270270 A1 10/2013 Reinders
2014/0010481 A1 1/2014 Last et al.
2014/0048536 A1 2/2014 Bisio
2014/0263475 A1 9/2014 Totten
2015/0129533 A1 5/2015 Taber et al.
2015/0232237 A1 8/2015 Berge
2016/0122095 A1 5/2016 Berge

FOREIGN PATENT DOCUMENTS

JP 10-181758 A 7/1998
JP 10-258850 9/1998
JP 2002-104447 A 4/2002
JP 2005-082193 3/2005
JP 2011-246128 A 12/2011
JP 2014-019447 2/2014
KR 2002-0024043 3/2002
KR 10-0951526 4/2010
KR 20-0455090 8/2011
KR 20-0466355 4/2013
WO WO 2008/050361 A1 6/2004
WO WO 2004/045977 A1 5/2008
WO WO 2015/123209 8/2015
WO WO 2016/069311 5/2016
WO WO 2017/135958 8/2017

OTHER PUBLICATIONS

Images of Spouts and Closures, document believed to be publicly available at least by Aug. 2012, 1 page.

(56) References Cited

OTHER PUBLICATIONS

Gualapack System, Image of Spouts and Caps, dated Apr. 1, 2013, at http://www.gualapack.com/img/pagine/prodotti/tappi/1.jpg, believed to be publicly available from Gualapack System at least by Aug. 2012, 1 page.
Gualapack System, Image of first stacked caps, dated Apr. 1, 2013, at http://www.gualapack.com/img/pagine/prodotti/innovazione/1.jpg, believed to be publicly available from Gualapack System at least by Aug. 2012, 1 page.
Gualapack System, Image of second stack caps, dated Apr. 1, 2013, at http://www.gualapack.com/img/pagine/prodotti/innovazione/2.jpg, believed to be publicly available from Gualapack System at least by Aug. 2012, 1 page.
Gualapack System, Image of third stacked caps, dated Apr. 1, 2013, at http://www.gualapack.com/img/pagine/prodotti/innovazione/3.jpg, believed to be publicly available from Gualapack System at least by Aug. 2012, 1 page.
Flexible Packaging. Silgan White Cap to Introduce Secure-Spout Pouch Technology at Global Pouch Forum. Jun. 1, 2014 [online], [site visited Nov. 18, 2015]. Available from Internet, <URL:http://www.flexpackmag.com/keywords/4416-silgan-white-cap>.
Silgan White Cap, Secure-Spout—9mm Spout with Fitment Brochure, believed to be publically available on Jun. 11, 2014 2014 and representative of closure and spout believed to be publically available on Jun. 11, 2014, 3 pages.
International Search Report and Written Opinion for PCT/US2015/056238, dated Dec. 30, 2015, 11 pages.
International Search Report and Written Opinion for PCT/US2016/016623, dated Oct. 27, 2016, 15 pages.

* cited by examiner

CLOSURE WITH TAMPER BAND AND SPOUT

BACKGROUND

The present invention relates to a closure and spout assembly for closing a container such as a pouch which holds a material having a liquid or gel-like consistency. In particular, the present invention relates to various embodiments, configurations, and combinations of closures having tamper bands formed with spout engagement structures and spouts formed with tamper band engagement structures. In particular embodiments, the spout engagement structures of the tamper bands are configured to engage with the tamper band engagement structures of the spouts to effectuate breakage of the tamper band upon initial removal of the closure from the spout and to increase the visibility and ease with which a user may identify the tamper band as having been broken.

SUMMARY OF THE INVENTION

In one embodiment, a spout and closure assembly includes a spout having a central channel extending through a wall portion between an inlet opening and an outlet opening. The channel surrounds a central axis of the spout. An attachment portion is located about a lower outer surface of the wall portion. The attachment portion is configured for attaching the closure assembly to a container. A thread is located about an upper outer surface of the wall portion.

An annular flange extends about the upper outer surface of the wall portion at a location below a lower end of the thread. A support structure extends about the upper outer surface of the wall portion at a location below a lower surface of the annular flange. The diameter of the annular flange is greater than the diameter of the support structure.

A wall structure extends downwards from and along a portion of the lower surface of the annular flange adjacent the outer periphery of the outer flange. At least a portion of an inner surface of the wall structure is positioned opposite at least a portion of an outer surface of the support structure. A keyway is defined between the portions of the inner surface of the wall structure and the portions of the outer surface of the support structure positioned opposite one another.

A width of the keyway as measured in a radial direction at a point along the wall structure located between a first end of the wall structure and a second end of the wall structure is less than a width of the keyway as measured in a radial direction at the first end of the wall structure.

The spout and closure assembly further includes a closure configured to be attached to the spout. The closure includes a central wall having an inner surface and an outer surface. A thread is formed on the inner surface of the closure and is configured to engage the thread of the spout.

A tamper-indicating band extends from a lower surface of the central wall. The tamper band includes an outer wall portion extending downwardly from the central wall. A frangible bridge attaches a first end of the outer wall portion to a portion of the tamper band adjacent the first end of the outer wall portion.

An engagement wall has a bottom end and a top end extending between the first end and a second end of the outer wall portion. The bottom end of the engagement wall is attached to and extends radially inward and upward from a lower portion of the outer wall portion. The top end of the engagement wall defines an upper engagement surface.

A width of the engagement wall as measured in a radial direction is substantially the same as the width of a narrowest portion of the keyway. In an initial, assembled configuration, the threads of the closure engage the threads of the spout to seal the inlet opening of the spout, and the engagement wall of the tamper band is located below the annular flange and radially outwards relative to the support structure, such that the upper engagement surface of the engagement wall is spaced opposite the lower surface of the upper flange.

Upon initial removal of the closure from the spout, as the closure is rotated relative to the spout a first end of the engagement wall enters into the keyway, the upper engagement surface of the engagement wall is brought into contact with the lower surface of the annular flange, and the frangible bridge is broken.

In some embodiments of the spout and closure assembly, a container filled with contents may optionally be attached to the spout along the attachment portion.

In some embodiments of the spout and closure assembly, upon initial removal of the closure from the spout, the engagement wall may encounter both radial and axial resistance to movement of the engagement wall as the closure is rotated relative to the spout.

In some embodiments of the spout and closure assembly, a hinge may optionally attach the second end of the outer wall portion to a portion of the tamper band adjacent the second end of the outer wall portion.

In some embodiments of the spout and closure assembly an arm element may optionally extend generally perpendicularly outwards along the lower surface of the annular flange from the outer surface of the wall portion to the outer periphery of the annular flange, such that an outermost end of the arm element is attached to the second end of the wall structure.

In one embodiment, a closure includes a top panel. A skirt extends generally perpendicularly downwards from an outer periphery of the top panel. A thread is located on an inner surface of the skirt. The thread is configured to engage a cooperating thread on a spout.

A tamper-indicating band extends from the lower end of the skirt. The tamper band is generally circular and includes one or more wall sections. The one or more wall sections are arranged in a generally circular configuration. A frangible bridge is located along a periphery of the tamper band.

A hinge element is located along the periphery of the tamper band. The hinge element is configured to allow a wall section that is attached to the hinge element to be moved relative to the other wall sections forming the tamper band.

A knuckle element is located along the periphery of the tamper band. The knuckle element includes a first leg and a second leg. A first end of the first leg and a second end of the second leg are each located along the periphery of the tamper band. A second end of the first leg is attached to a first end of the second leg at an intersection point defined by a non-zero degree angle. The intersection point is not located along the periphery of the tamper band.

An engagement element extends radially inwards from an inner surface of at least one wall section. The engagement element is configured to interact with a structure on a spout to resist movement of the tamper band relative to the spout upon initial removal of the closure from the spout.

In some embodiments of the closure, the closure may optionally include an outer wall extending radially outwards from the skirt. An inner surface of the outer wall is attached to an outer surface of the skirt by one or more connectors.

In some embodiments of the closure, the top panel may optionally be spaced apart from a top portion of the outer wall, and a lower end of the skirt may optionally be spaced apart from a lower end of the outer wall such that a passageway is defined between the outer surface of the skirt and the inner surface of the outer wall between a top portion and a bottom portion of the closure.

In some embodiments of the closure, the engagement element may optionally be located at a position along the periphery between the location of the frangible bridge and the location of the knuckle.

In some embodiments of the closure, the engagement element may optionally be configured to engage one or more corresponding structures on a spout to provide a resistance to a rotational movement of the closure in both the axial and radial directions upon the initial removal of the closure from a spout to which the closure is sealingly engaged.

In some embodiments of the closure, the tamper band may optionally include only a single frangible bridge, only a single hinge, only a single knuckle, and only a single engagement element.

In some embodiments of the closure, the intersection point may optionally be located radially outwards relative to the outer periphery of the tamper band.

In one embodiment, a spout for a container configured to be sealed by a closure includes a generally cylindrical wall portion extending along and centered about a vertical axis. A central channel extends through the wall portion and terminates at an upper inlet opening and a lower outlet opening. A thread extends from an outer surface of an upper end of the wall portion. The thread is configured for engaging a cooperating structure on a closure.

A mounting portion extends from an outer surface of a lower end of the wall portion. The mounting portion defines an outer surface configured for attachment to an inner surface of a container.

The spout include an engagement portion configured for engaging a tamper band of a closure sealingly engaged with the spout upon removal of the closure from the spout. The engagement portion includes an annular flange extending outwards along a horizontal plane from an upper portion of the outer surface of the wall portion at a location below the thread.

A support flange extends about a portion of the upper portion of the outer surface of the wall portion of the spout at a location directly below a lower surface of the annular flange. An outermost periphery of the support flange lies radially inwards relative to an outermost periphery of the annular flange.

A wall structure extends downwards from the lower surface of the annular flange. At least a portion of the inner surface of the wall structure is positioned opposite at least a portion of an outer surface of the support flange.

A passageway is defined between those portions of the wall structure inner surface and the support flange outer surface that are positioned opposite one another. The width of the passageway as measured in a radial direction is greater at a position corresponding to a first end of the wall structure than the width of the passageway as measured at a position corresponding to point along the wall structure that is located in between the first end of the wall structure and a second end of the wall structure.

In some embodiments, a container filled with contents may optionally be attached to the spout along the mounting portion.

In some embodiments of the spout, an arm element may optionally extend along the lower surface of the annular flange generally perpendicularly outwards from the outer surface of the wall portion to the outermost periphery of the outer flange, an outermost end of the arm element attached to the second end of the wall structure.

In some embodiments of the spout, the first end of the wall structure may optionally have a width as measured in a radial direction that is less that a width of the second end of the wall structure as measured in a radial direction.

In some embodiments of the spout, the first end of the wall structure may be defined by a beveled surface extending along a plane generally parallel to the vertical axis.

In some embodiment of the spout, a rounded protrusion may optionally extend downwardly from the lower surface of the annular flange at a position within the passageway.

In some embodiments of the spout, the wall structure may optionally extend downwards from the lower surface of the annular flange a first distance and the support flange may optionally extend downwards from the lower surface of the annular flange a second distance. The first distance may optionally be less than the second distance.

In some embodiment of the spout the wall structure may optionally extend downwards from the lower surface of the annular flange a first distance and the support flange may optionally extends downwards from the lower surface of the annular flange a second distance. The first distance may optionally be substantially the same as the second distance.

BRIEF DESCRIPTION OF THE DRAWINGS

The present invention relates to a container assembly having a spout with a modified mounting portion. The modified mounting portion is configured to minimize or prevent any damage to the pouch and/or the connection between the spout and pouch when changes in temperature and/or pressure occur, or when external forces are imparted onto the container assembly.

This application will become more fully understood from the following detailed description, taken in conjunction with the accompanying figures, wherein like reference numerals refer to like elements in which.

DETAILED DESCRIPTION

Referring generally to the figures, various embodiments of a container assembly including a pouch, closure and related spout are described. In some embodiments, the closure comprises a tamper band that is configured to be broken upon initial removal of the closure from the spout so as to provide a visual indication to a user that the container has been opened. In some embodiments, the spout includes a tamper band engagement structure configured to assist in breaking the tamper band upon initial removal of the closure, and which may also be configured to increase the visibility of the broken tamper band to a user.

The closure and the tamper band discussed herein may be particularly suitable for containers, for example food or drink containers, intended for use by children. For example, because the tamper band remains attached to the closure after the container is opened, the likelihood that the tamper band is accidentally swallowed by a user may be reduced. Specifically, because the tamper band is removed along with the removal of the closure, it does not remain near the opening of the container where a user may place their mouth.

Before turning to the figures, which illustrate the exemplary embodiments in detail, it should be understood that the present application is not limited to the details or methodology set forth in the description or illustrated in the figures. It should also be understood that the terminology is for the purpose of description only and should not be regarded as limiting.

Figure 1:
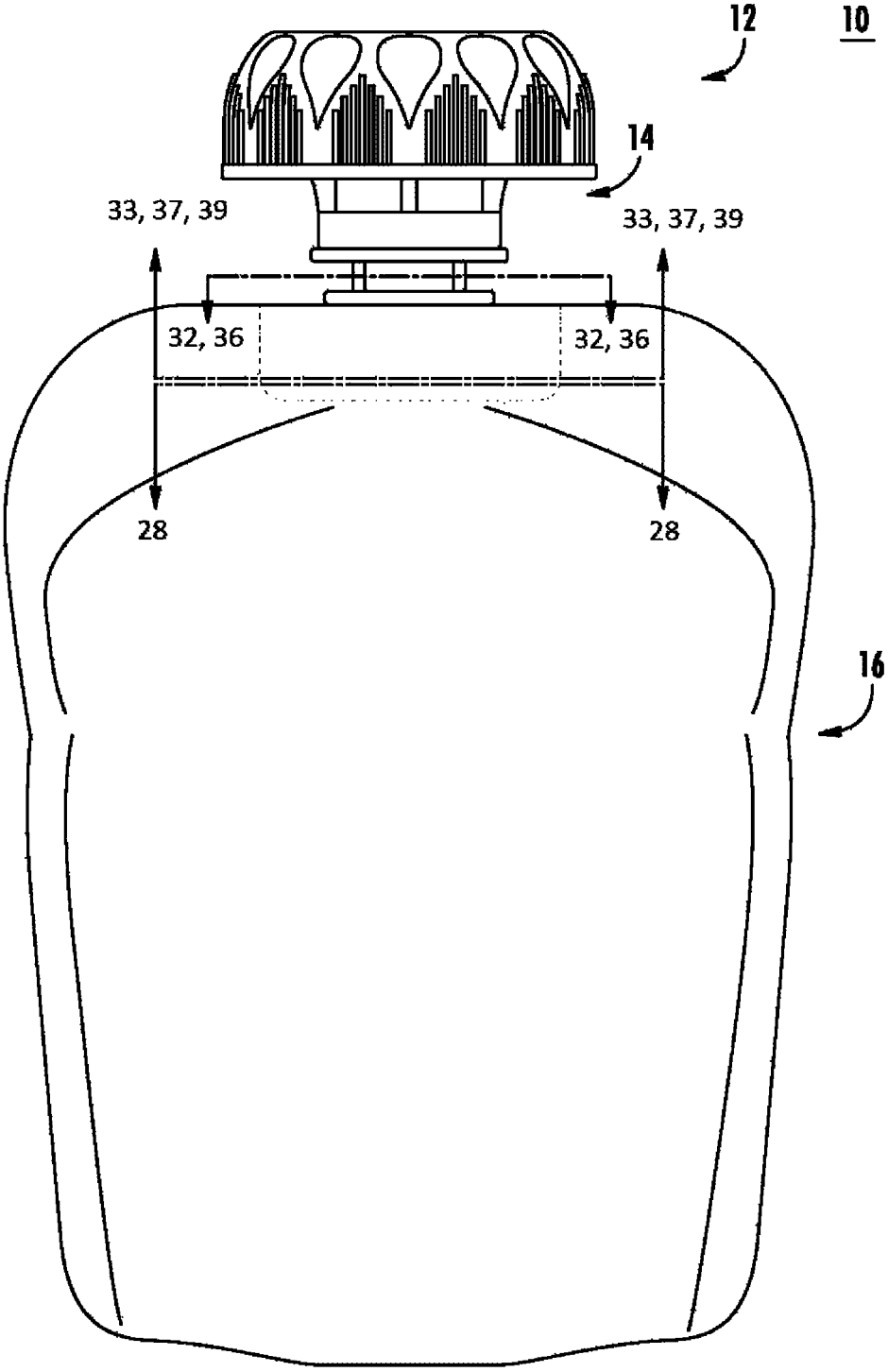
FIG. 1 shows a container assembly including a closure and spout assembly attached to a pouch-type container according to an exemplary embodiment.

FIG. 1 shows a container assembly 10 according to one embodiment. Container assembly 10 includes a container, shown as pouch 16 and a closure assembly, including a closure 12 and a spout 14. In general, pouch 16 includes container contents, such as liquid, semi-liquid, or powdered food or beverage, within pouch 16, and spout 14 provides a channel through which the contents of pouch 16 can be accessed.

In the embodiment shown, pouch 16 is a flexible, squeezable type of container which may be formed from a flexible material. In various embodiments, the flexible material may be a material such as a thermoplastic sheet or a foil pouch. In other embodiments, closure 12 and spout 14 may be used in conjunction with other types of containers, such as plastic bottles or composite (paper, cardboard, etc.) boxes, or pouches fabricated from suitable laminated materials. In specific embodiments, the contents of pouch 16 may be food or beverage intended for consumption by a child, such as baby food, yogurt, apple sauce, etc.

As will be generally understood, the lower end of pouch 16 may provide an end wall or rim providing a stable base for pouch 16 to sit in the upright position shown in FIG. 1. The spout 14 may be assembled with the closure 12 before attachment of the spout 14 to a pouch 16 that has been prefilled with contents. Alternatively, the spout 14 may be inserted into an empty pouch 16 that is then filled with contents through the spout 14, after which the closure 12 is added to the spout 14.

In various embodiments, the closure 12 and/or spout 14 may be formed from a molded plastic material. In various embodiments, closure 12 and/or spout 14 may be polyethylene, polypropylene, polyethylene terephthalate, or any other suitable plastic material. In various embodiments, the closure 12 and/or spout 14 may be formed through any suitable molding method including injection molding, compression molding, etc.

Illustrated in FIGS. 2-6 are various embodiments of a closure 12 having a tamper band 32. As shown in FIGS. 2-6, in various embodiments closure 12 may include threads 59 that engage cooperating threads 58 on spout 14. Closure 12 includes an outer wall 18, with an interior upper edge 21 that defines a top opening. As shown in FIGS. 2-6, outer wall 18 may include a textured design 154 molded into the exterior surface of the outer wall 18 that facilitates gripping by a user. In other embodiments, the textured design 154 may be etched, printed, or adhered to the outer wall 18. The pattern of the textured design 154 may vary in size, complexity, symmetry, or distribution. Alternatively, the outer wall 18 may be formed without a textured design 154.

Closure 12 may include a central wall portion, shown as central cylinder 24, that is coupled to an inner surface of outer wall 18 by radial walls 26 such that open spaces or channels 27 are defined within closure 12. Channels 27 extend vertically through closure 12 from interior upper edge 21 to lower end of closure 12 such that airflow is permitted through closure 12. As such, if the closure 12 is accidently swallowed by a user, air may flow through channels 27, allowing the user to breathe.

In one embodiment, radial walls 26 are monolithically and integrally formed with the inner surface of outer wall 18. In alternate embodiments, the radial walls 26 are formed independently and subsequently attached to the inner surface of outer wall 18. Although the embodiment shown includes four radial walls 26, closure 12 may include any number of radial walls 26 as may be appropriate based on the material of the closure 12, the dimensions of the closure 12, and the intended use of the container assembly 10.

Closure 12 may include a tamper band 32 extending from the lower end of central cylinder 24. Referring to FIGS. 2A-2D a closure 12 having a tamper band 32 according to one embodiment is shown. Tamper band 32 comprises one or more wall sections 36 that, taken together, generally define a circular perimeter.

Figure 2A:
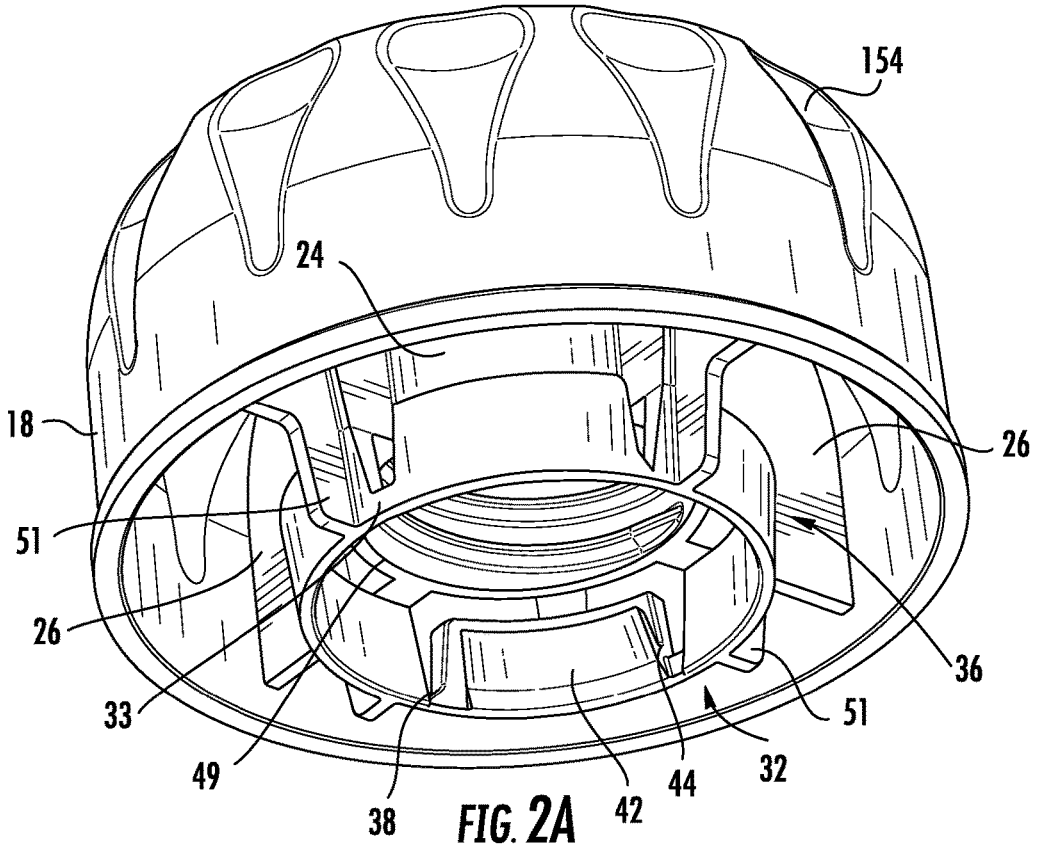
FIGS. 2A-D show various views of a closure according to an exemplary embodiment.
Figure 2B:
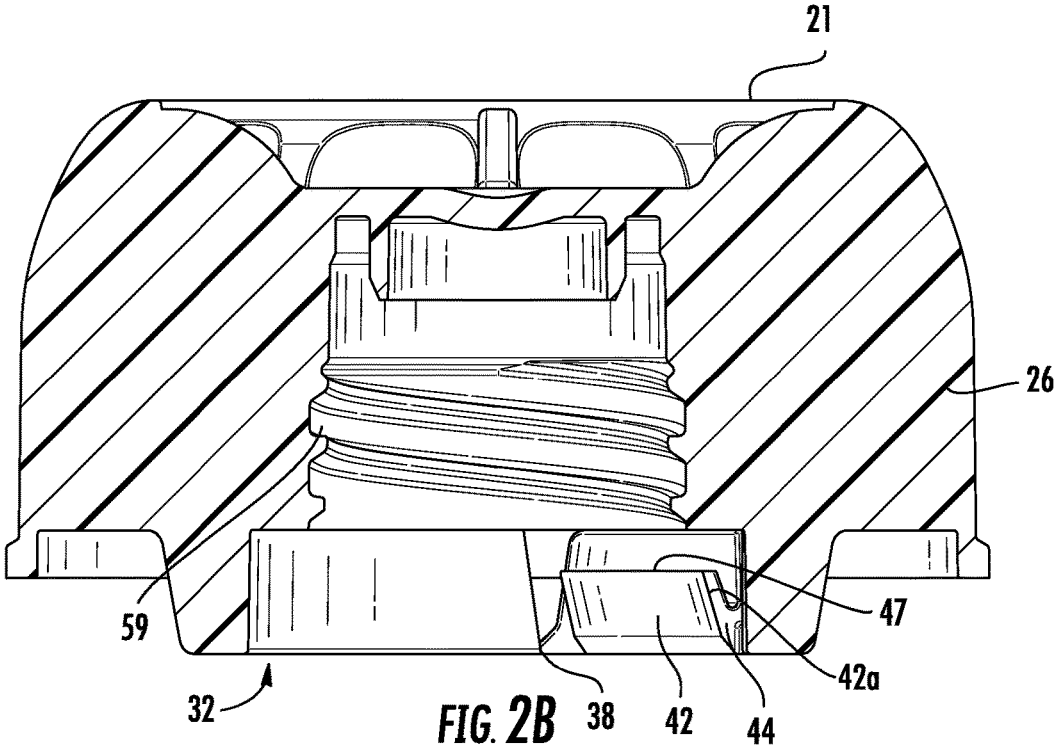
Figure 2C:
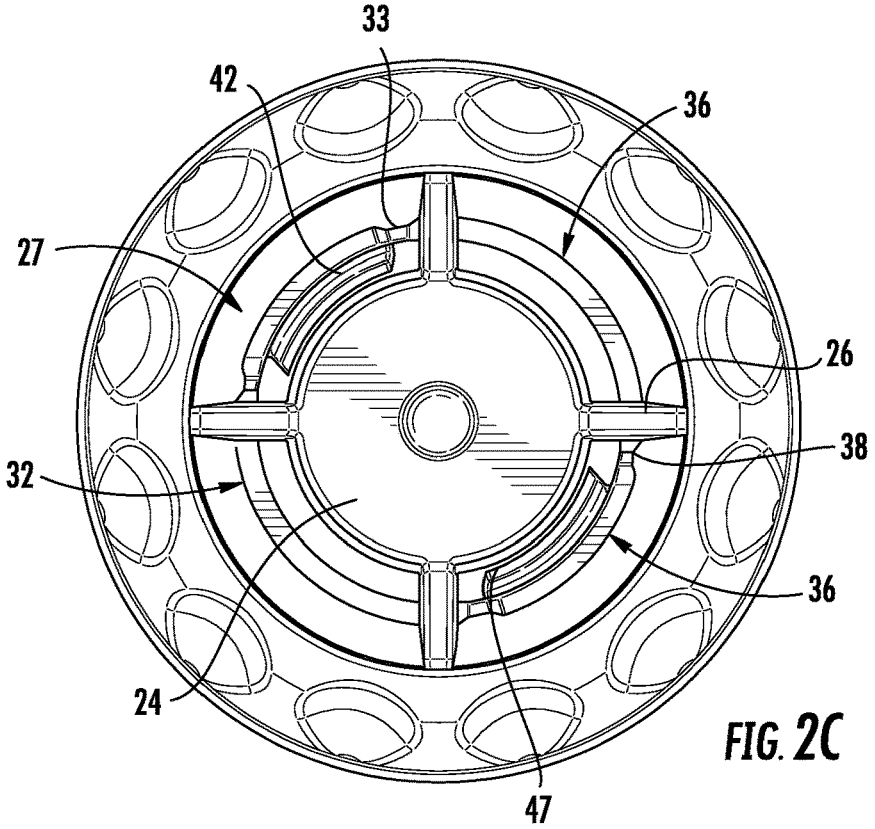

As illustrated in in FIG. 2C, frangible bridges 38 extend at the ends of some wall sections 36. Located at the ends of some or all of the remaining wall section are hinges 33. In some embodiments, the number of hinge 33 and bridges may be equal. As will be described in more detail below, frangible bridges 38 are configured to break upon initial removal of the closure 12 from the spout 14.

Once the bridges 38 have been broken, the flexible hinges 33 are configured to allow at least a portion of the wall section 36 to deflect more easily and readily relative to the original, generally circular arrangement of the wall section 36, so as to more readily alert a user when the container assembly 10 has been opened.

The tamper band 32 is attached to the closure 12 via one or more posts 51 extending downwardly from the lower portions of one or more of the radial walls 26. As shown in FIG. 2A, in various embodiments the posts 51 may be attached to the tamper band along the outer surface of the tamper 32 and/or along the upper edge of the wall sections 36.

As illustrated in FIG. 2C, in various embodiments the arrangement of hinges 33 and bridges 38 about tamper band 32 may correspond to the location of posts 51 attached to the tamper band 32. In particular, in various embodiments, the hinges 33 and bridges 38 are arranged so that both a hinge 33 and a bridge 38 are located about a portion of the circumference of the tamper band 32 that extends between two adjacent posts 51.

Specifically, in some embodiments, the spacing of the wall sections 36 of the tamper band 32 may be such that a clockwise facing end of a hinge 33 is positioned adjacent a counter-clockwise facing end of a first post 51, and the counterclockwise facing end of a bridge 38 is positioned adjacent a clockwise facing surface of a second post 51 located adjacent the first post 51. Maximizing the spacing between the hinge 33 and bridge 38 about the portion of the tamper band 32 located in between adjacent posts 51 may allow for greater deflection of the wall section 36 upon breaking of the bridges 38. Furthermore, because the deflection of the wall section 36 occurs entirely or largely within the space located in between adjacent posts 51, the distortion of the wall section 36 is minimally or not at all obscured by the placement of the radial walls 26, allowing a user to more easily and clearly recognize that the tamper band 32 has been broken when looking downwards at the container 10.

Turning to FIG. 2B, located on the inner surface of one or more of the wall sections 36 are one or more spout engagement structures that are configured to engage one or more corresponding tamper band engagement structures located on the spout 14.

As shown e.g. in the embodiment of closure 12 shown in FIGS. 2A-2D, in some embodiments the spout engagement structure formed on wall sections 36 may comprise or consist of one or more J-bands 42 that extend radially inward away from a lower portion of the inner surfaces of wall sections 36 and upwards toward the upper end of closure 12.

In some embodiments, the J-bands 42 are sections that are integrally molded with the rest of tamper band 32 and are connected to the lower end 45 of tamper band 32. In one embodiment, J-bands 42 are molded in the positioning shown e.g. in FIGS. 2-6 with a connector, such as, e.g. u-shaped curved connector section 44. In other embodiments, J-bands 42 are molded extending downwards from the lower end 45 of tamper band. Following molding, J-bands 42 are folded upward and inward relative to tamper band 32 to form u-shaped connector sections 44. In either molding arrangement, connector sections 44 provide the transition from the generally downwardly extending wall section 36 to the generally upwardly extending J-bands 42.

Figure 2D:
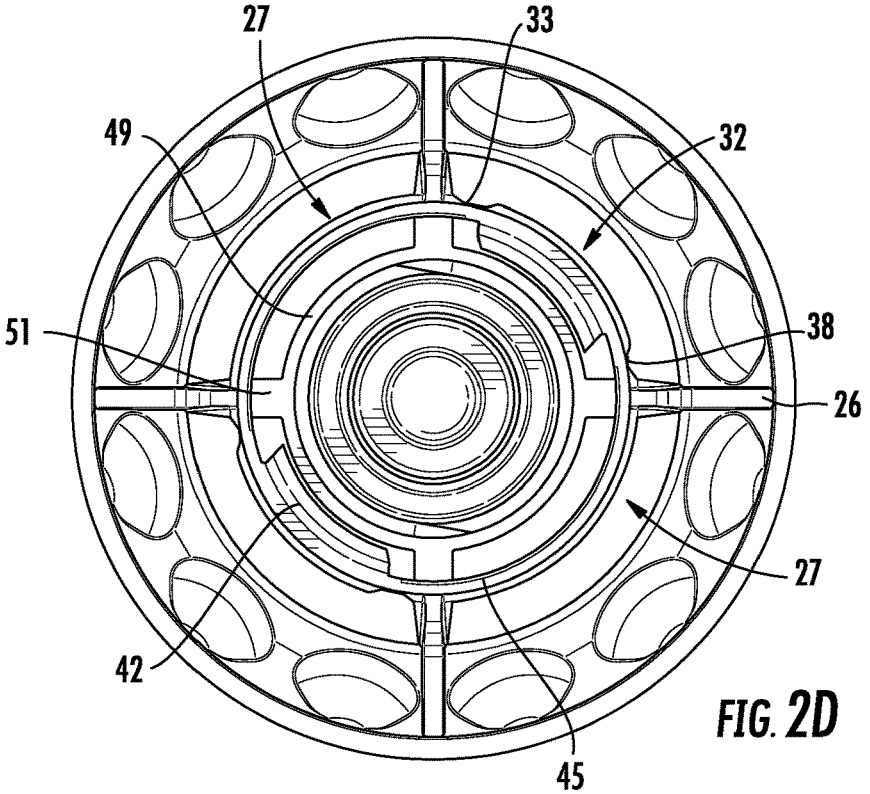

J-bands 42 may extend from the inner surface of any number of the wall section 36 defining tamper band 32. As illustrated in FIGS. 2C and 2D, in some embodiments, the J-bands 42 extend along a portion of those wall sections 36 that extend between a hinge 33 and a bridge 38. In such embodiments, the wall sections 36 extending between a hinge 33 and a bridge 38 may be positioned about the tamper 32 such that the wall sections 36 correspond to portions of the tamper band 32 that extend entirely in between adjacent posts 51, such that J-bands 42 are also positioned about the tamper band 32 along portions of the tamper band 32 that extend entirely in between adjacent posts 51.

J-bands 42 are angled radially inwards relative to wall sections 36. Further, J-bands 42 each have an upper edge or surface 47 that defines the uppermost surface of each J-band 42. J-bands 42 have a height (i.e., the dimension in the direction of the longitudinal axis of the closure 12) that is less than the height of wall section 36 such that the upper surface 47 of each J-band 42 is located below both the upper portion of wall section 36, and below the lowermost edge 49 of central cylinder 24.

In various embodiments, the angular length of wall sections 36 in the circumferential direction is greater than the angular length of J-bands 42 in the circumferential direction. As illustrated in FIGS. 2A-2D, in some embodiments, although the angular length of J-band 42 may be less than the angular length of the wall section 36 from which the J-band 42 extends, the angular length of the J-band 42 may generally correspond to the length of the portion of the wall section 36 extending between the hinge 33 an bridge 38 to which the J-band 42 is attached. In other embodiments, such as e.g. in which one or more J-bands 42 extend from a wall section 36, the angular lengths of the J-bands 42 may be substantially shorter than the angular length of the wall section 36.

In some embodiments, the entire closure 12 may be monolithically formed, (e.g. by injection molding) as a single, unitary structure. In other embodiments, various components of closure 12 may initially be formed separately and may be subsequently connected together.

In various embodiments, wall sections 36 are configured to provide a relatively compete band surrounding the base of central cylinder 24. In the embodiment shown in FIGS. 2A-E, tamper band 32 includes two wall sections 36. However, tamper band 32 may include any number of wall sections 36 that are connected to adjacent wall sections 36 by a pair of bridge sections 38. For example, as illustrated in FIGS. 4A-4D, in some embodiments tamper band 32 may include a single wall section 36. In other embodiments (not shown) the tamper band 32 can include more than two wall sections 36.

As illustrated in FIG. 2B, in some embodiments each wall section 36 of the tamper band 32 includes one J-band 42. In other embodiments, tamper band 32 may be formed such that not all wall sections 36 include a J-band 42. In other embodiments, wall section 36 may be formed with more than one J-band. In some embodiments, each wall section 36 of the tamper band 32 will have the same number of J-bands 42, while in other embodiments the number of J-bands 42 on the wall sections 36 will vary.

Figure 3A:
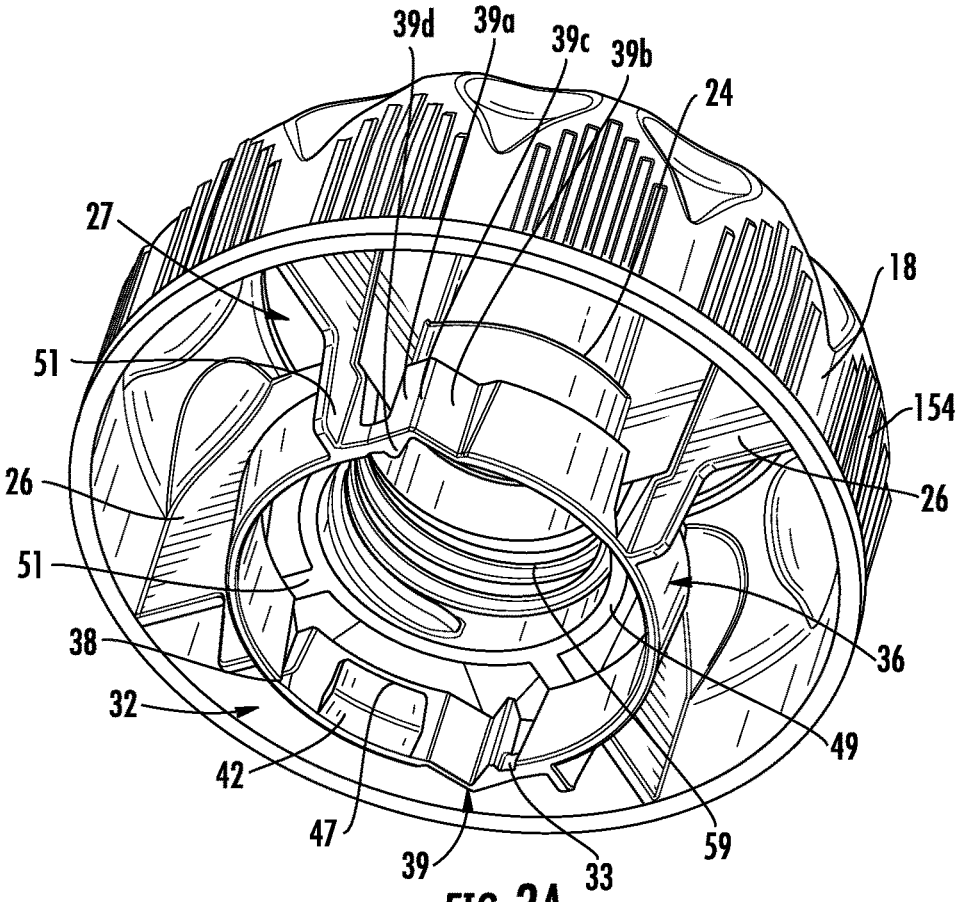
FIGS. 3A-D show various views of a closure according to an exemplary embodiment.
Figure 3B:
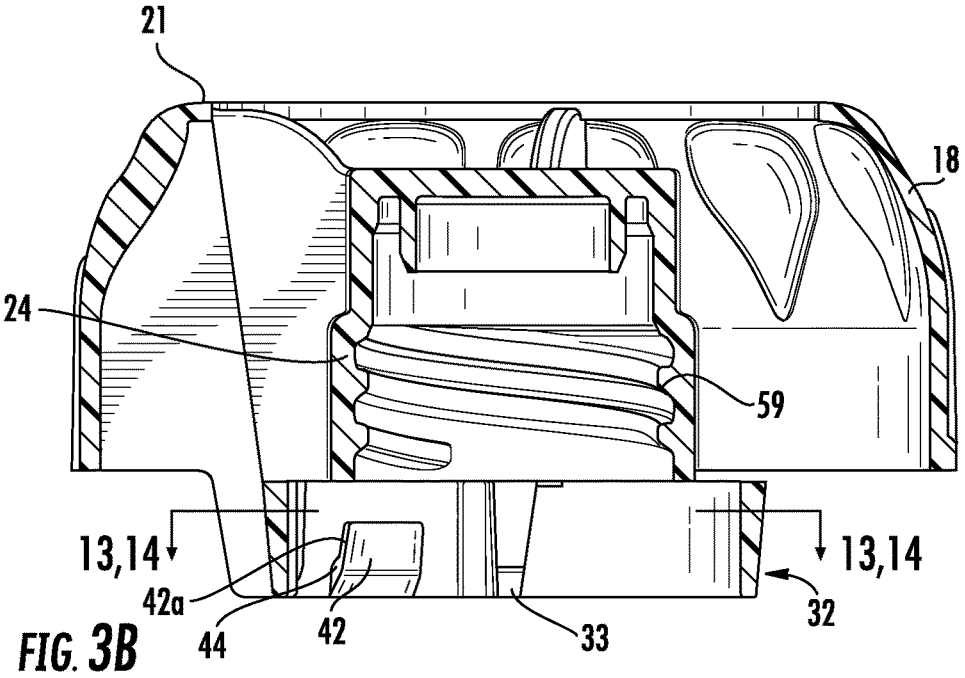

Illustrated in FIGS. 3A-3D is another embodiment of a tamper band 32 that may be formed with closure 12. As shown in FIG. 3A, the tamper band 32 embodiment of FIGS. 3A-3D includes a number of the same or similar features as those described with reference to the tamper band 32 embodiment of FIGS. 2A-2D.

As shown in FIG. 3A, in addition to the features of tamper band 32 described with reference to the embodiment of FIG. 2A, in some embodiments tamper band 32 may be formed having one or more knuckles 39 that are spaced about tamper band 32. As illustrated in FIG. 3A, knuckle 39 is generally defined by a portion of the otherwise generally circular tamper band 32 that is formed in a folded, angled arrangement.

As will be described in more detail below, as the closure 12 is initially removed from the spout 14, the knuckle 39 is configured to collapse, allowing for additional distortion and deflection of the tamper band 32 as the spout engagement structure of the tamper band 32 engages the tamper band engagement structure of the spout 14 so as to further increase the ease with which a user can see that the tamper band 32 has been broken.

Figure 3C:
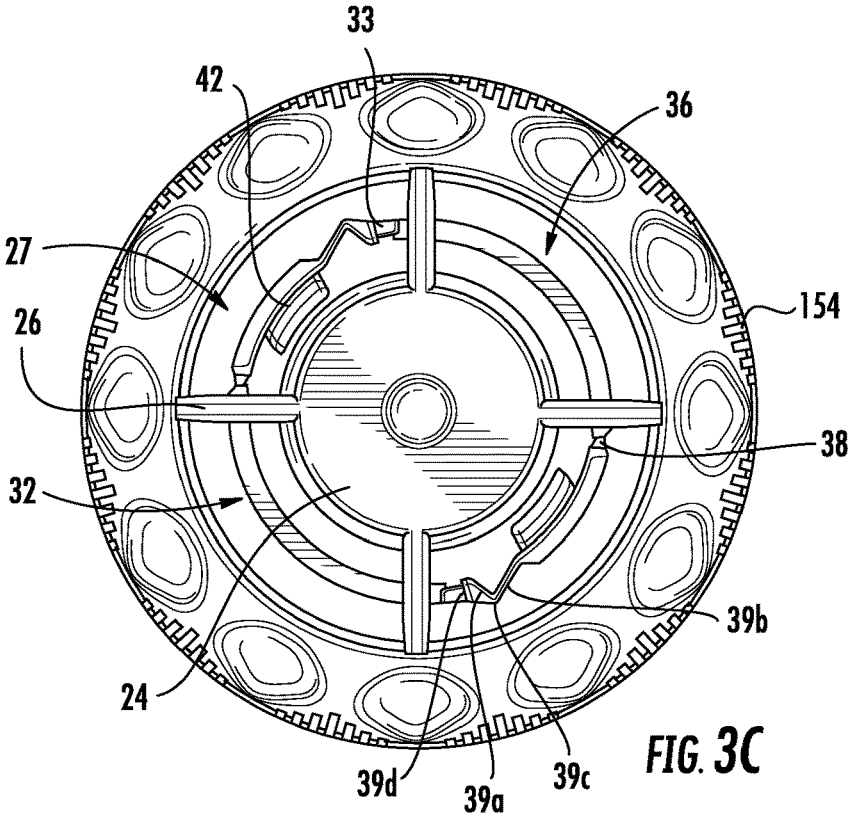
Figure 3D:
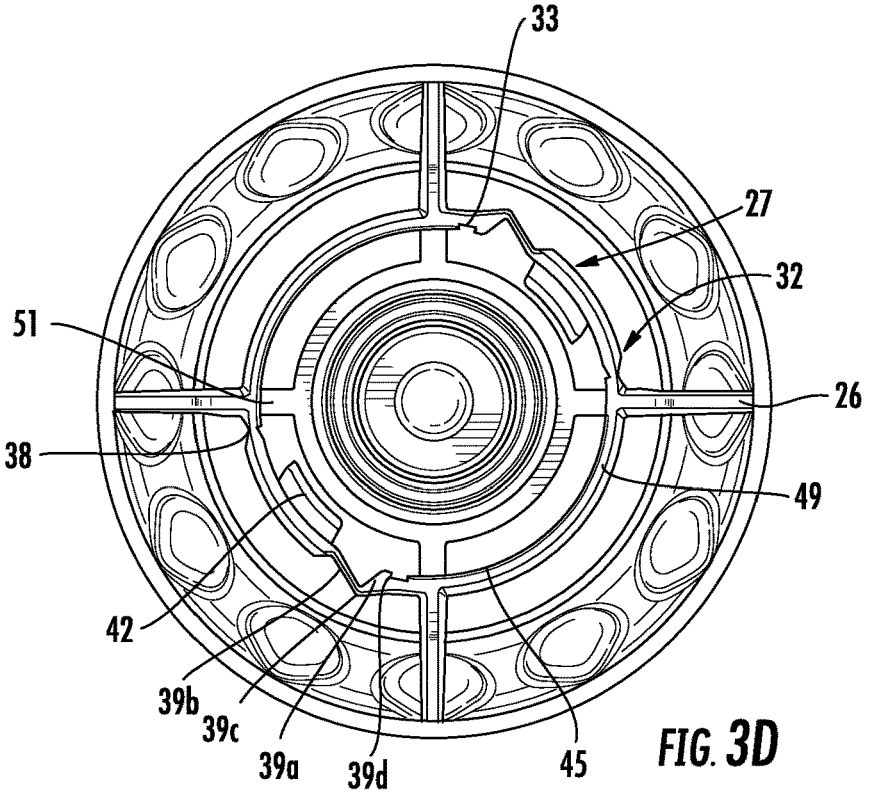
Figure 4A:
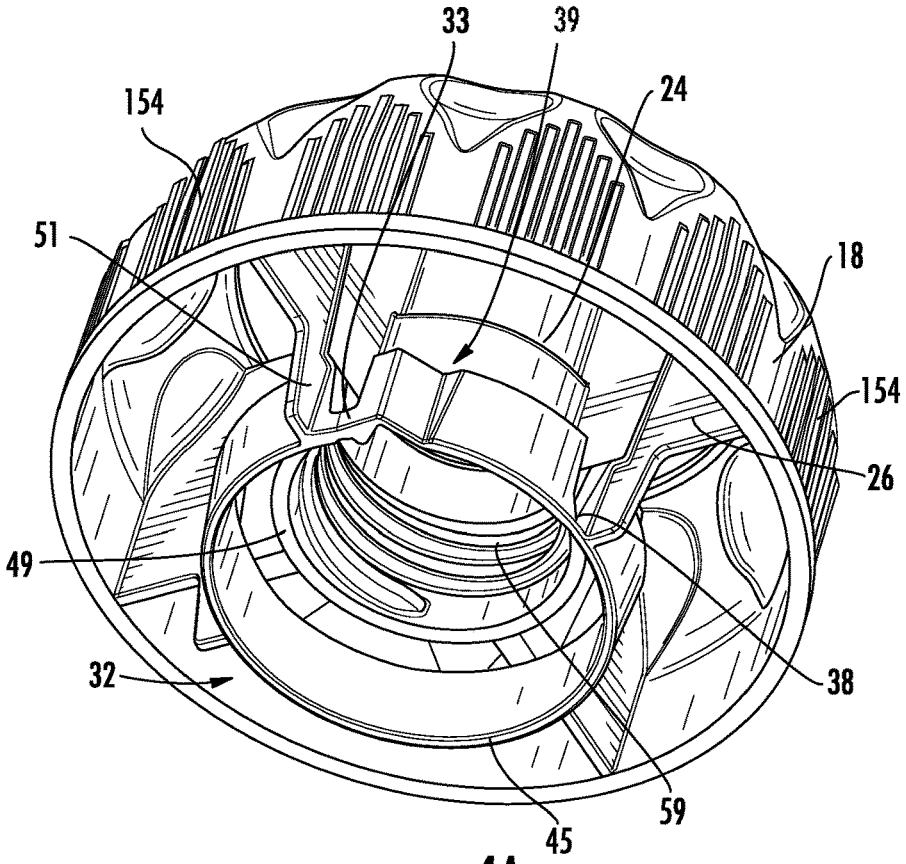
FIGS. 4A-D show various views of a closure according to an exemplary embodiment.
Figure 4B:
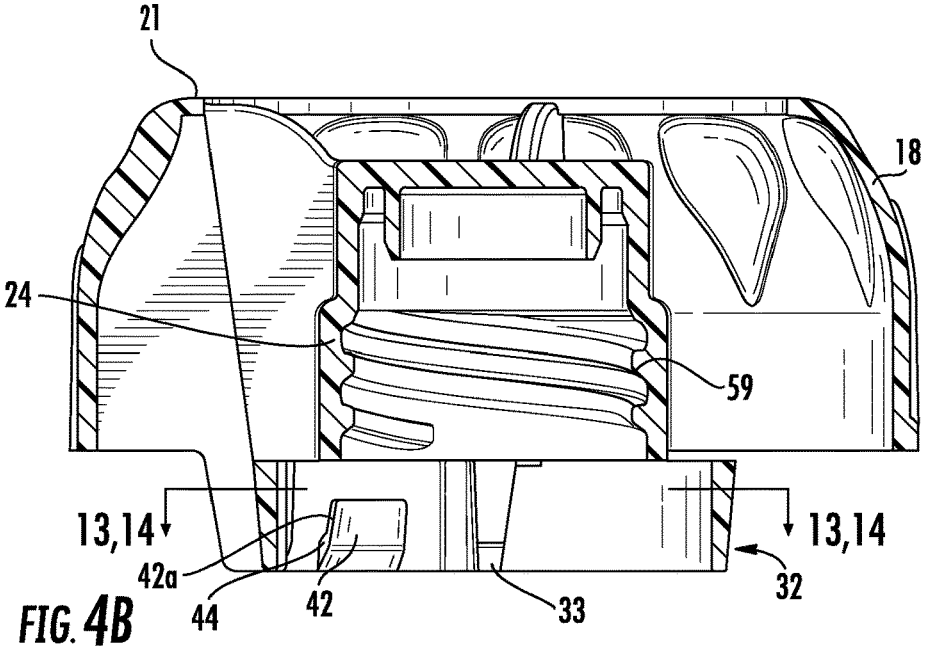
Figure 4C:
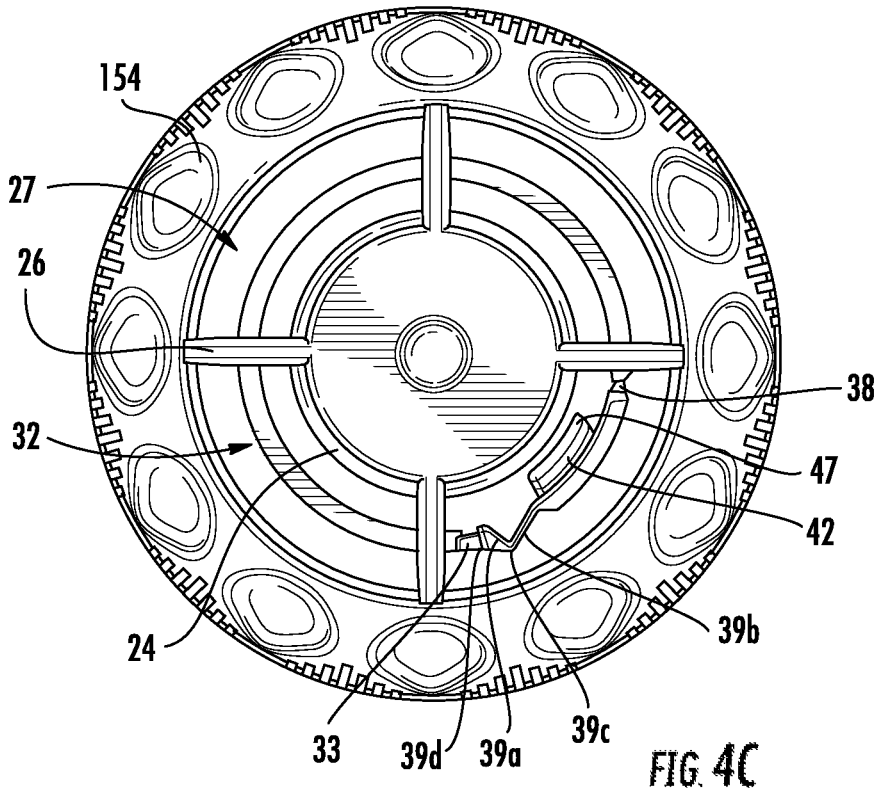
Figure 4D:
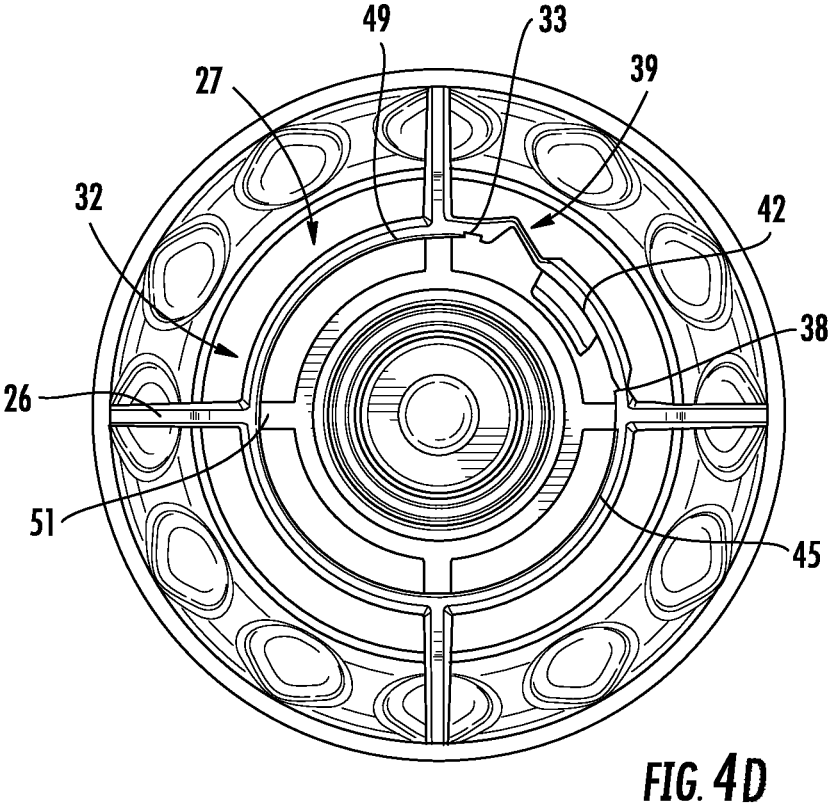

Referring to FIGS. 3C and 3D, in order to allow the knuckle 39 to more effectively collapse and increase the distortion and deflection of the tamper band 32, the knuckle 39 may be arranged about the tamper band 32 at a location near or adjacent of the hinge 33. As shown in FIG. 3C, in some embodiments the knuckle 39 may comprise an attachment portion 39*d* having a clockwise facing edge surface that is attached to and extends directly from a counterclockwise facing edge surface of the hinge 33.

As illustrated in FIGS. 3C and 3D, the attachment portion 39*d* may be forming having a wall thickness that is greater than the wall thickness of the hinge 33, as well as optionally a wall thickness greater than the wall thickness of the other portions of wall section 36. This thickened attachment portion 39*d* of knuckle 39 may be configured to provide a more stable connection between the portion of the wall section 36 extending between the bridge 38 and the hinge 33 to the hinge 33, and the attachment portion 39*d* may be configured to allow the tamper band 32 to be distorted and deflected in the desired manner to maximize tamper band 32 breakage upon initial removal of the closure 12 from spout 14.

Additionally, the thickened attachment portion 39*d* of knuckle 39 may be configured to provide a reinforced attachment of the portion of the wall section 36 extending between the bridge 38 and the hinge 33 to the hinge 33 so as to allow the folded portion of knuckle 39 to collapse upon initial removal of the closure 12 from spout 14.

As illustrated in FIGS. 3C and 3D, the folded portion of knuckle 39 comprises a first angled portion 39*a* that extends radially outwards in a counterclockwise direction from the attachment portion 39*d*. The counterclockwise facing end of the first angled portion 39*a* is attached to the clockwise facing end of a second angled portion 39*b* at an intersection portion 39*c*. The second angled portion 39*b* extends radially inwards from the intersection 39*c*, and is attached at its counterclockwise facing end to a wall section 36. This portion of the wall section 36 to which the second angled portion 39*b* is attached may correspond to a portion of the wall section that is adjacent a frangible bridge 38, and on which one or more spout engagement structures, such as, e.g. J-band 32, may be formed.

Referring to FIGS. 3C and 3D, the wall thickness of the first angled portion 39*a* decreases in thickness as the first angled portion extends radially outwards from the attachment portion 39*d*. The wall thickness of the second angled portion 39*b* is generally constant, and the wall thickness of the second angled portion 39*b* is generally thinner than the wall thickness of the remaining portions of the tamper band 42. This thinness of the second angled portion 39*b* is configured to allow the knuckle 39 to more easily deform and collapse as the spout engagement structure of the tamper band 32 interacts with the tamper band engagement structure of the spout 14.

Tamper band 32 may be formed with any number and any combination of any number of wall sections 36, bridges 38, hinges 33, and spout engagement structures such as, e.g. J-bands 42, knuckles 39, etc. For example, illustrated in FIGS. 4A-4D is one embodiment of a tamper band 32. As shown in FIGS. 4A-4D, the tamper band 32 of the embodiment of FIGS. 4A-4D includes a wall section 36 with a knuckle 39, a J-band 42, a frangible bridge 38 and a hinge 33 similar to that of the tamper band 32 embodiment of FIGS. 3A-3D. However, whereas tamper band 32 of the embodiment of FIGS. 3A-3D includes two wall sections 36, two knuckles 39, two J-bands 42, two frangible bridges 38 and two hinges 33, the tamper band 32 of the embodiment of FIGS. 4A-4D only includes one of each of these elements.

As illustrated by the comparison of the tamper band 32 embodiments of FIGS. 3A-3D and FIGS. 4A-4D, in some embodiments in which tamper band 32 includes the same elements present in different quantities, the relative spacing and arrangement of the elements about the tamper bands 32 may be similar between the two embodiments. For example, although the tamper band 32 of the embodiment of FIGS. 4A-4C only includes one set of elements, the relative spacing and arrangement of these elements about the tamper band 32 (e.g. the angular distance between the frangible bridge 38 and hinge 33, etc.) generally corresponds to the relative spacing and arrangement of these same elements about the tamper band 32 of an embodiment having more than one of these elements, such as e.g. shown in FIGS. 3A-3D. However, in other embodiments (not shown), tamper band 32 embodiments formed with different quantities of the same elements may also have different relative spacings and arrangements of these same elements about the tamper band 32.

In some embodiments of a tamper band 32 including a knuckle 39, the knuckle 39 may optionally be positioned at a location that is not adjacent to hinge 33 and/or knuckle 39 may be formed such that knuckle intersection 39*c* is located either radially outwards or inwards relative to tamper band 32. As illustrated by the tamper band 32 embodiment of FIGS. 5A-5D, in some embodiments, such as e.g. tamper band 32 embodiments having more than one spout engagement structure positioned on the portion of wall section 36 extending between a bridge 38 and a hinge 33, the knuckle 39 may be positioned about the circumference of the tamper band 32 at a location between two adjacent spout engagement structures.

Although in some embodiments where the knuckle 39 is positioned in between adjacent spout engagement structures the knuckle 39 is positioned in between two adjacent identical spout engagement structures, in other embodiments, such as e.g. shown in FIGS. 5A-5D, the knuckle 39 is positioned in between differing spout engagement structures having different configurations, sizes, etc.

As also illustrated by the embodiment of tamper band 32 of FIGS. 5A-5D, in some embodiments of a tamper band 32 incorporating a knuckle 39, the first and second angled portions 39*a*, 39*b* forming the knuckle 39 can be angled such that the intersection 39*c* of the two angled portions 39*a*, 39*b* is located radially inwards relative to the tamper band 32, rather than having the angled portions 39*a*, 39*b* arranged such that the intersection 39*c* is located radially outwards relative to the tamper band 32, such as e.g. illustrated by the embodiment of tamper band 32 of FIGS. 3A-3D.

Referring still to FIGS. 5A-5D, in some embodiments, in addition to, or as an alternative to, a J-band 42, the spout engagement structure of the tamper band 32 may include one or more radially inwardly angled hooks 22 extending from an inner surface of wall section 36. As described in more detail below, in some embodiments, engagement of the hooks 22 with the tamper band engagement structures of the spout 14 may create a resistance in the radial direction that may be used to break bridges 38 and/or cause distortion and deflection of the tamper band 32 upon initial removal of the closure 12 from spout 14.

Shown in FIGS. 6A-6E are views of a tamper band 32 embodiment that, similar to the tamper band 32 of the embodiment of FIGS. 5A-5D also includes an inwardly angled knuckle 39 located in between two different spout engagement structures. As shown in FIGS. 6A-6D, in some embodiments, the spout engagement structure of the tamper band 32 may include a modified J-band 42'.

Similar to J-band 42, the modified J-band 42' may extend radially inwards and away from a lower portion of the inner surfaces of wall sections 36 and upwards toward the upper ends of closure 12. However, as shown in FIG. 6A, unlike J-band 42 which is attached along the entirety of its lower portion to the inner surface of wall section 36, the lower portion of the modified J-band 42' includes a portion that is not attached to the inner surface of wall section 36. Additionally, as illustrated in FIG. 6A, the edge of the lower portion of the modified J-band 42' that is not attached to the wall section 36 may be spaced upwards relative to the edge of the lower portion of J-band 42' that is attached to the wall section 36, such that a gap extends along a height between the bottom of the unattached lower portion of the modified J-band 42' and the lowermost portion of wall section 36. This configuration of the partial attachment of the modified J-band 42' to the wall section 36 may be configured to provide a spout engagement structure that has combined features of a J-band and the hook 22 of the embodiment of FIG. 5A, and which can be used to both radially and/or axially effectuate breaking of bridges 38 and/or cause distortion or deflection of the tamper band 32 upon initial removal of the closure 12 from the spout. A representative illustration of one possible configuration of the resultant breakage and distortion of the tamper band 32 of the closure 12 embodiment of FIG. 6A-6D as a result of engagement of the tamper band 32 with the tamper band engagement structures of a spout 14 following initial removal of the closure 12 from spout 14 is illustrated in FIG. 6E.

Turning to FIGS. 7-10, various spout 14 embodiments are illustrated. Spout 14 generally includes a tube 20 extending about the longitudinal axis of the spout 14 and defining a central channel 52 that extends through spout 14 from an input or inlet opening to an output or outlet opening. In general, central channel 52 provides a pathway from the interior of a container (such as pouch 16) to the exterior of the container through which container contents can be accessed and removed.

Located on the upper portion of spout 14 is a closure engagement structure, shown as threads 58 that engage cooperating threads 59 of closure 12. Formed about a lower portion of spout is a mounting portion 40 along which the spout 14 is attached to pouch 16. Various embodiments of mounting portion 40 configurations that may be incorporated into any of the embodiments of spout 14 illustrated in or described with reference to any of FIGS. 7-14 are discussed in more detail below. In some embodiments, spout 14 may optionally include a structure 70 extending downwards from a lower end of the mounting portion 40 and surrounding the outlet opening that acts to prevent the outlet opening from being occluded by the sidewall of the container (e.g., pouch 16) to which spout 14 is attached.

Below threads 58, the spout 14 may include one or more annular flanges, such as, e.g. upper flange 60, central flange 64, and/or lower flange 62 that extend radially out from the exterior surface of the tube 20. In some embodiments, an annularly extending support flange 63 may also be located between the lower surface of upper flange 60 and the upper surface of central flange 64. In some embodiments, spout 14 may optionally or alternatively also include a plurality of generally vertically extending ribs 61 extending along a portion of the outer surface of spout 14 between the lower surface of flange 60 and the upper surface of support flange 63 and/or upper surface of central flange 64.

The support flange 63 and/or ribs 61 are configured to prevent the J-band 42 from unfurling/unfolding or rolling-out during removal of the closure 12 by interacting with a radially innermost section of J-band 42 during removal of the closure 12, and thus limiting the ability of J-bands 42 from tucking under flange 60 as the closure 12 moves axially upwards relative to spout 14. In some embodiments, the support flange 63 and/or ribs 61 are arranged about the entirety of the circumference of the tube 20 of spout 14. In other embodiments, the support flange 63 and/or ribs 61 may be arranged about only portions of the outer surface of the tube 20, such as, e.g. only those portions of the spout 14 about which the tamper band engagement structures of the spout 14 are formed.

Referring to FIGS. 7-10, in various embodiments of spout 14, located between upper flange 60 and central flange 64 may be provided one or more tamper band engagement structures. The one or more tamper band engagement structures are configured to interact with the tamper band 32 to break frangible bridges 38 and/or to distort or displace the tamper band 32 upon initial removal of the closure 12 from the spout 14 so as to make more recognizable to a user that the container 10 has been opened.

Figure 7A:
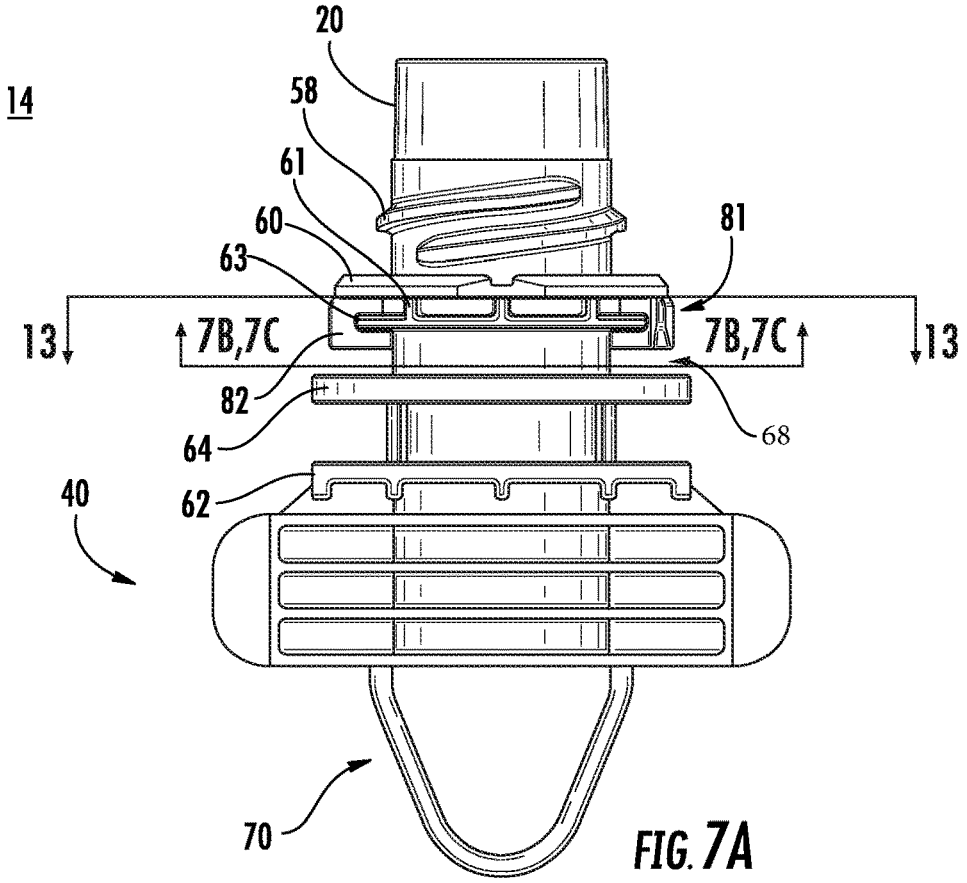
FIGS. 7A-7C show various views of a spout according to an exemplary embodiment.
Figure 7B:
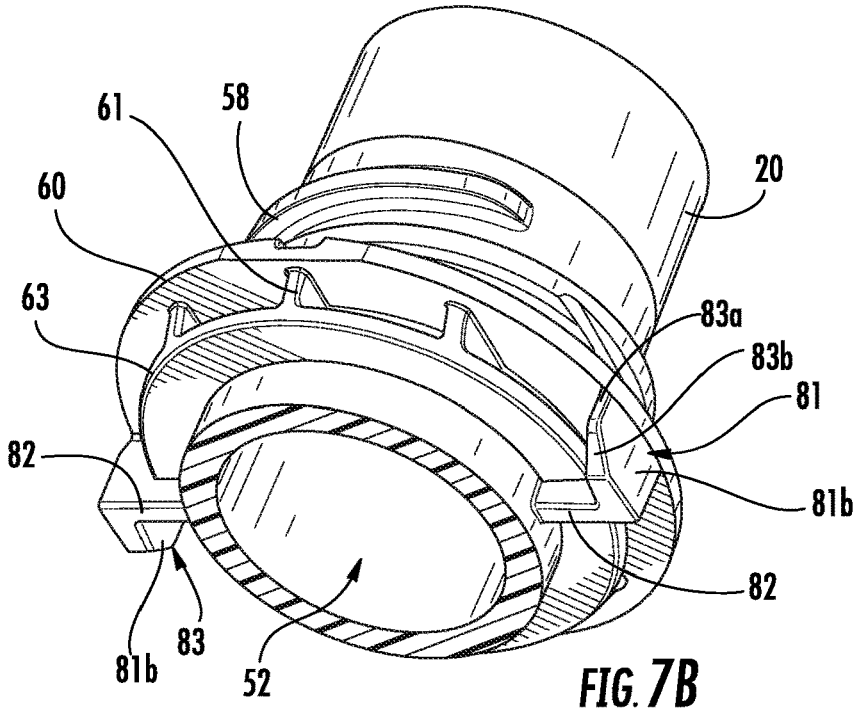
Figure 7C:
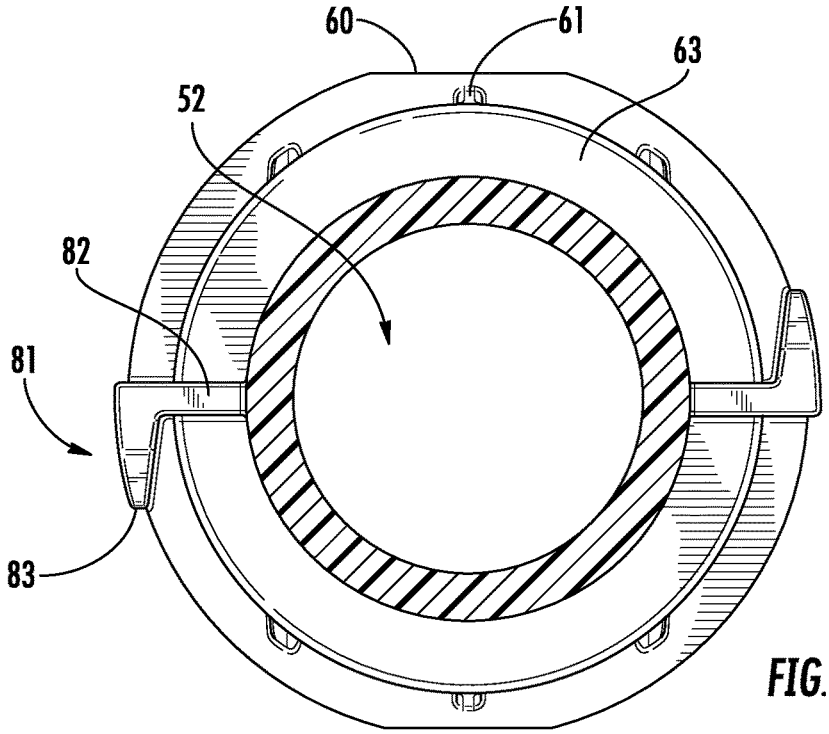

Shown in FIGS. 7A-7C is one embodiment of a tamper band engagement structure that may be provided on spout 14. As illustrated in FIG. 7B, tamper band engagement structure generally comprises one or more hooks 81 extending vertically downwards a first distance from an outermost periphery of the lower surface of upper flange 60. Extending generally perpendicularly radially outwards from the outer surface of the tube 20 towards the outer periphery of upper flange 60 are one or more arms 82.

As shown in FIGS. 7B and 7C, hooks 81 and arms 82 are arranged about spout 14 such that arms 82 are attached to hooks 81 along the counterclockwise facing ends of hooks 81. In some embodiments, such as e.g. shown in FIGS. 7A-7C, the bottommost surfaces of arms 82 generally extend from the bottom surface of the upper flange 60 such that the bottoms of the arms 82 and hooks 81 are generally coplanar. In other embodiments, the second distance may be less than or greater than the first distance, such that the bottommost surface of arms 82 extends upwards or downwards relative to the bottommost surface of hooks 81.

The outer surface 81*a* of hook 81 extends along a curve that generally mirrors the curve of the upper flange 60. The inner surface 81*b* of hook 81 extends at angle that tapers outward from the counterclockwise facing end of hook 81 to the clockwise facing end of hook 81.

Referring further to FIGS. 7B and 7C, the clockwise facing end of hook 81 is defined by an engagement surface 83 defined by the intersection of the outer surface 81*a* and inner surface 81*b* of hook 81. As shown in FIG. 7B, is some embodiments, the engagement surface 83 may be defined by an upper portion 83*a* that extends generally vertically perpendicularly from the bottom of upper flange 60, and a beveled portion 83*b* that extends along a non-perpendicular angle relative to the horizontal axis between the lower end of upper portion 83*a* and the bottommost surface of hook 81.

Any number of hooks 81 and/or arms 82 may be provided about the spout 14. As shown in FIGS. 7A-7C, in one embodiment, the hooks 81 and arms 82 are spaced evenly about the spout 14. In other embodiments, the hooks 81 and/or arms 82 may be spaced in any other configurations of even and/or uneven spacing of hooks 81 and/or arms 82 about the spout 14.

In some embodiments, the bottoms of hooks 81 and arms 82 may extend downwards towards and be attached to the upper surface of the central flange 64. However, as illustrated in FIGS. 7A-7C, in some embodiments the bottoms of hooks 81 and arms 82 may terminate above the central flange 64 such that a gap 68 is defined between the bottom surfaces of hooks 81 and arms 82 and the upper surface of central flange 64. Accordingly, in some embodiments, the lower beveled surface 83*b* of engagement surface 83 of hook 81 may be configured to be brought into contact with the outer surface of the leg 42*a* of J-band 47 upon rotation of the closure 12 relative to the spout 14, in a manner such as, e.g. described with reference to FIGS. 13A-13D below. In such embodiments, the beveled surface 83*b* of engagement surface 83 of hook may be configured to provide a larger contact surface area along which the hook 81 may engage with the J-band 42.

By providing a gap 68 in between the bottom surfaces of hooks 81 and arms 82, the ability of the spout 14 to distort and deflect the tamper band 32 upon initial removal of the closure 12 from the spout 14 may be maximized. Specifically, the presence of the gap 68 allows the J-band 47 to be kept in engagement with the tamper band engagement structure of the spout 14 for a longer period of time as the closure 12 continues to be rotated relative to the spout 14 than would be possible if no gap 68 existed. This increased time during which the J-band 47 is prevented from rotating relative to the spout 14 as the J-band 47 is engaged with the tamper band engagement structure of the spout allows the non-J-band 47 containing portion of the tamper band 32 to continue to rotate about the spout 14 by a greater degree relative to the J-band 47 prior to the J-band 47 snaking out of engagement with the tamper band engagement structure of the spout 14. This movement of parts of the tamper band 32 relative to one another impart stresses and forces onto the tamper 32 which result in portions of the tamper band 32, e.g. the knuckles 39 and/or hinges 33, distorting to a greater extent than they would if the J-band 47 were to be able to more quickly disengage from the tamper band engagement structure of the spout 14 during rotation of the closure 12, such as, e.g. would occur if no gap 68 existed.

In some embodiments, the height of the gap 68, as measured in between the bottommost surface of hooks 81 and the upper surface of central flange 64 is between approximately 0.01 inches and approximately 0.10 inches, more specifically in between approximately 0.03 inches and approximately 0.07 inches, even more specifically in between approximately 0.045 inches and approximately 0.055 inches, an in particular 0.05 inches.

In some embodiments, the height of the hook 81, as measured in between the bottommost surface of hooks 81 and the bottom surface of upper flange 60 is between approximately 0.08 inches and approximately 0.18 inches, more specifically in between approximately 0.10 inches and approximately 0.15 inches, even more specifically in between approximately 0.125 inches and approximately 0.145 inches, an in particular 0.133 inches.

In some embodiments, the length of the outer surface 81*a* of the hook 81, as measured in a linear direction from the counterclockwise end of the hook 81 to the upper portion 83*a* of the engagement surface 83 is between approximately 0.05 inches and approximately 0.15 inches, more specifically in between approximately 0.08 inches and approximately 0.13 inches, even more specifically in between approximately 0.095 inches and approximately 0.105 inches, an in particular 0.1 inches.

In some embodiments, the length of the outer surface 81*a* of the hook 81, as measured in a linear direction from the counterclockwise end of the hook 81 to the lower portion 83*b* of the engagement surface 83 is between approximately 0.02 inches and approximately 0.10 inches, more specifically in between approximately 0.04 inches and approximately 0.08 inches, even more specifically in between approximately 0.055 inches and approximately 0.065 inches, an in particular 0.059 inches.

Figure 8A:
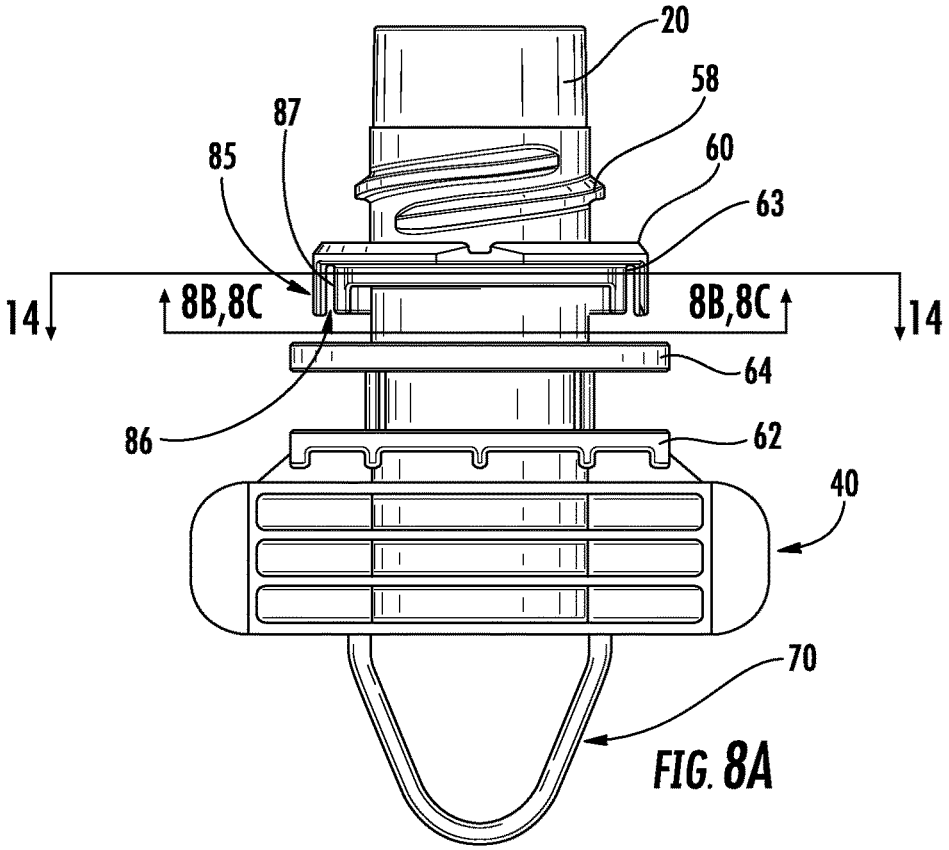
FIGS. 8A-8C show various views of a spout according to an exemplary embodiment.
Figure 8B:
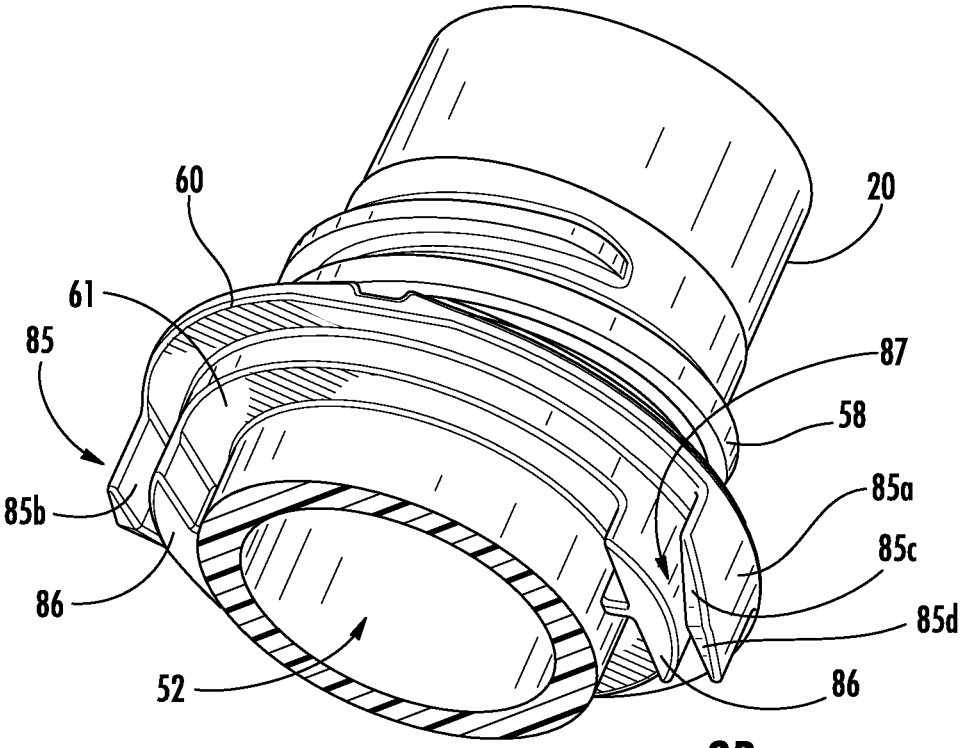
Figure 8C:
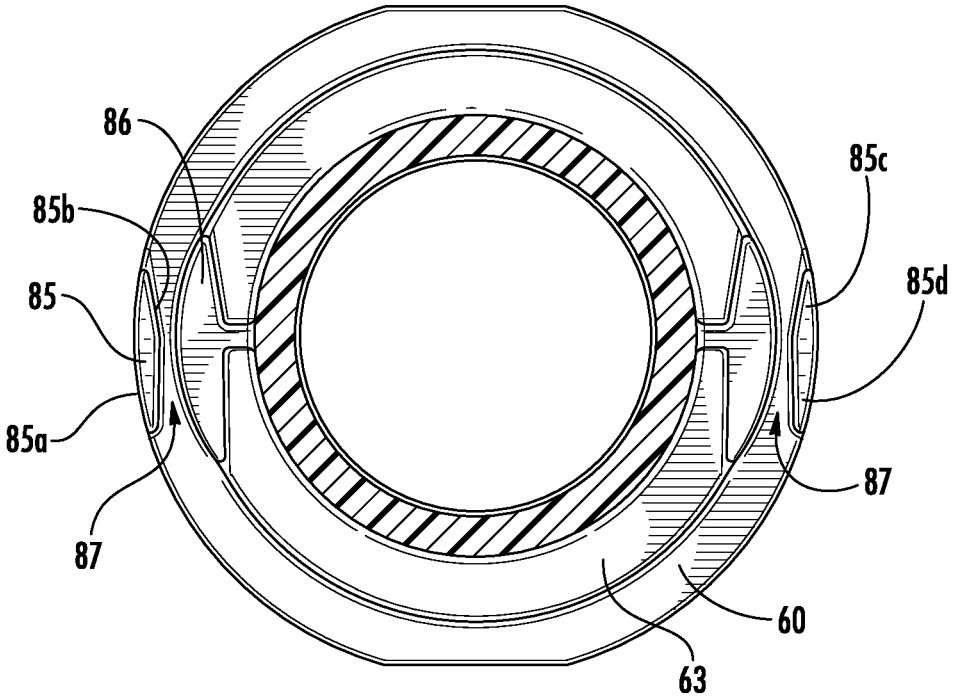

Illustrated in FIGS. 8A-8C is a spout 14 having a tamper band engagement structure according to another embodiment. As illustrated in FIG. 8B, extending generally perpendicularly downwards from the bottom surface of upper flange 60 is a wedge element 85. Referring to FIG. 8C, although the outer surface 85*a* of wedge 85 is curved so as to generally correspond to the outer curved periphery of the upper flange 60, the inner surface 85*b* of wedge element 85 extends along linearly extending surfaces. Also extending downwards from a lower surface of upper flange 60 is a support element 86 having a curved outer surface. As shown in FIG. 8C, in embodiments in which the spout 14 is provided with a support flange 63, the outermost diameter of the outer surface of the support element 86 may generally correspond to or be slightly greater than the outermost diameter of support flange 63.

Defined between the curved outer surface of support element 86 and the linearly extending inner surface 85*b* of wedge 85 is a keyway 87. As shown in FIG. 8C, in some embodiments the linearly extending inner surface 85*b* of wedge 85 may be defined by first and second walls extending inwardly from the ends of wedge 85 and which intersect at a location positioned radially inwards from the locations of the ends of wedge 85. In other embodiments, a single linear wall may join the clockwise facing and counterclockwise facing ends of wedge 85.

Referring to FIGS. 8A and 8B, in some embodiments the clockwise facing end of the wedge 85 may be defined by a beveled lead edge 85*c* that extends downwards from the clockwise end of wedge 85, and which transitions into a counterclockwise wedge end defined by a generally horizontally extending bottom surface 85*d*. In other embodiments, the lead edge 85*c* may be coplanar with the bottom surface 85*d* of wedge 85.

Figure 9A:
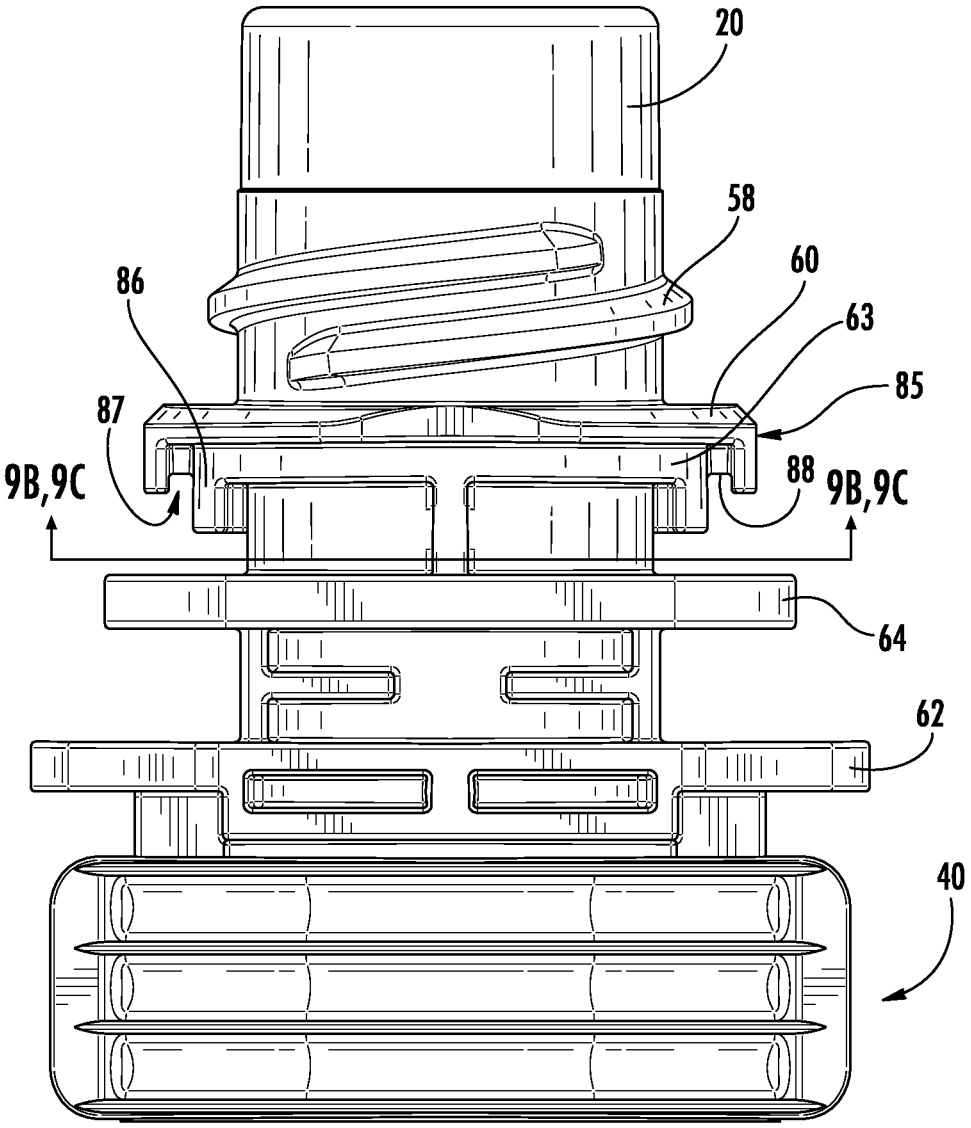
FIGS. 9A-9C show various views of a spout according to an exemplary embodiment.
Figure 9B:
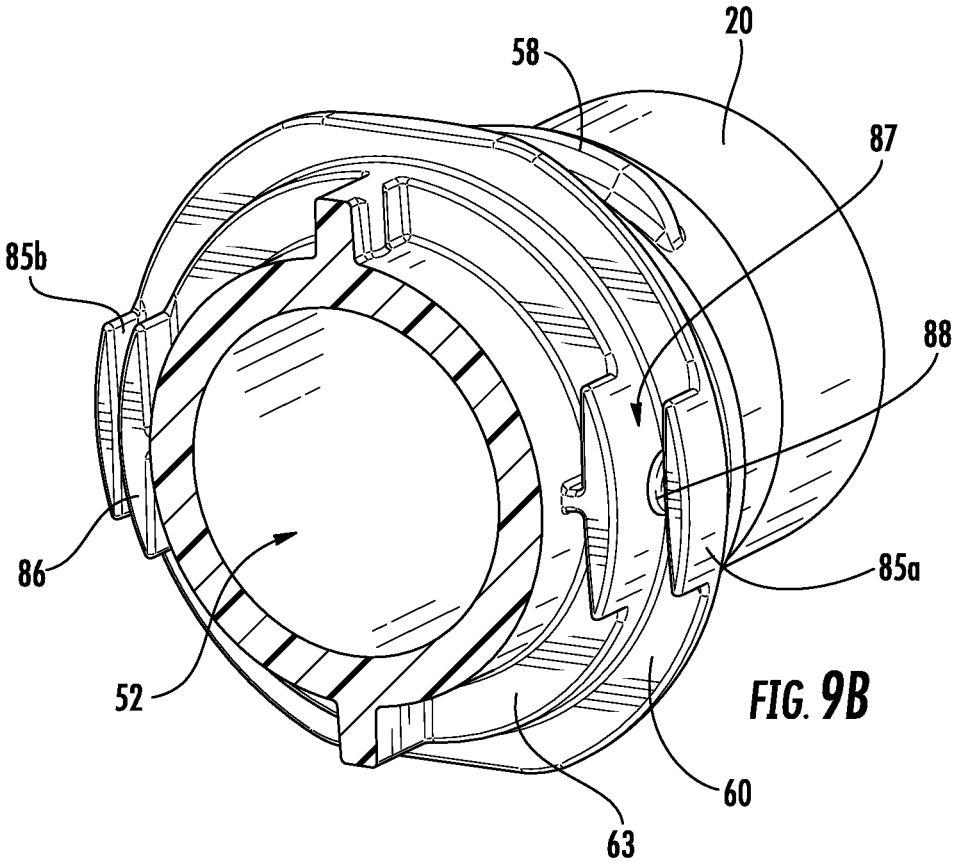
Figure 9C:
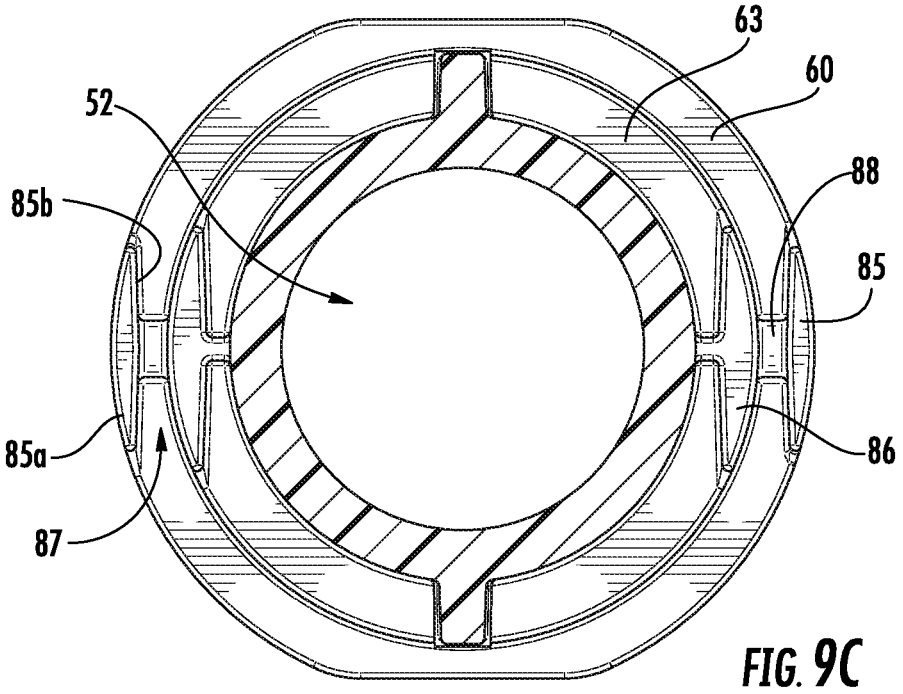

Turning to FIGS. 9A-9C, a spout 14 having a tamper band engagement structure according to another embodiment is shown. Similar to the spout 14 embodiment of FIGS. 8A-8C, the embodiment of spout 14 of FIGS. 9A-9C also comprises one or more wedge elements 85 and support elements 86 extending perpendicularly downwards from the lower surface of upper flange 60. Similar to the spout 14 embodiment of FIGS. 8A-8C, the outermost diameter of the outer surface 86 of support element 86 may generally correspond to or be slightly greater than the outermost diameter of support flange 63.

Referring to FIGS. 9B and 9C, in contrast to the inwardly angled inner surface 85*b* of wedge 85 of the embodiment of spout 14 illustrated in FIGS. 8A-8C, the inner surface 85*b* of the wedge 85 of the spout 14 embodiment of FIGS. 9A-9C extends along a single plane between the clockwise and counterclockwise ends of wedge 85. Accordingly, as illustrated in FIGS. 9A-9C, the keyway 87 defined between the outer surface of support element 86 and the inner surface 85*b* of wedge 85 of the spout 14 of FIGS. 9A-9C is relatively wider than that keyway 87 of the spout 14 embodiment of FIGS. 8A-8C.

Referring to FIGS. 9A and 9B, in some embodiments, the bottom surface of wedge 85 may extend along a single plane. In other embodiment, the counterclockwise facing end of wedge 85 may be formed with a lead edge that extends downwards from the clockwise end of wedge 85, such as, e.g. the lead edge 85*c* described with reference to the spout 14 embodiment of FIGS. 8A-8C.

As compared to the embodiment of FIGS. 8A-8C, the wedge 85 of the embodiment of spout 14 of FIGS. 9A-9C extends downwards by a smaller distance from the lower surface of upper flange 60. In particular, in some embodiments, the height of the wedge 85 of the embodiment of spout 14 of FIGS. 9A-9C is less than the height of the J-bands 42 of the tamper band 32 of the closure 12 with which the spout 14 embodiment of FIGS. 9A-9C is to be sealed.

As illustrated in FIGS. 9A-9C, extending in the keyway 87 of spout 14 may be one or more detents 88 that may be configured to provide tactile feedback to a user during removal of the closure 12 from the spout 14. Also, in some embodiments, e.g. where the spout 14 of FIGS. 9A-9C is sealed by the closure 12 embodiment of FIGS. 3A-3D, upon initial removal of the closure 12, the resistance encountered as a result of the engagement of the leading, counterclockwise facing end of J-band 42 with the detent 88 allows the knuckle 39 to collapse. As the closure 12 continues to be rotated, the engagement of the upper surface 47 of J-band 42 with the lower surface of the detent 88, and the subsequent contact of the upper surface 47 of J-band 42 with the lower surface of upper flange 60 provides an axial resistance to the upwards movement of the closure 12, which causes the bridges 38 of tamper band 32 to break.

Figure 10A:
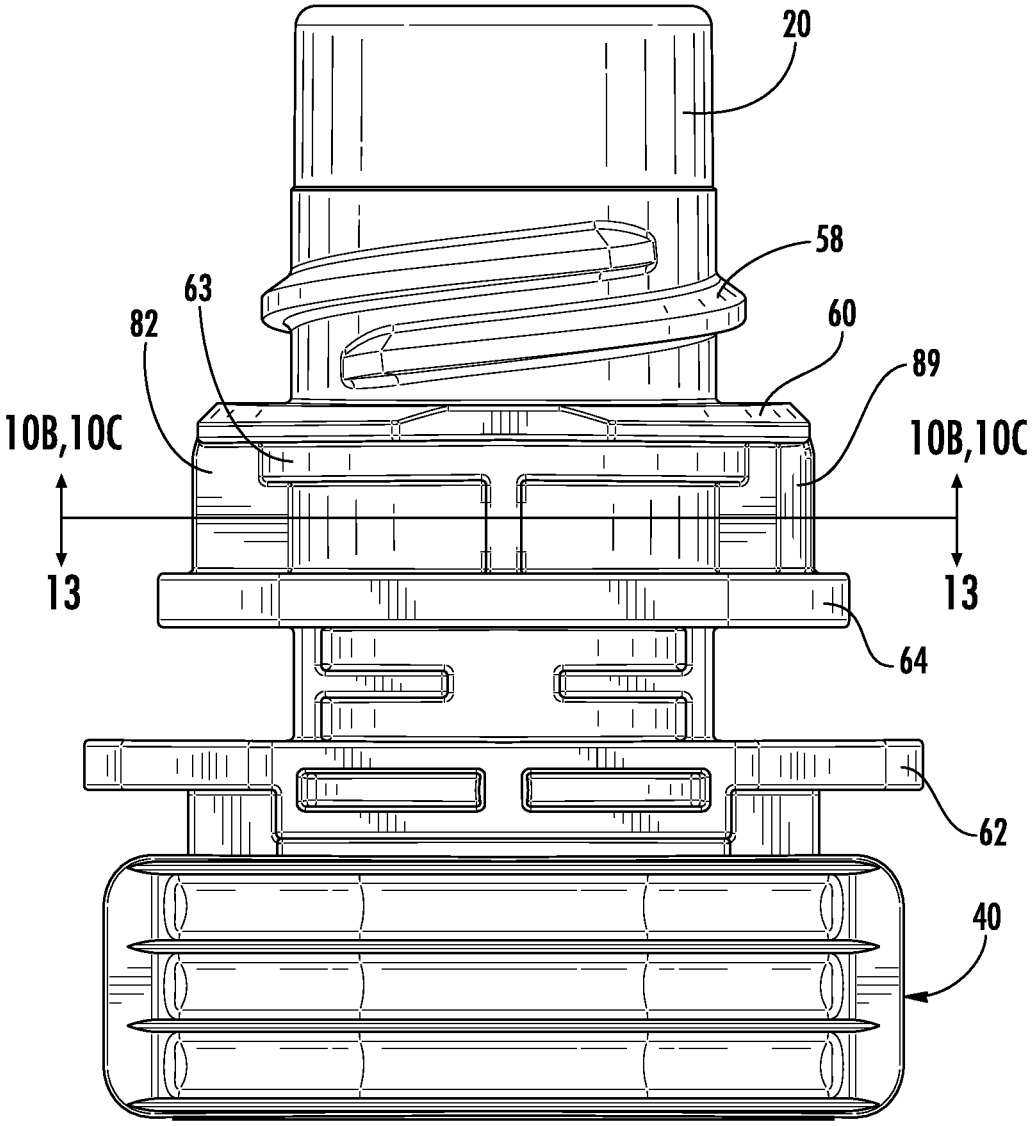
FIGS. 10A-10C show various views of a spout according to an exemplary embodiment.
Figure 10B:
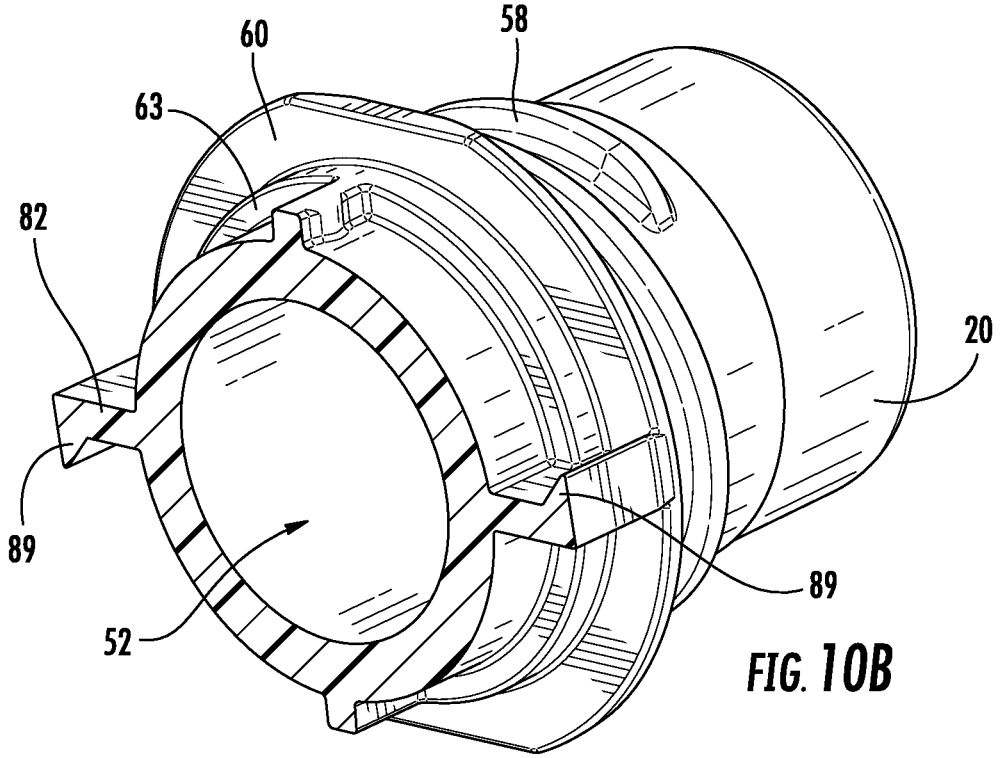
Figure 10C:
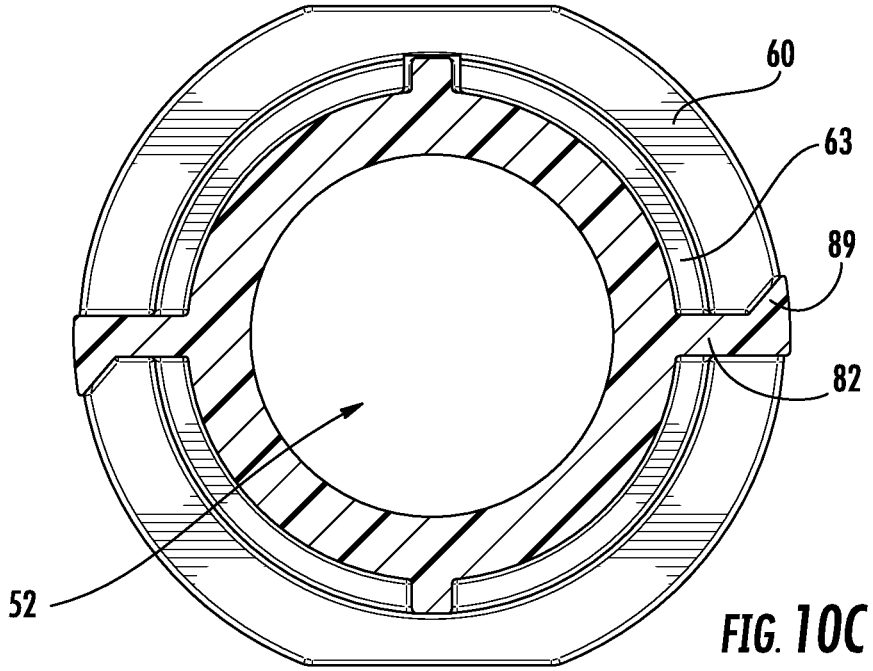

Referring to FIGS. 10A-10C, another embodiment of a spout 14 having a tamper band engagement structure is illustrated. As shown in FIGS. 10B and 10C, extending outwardly from the outer surface of tube 20 are one or more arms 82. Formed at the outermost ends of arms, at a location generally corresponding to the outer periphery of the upper flange 60 is an outwardly flared catch 89. As illustrated in FIG. 10A, in some embodiments the arms 82 and catches 89 are attached to and extend between the lower surface of upper flange 60 and the upper surface of central flange 64.

In general, tamper band engagement structures of spout 14 and spout engagement structures of tamper band 32, e.g. such as those illustrated in and described with reference to FIGS. 2-10, are configured so as to effectuate breakage of frangible bridges 38 upon initial removal of the closure 12 from the spout 14. In various embodiments, the tamper band engagement structures of spout 14 and spout engagement structures of tamper band 32 may also be configured so as to increase the distortion, dislocation, or other disruption of the broken tamper band 32 from the initial, generally circular tamper band 32 configuration upon removal of the closure 12 from spout 14, so as to increase the visibility of the break in the tamper band 32, which allows a user to more easily distinguish that a container 10 has previously been opened. In such embodiments in which initial removal of the closure 12 results in both breakage or bridges 38 and distortion of the tamper band 32, the order in which the breakage of bridges 38 and/or distortion of the tamper band 32 occurs may be such that the breakage of bridges 38 occurs prior to, after, or during the distortion of the tamper band 32.

The breakage of the bridges 38 and/or the distortion of the tamper band 32 may be effectuated by resistance to the rotational and/or axial movement of the closure 12 caused by the rotational and/or axial engagement of the spout engagement structures of the tamper band 32 with the tamper band engagement structures of the spout 14 upon initial removal of the closure 12 from spout 14.

In some embodiments, the breakage of bridges 38 and/or distortion of the tamper band 32 may occur solely as a result of resistance to the rotational movement of the closure 12. In other embodiments, the breakage of bridges 38 and/or distortion of the tamper band 32 may occur solely as a result of resistance to the movement of the closure 12 in an axial direction upon initial removal of the closure 12 from the spout.

In yet other embodiments, the breakage of bridges 38 and/or distortion of the tamper band 32 may occur as a result of both resistance to the rotational and axial movement of the closure 12 relative to the spout 14 caused by the engagement of the spout engagement structures of the tamper band 32 with the tamper band engagement structures of the spout 14. In such embodiments, the manner in which the closure 12 encounters the axial and rotational resistance may be such that: breakage of the bridges 38 is effectuated only by rotational resistance, only by axial resistance, or by a combination of both axial and rotational resistance. Similarly, the distortion of the tamper band 32 may be effectuated by only rotational resistance, only by axial resistance, or by a combination of both axial and rotational resistance. Furthermore, in such embodiments in which the closure 12 experiences both rotational and axial resistance to movement of the closure 12, the order in which the resistance is encountered may be such that axial resistance is first encountered, rotational resistance is first encountered, or both axial and rotational resistance are encountered simultaneously.

Illustrated in and described with reference to FIGS. 11-14 below are examples of various embodiments of closure 12 and spout 14 combinations that may be used to seal container 10. However, as will generally be understood, various other combinations of the closures 12 and spouts 14 illustrated in or described with reference to FIGS. 2-10 (or any number of modifications of the closures 12 and/or spouts 14 of FIGS. 2-10) may be used to seal container 10, depending on the type of and order of the resistance (i.e. axial and/or rotational) between the spout engagement structures of the tamper band 32 with the tamper band engagement structures of the spout 14 that is desired to effectuate the breaking of bridges 38 and/or distortion of the tamper band 32 upon initial removal of the closure 12 from the container 10.

Figure 11:
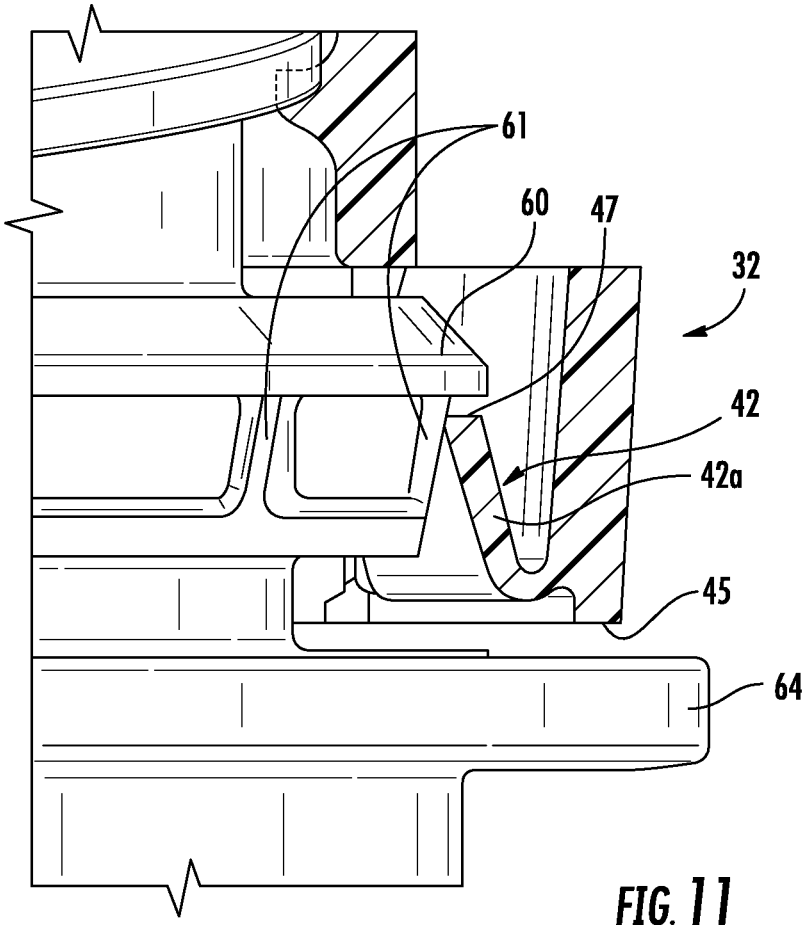
FIG. 11 shows a detailed sectional view of the interaction of the tamper band portion of the closure and the spout.

As discussed above, in various embodiments of tamper band 32, the spout engagement structure of the tamper band 32 may include one or more J-bands 42. Illustrated in FIG. 11 is a detailed cross-sectional view of an embodiment of a closure 12 having a tamper band 32 incorporating a J-band 42 coupled to a spout 14 having an upper flange 60. As shown in FIG. 11, when closure 12 is fully engaged on spout 14, J-bands 42 are engaged underneath flange 60. In this arrangement, tamper band 32 is positioned between the central flange 64 and the upper flange 60 such that in the closed configuration of the container 10, the upper surfaces 47 of each J-band 42 are facing and spaced apart from the bottom surface of upper flange 60.

As closure 12 is initially removed, closure 12 begins to move upwards relative to spout 14, causing the upper surfaces 47 of J-bands 42 to interact with the bottom surface of upper flange 60. As the closure 12 continues to move upwards relative to the spout 14, the interaction of J-bands 42 with upper flange 60 provides resistance to the upward axial movement of the portions of the tamper band 32 about which J-bands 42 are formed. Meanwhile, those portions of the tamper band 32 about which no J-bands 42 are formed continue to move upwards relative to the spout 14. As the axial distance between these J-band 42 and non-J-band 42 containing portions of the tamper band 32 increases, tension and stress is increasingly imparted onto the bridges 38, which eventually causes the bridges 38 to break.

Once the bridges 38 have been broken and as the upper surfaces 47 of J-bands 42 continue to engage with the bottom surface of upper flange 60, the attachment of the J-band 42 containing portions of the tamper band 42 to the rest of tamper band 32 via hinges 33 allows the tamper band 32 to flex outwards about hinges 33 and move upwards and axially past the upper flange 60. Thus, once the bridges 38 have been broken, the entirety of the tamper band 32, including those portions about which J-band 42 are formed, is able to move axially upwards in response to the continued removal of the closure 12.

Figure 12A:
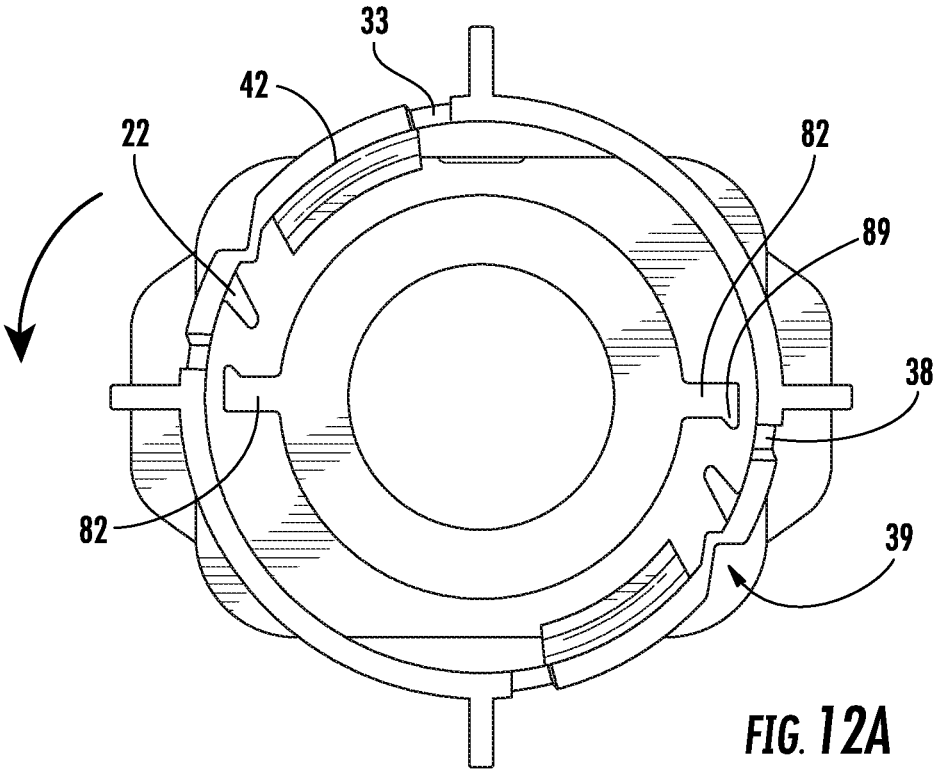
FIGS. 12A-12E show a cross-sectional view of the closure of FIG. 5A at various stages of engagement with the spout FIG. 10A, as taken along lines 12-12 of FIG. 5B and FIG. 10A, during initial removal of the closure from the spout according to one embodiment.

Illustrated in FIGS. 12A-12E is a progression of the interaction of the spout engagement structures of the tamper band 32 of the embodiment of closure 12 of FIGS. 5A-5D with the tamper band engagement structures of the embodiment of spout 14 of FIGS. 10A-10C, according to one embodiment. Referring to FIG. 12A, the original configuration of the closure 12 relative to the spout 14 in the initial sealing position, and prior to the initial removal of the closure 12 from the spout 14 is shown.

Figure 12B:
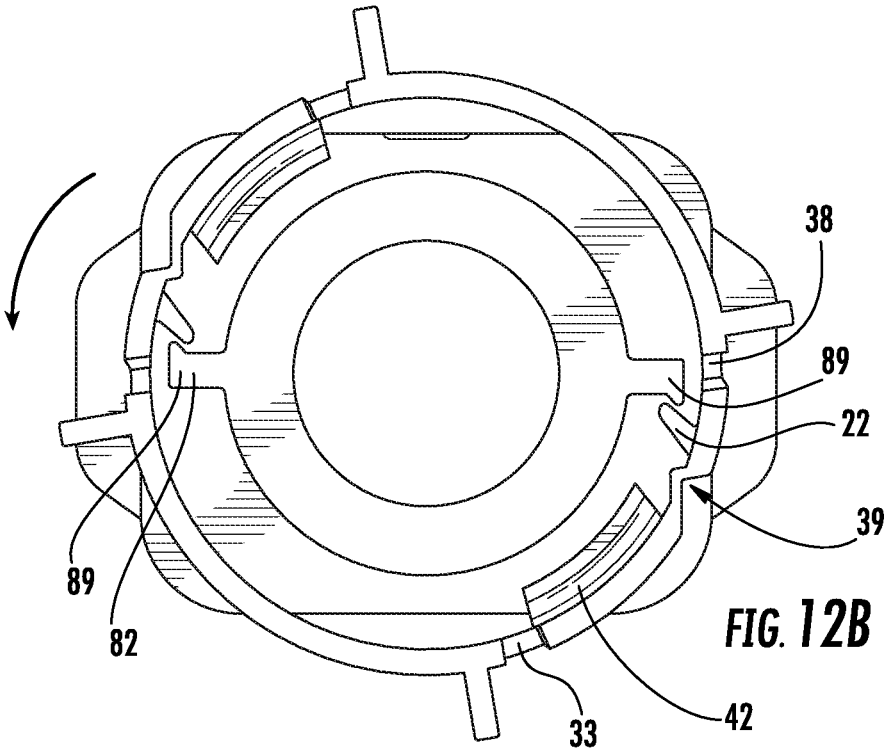

Illustrated in FIG. 12B is the arrangement of closure 12 relative to spout 14 following a rotation of approximately 13° of the closure 12 in the counterclockwise direction upon initial removal of the closure 12 from the spout 14. As shown in FIG. 12B, at this 13° rotational position, the spout engagement structures of the tamper band 32 have moved closer into contact with the tamper band engagement structures of the spout 14, but have not yet engaged these elements. Furthermore, while the closure 12 has travelled axially upwards relative to the spout 14, the upper surfaces 47 of the J-bands 42 have not yet engaged the underside of the lower surface of upper flange 60.

Figure 12C:
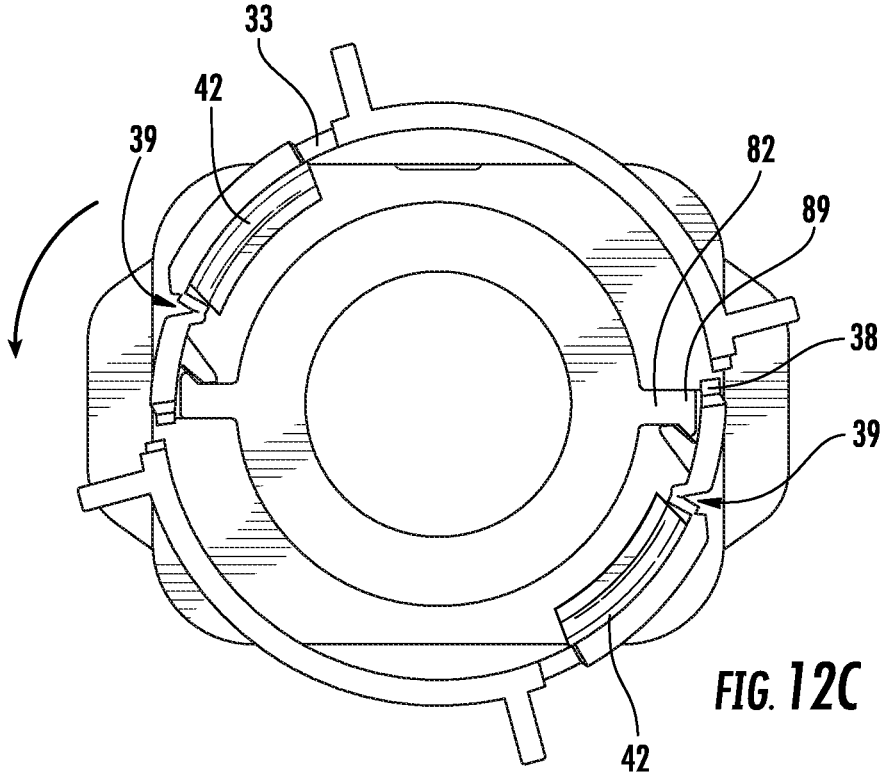

The arrangement of closure 12 and spout 14 following 15° of rotation of the closure 12 relative to the spout 14 during initial removal of the closure 12 is illustrated in FIG. 12C. As shown in FIG. 12C, in this position, the inwardly angled hooks 22 forming a portion of the spout engagement structure of the tamper band 32 have engaged the catches 89 forming a portion of the tamper band engagement portions of the spout 14. This interaction of the hooks 22 with the catches 89 creates a resistance to the rotation of the closure 12 relative to the spout 14, with this resistance contributing to the collapsing of the knuckle 39 and the breaking of the frangible bridges 38 as illustrated in FIG. 12C.

Additionally, following 15° of rotation of the closure 12 relative to the spout 14 during initial removal of the closure 12 as illustrated in FIG. 12C, the closure 12 has traveled upwards relative to the spout 14 by such a distance that the lower surfaces 47 of J-bands 42 have come into contact with the underside of the upper flange 60. As described with reference to FIG. 11, this engagement of the J-bands 42 with the lower surface of upper flange 60 is configured to assist in breaking bridges 38.

Figure 5A:
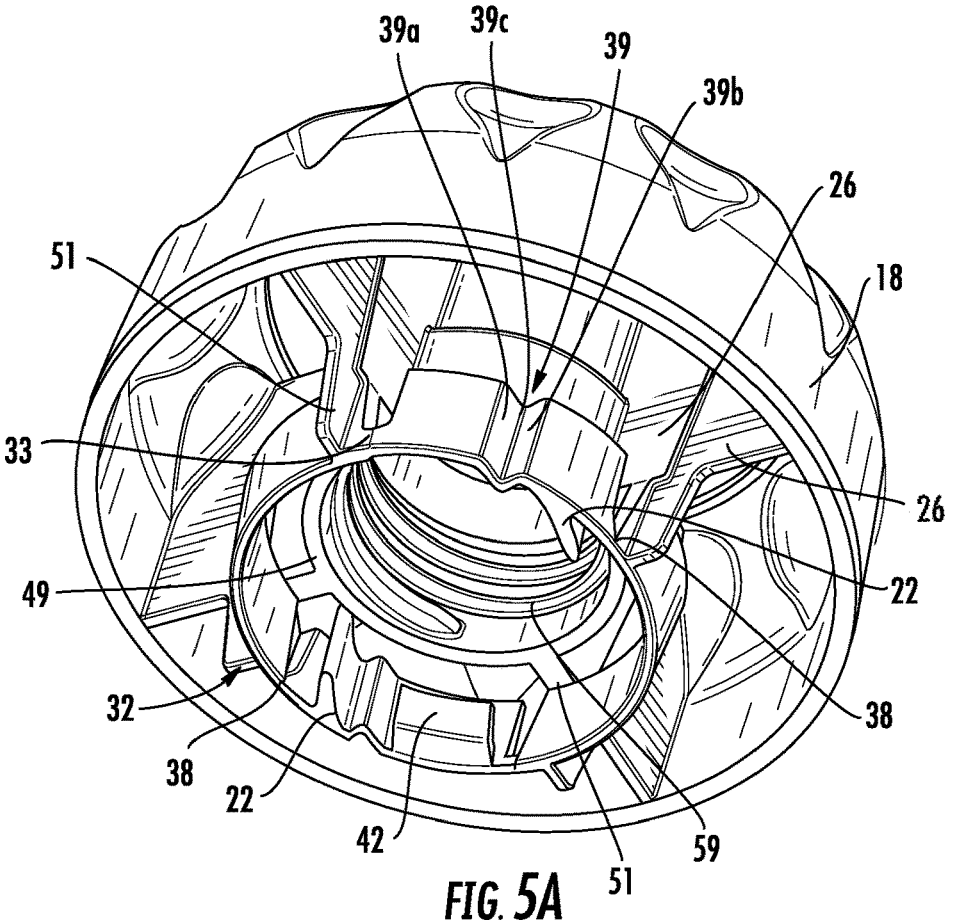
FIGS. 5A-D show various views of a closure according to an exemplary embodiment.
Figure 5B:
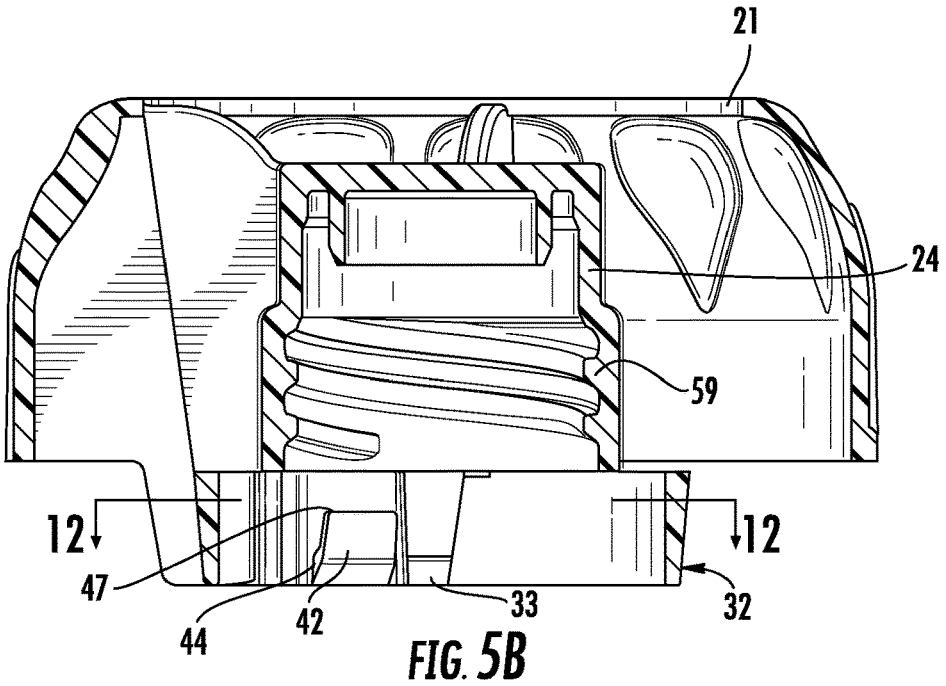
Figure 5C:
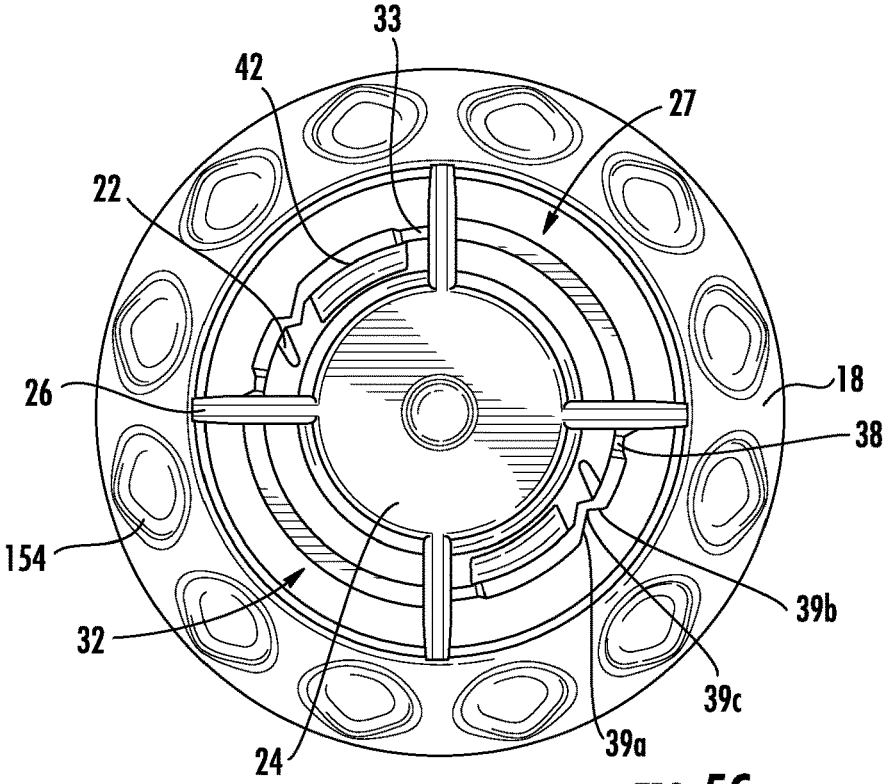
Figure 5D:
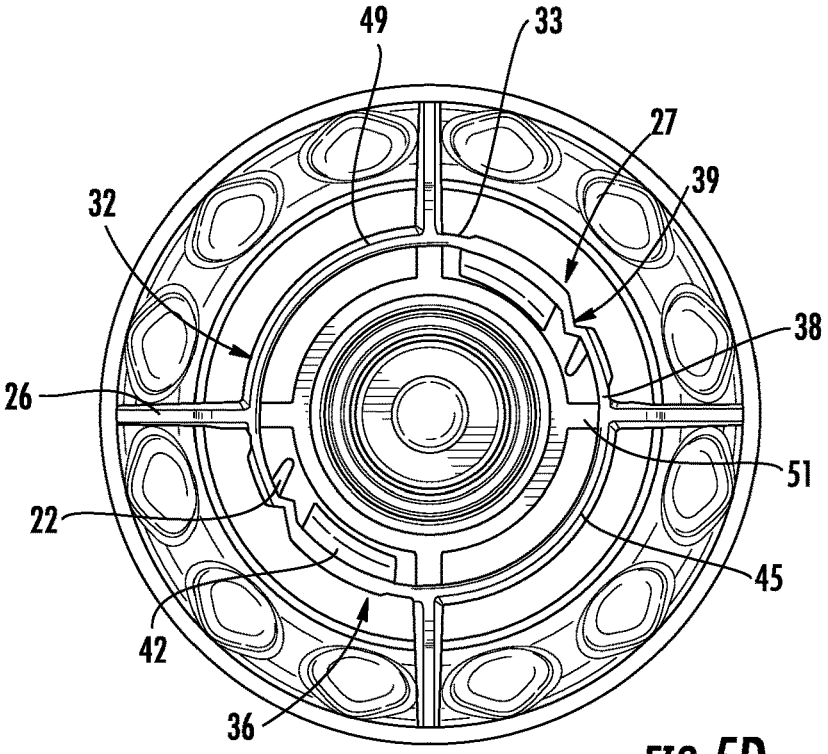
Figure 6A:
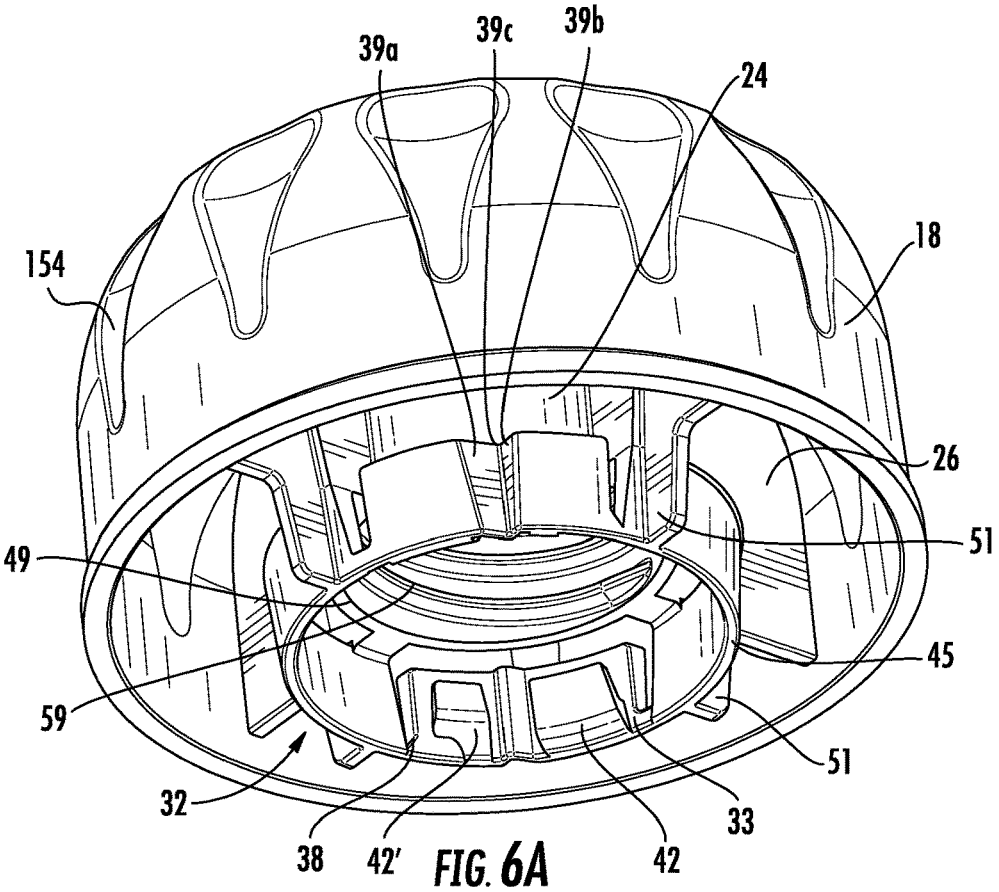
FIGS. 6A-E show various views of a closure, including a view of the closure following initial removal of the closure from a spout, according to an exemplary embodiment.
Figure 6B:
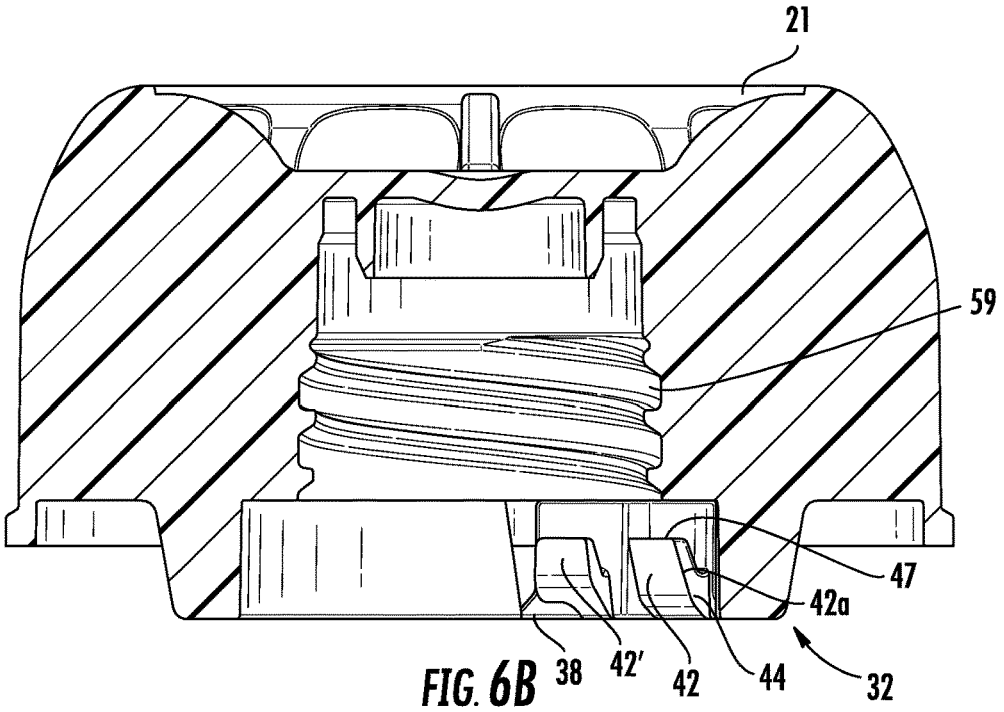
Figure 6C:
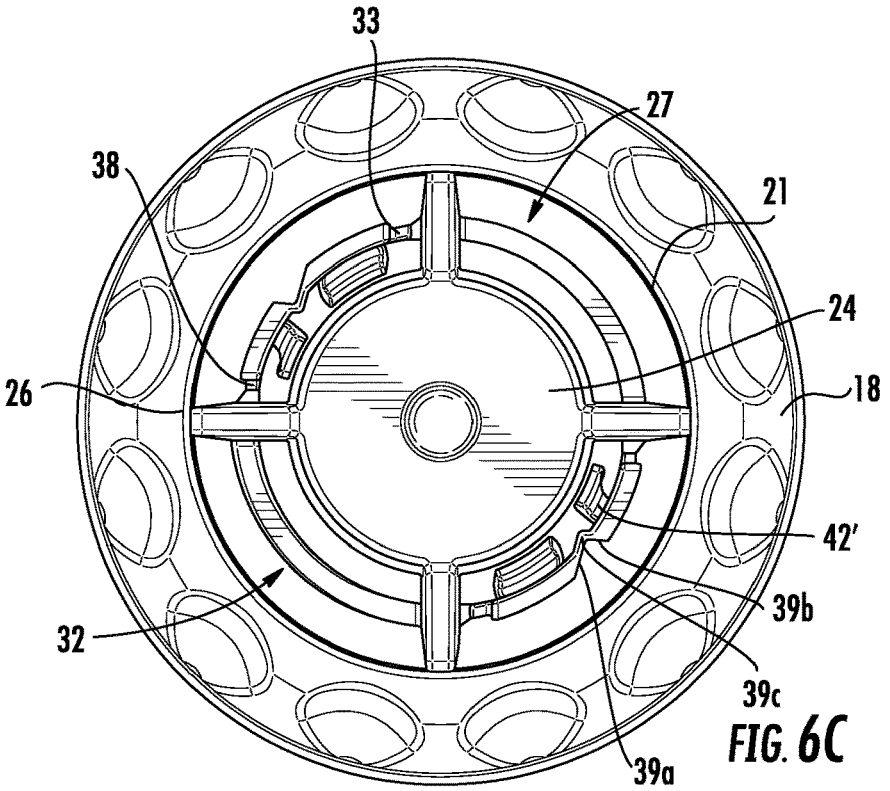
Figure 6D:
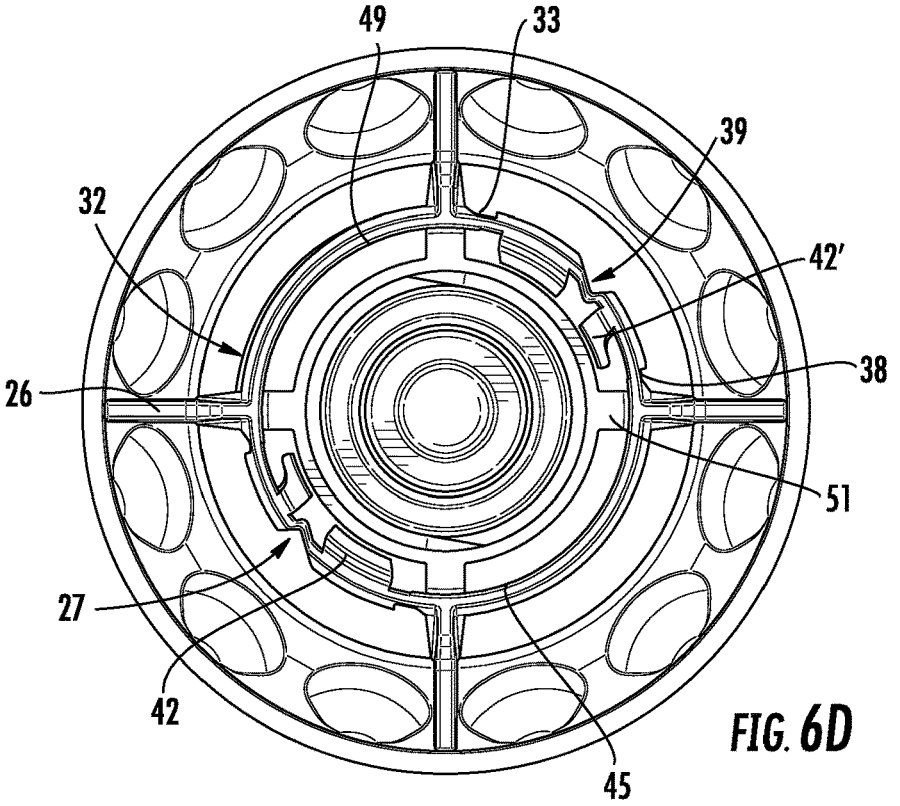
Figure 6E:
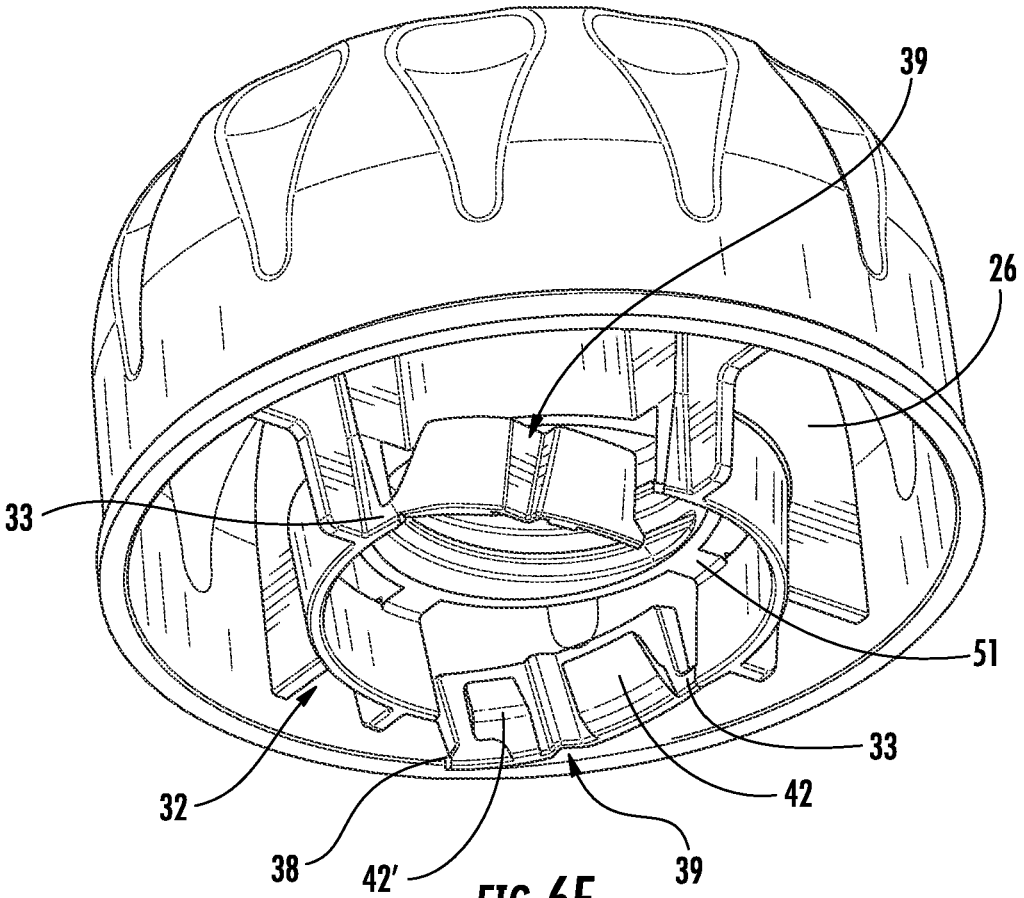
Figure 12D:
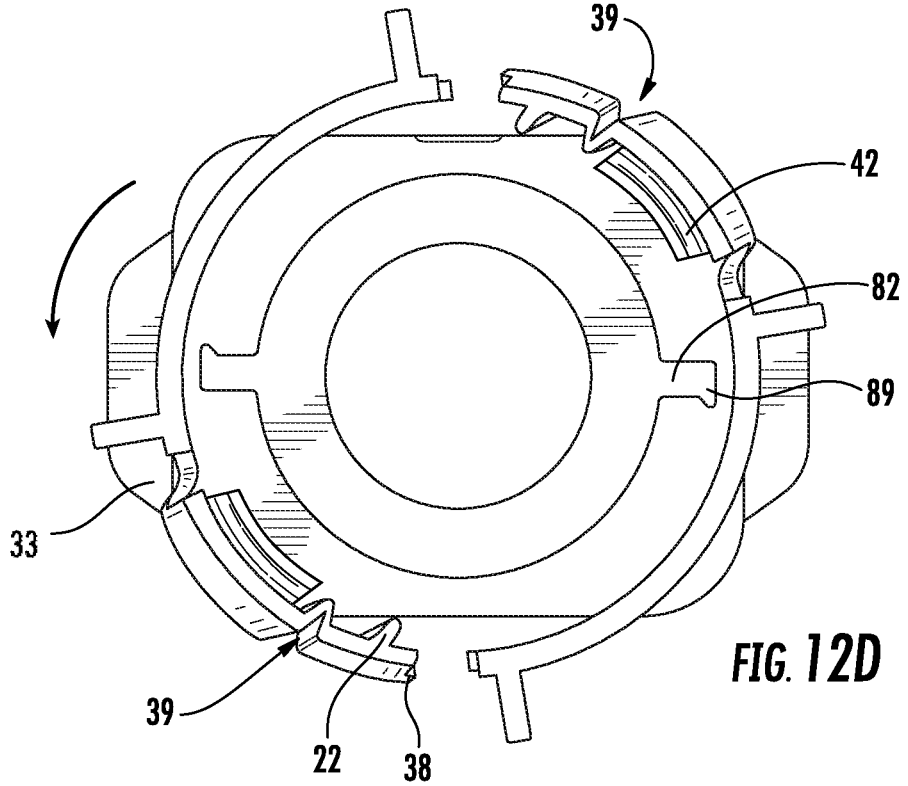
Figure 12E:
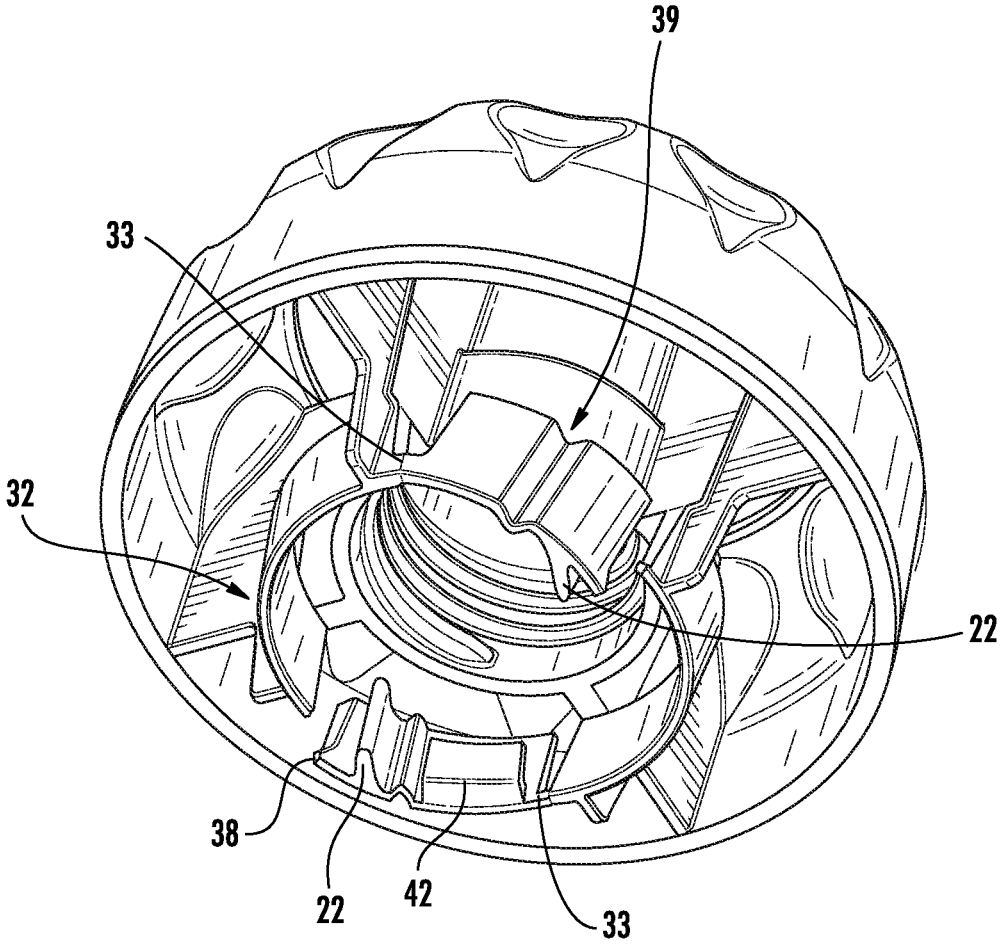

Furthermore, once the bridges 38 have been broken and as the closure 12 continues to be rotated and move upwards, the continued engagement of the upper surfaces 47 of the J-bands 42 with the lower surface of the upper flange 60 imparts a downward force along the upper surfaces 47 of J-bands 42 that forces the tamper band 32 to twist and distort about the hinge 33, such as e.g. in the manner illustrated in FIG. 12D, which illustrates an exemplary embodiment of the distortion of the tamper band 32 of the closure 12 embodiment of FIG. 5A following approximately 110° of rotation. Shown in FIG. 12E is a representation of the distorted and displaced tamper band 32 of the closure 12 embodiment of FIG. 5A upon removal of the closure 12 from the spout 14 of the embodiment of FIGS. 10A-10C.

Turning to FIGS. 13A-13D, the progression of the interaction of the spout engagement structures of the tamper band 32 of the embodiment of closure 12 of FIGS. 4A-4D with the tamper band engagement structures of the embodiment of spout 14 of FIGS. 7A-7C is shown. Although the closure 12 that is shown is an embodiment of closure 12 having only a single set of spout engagement structures, it is to be understood that the progression of engagement of the spout engagement structures of the tamper band 32 embodiment having a plurality of such elements, such as e.g. illustrated in FIGS. 3A-3D, with the tamper band engagement structures of spout 14 shown in FIGS. 7A-7C would be similar to that illustrated in FIGS. 13A-13D.

Figure 13A:
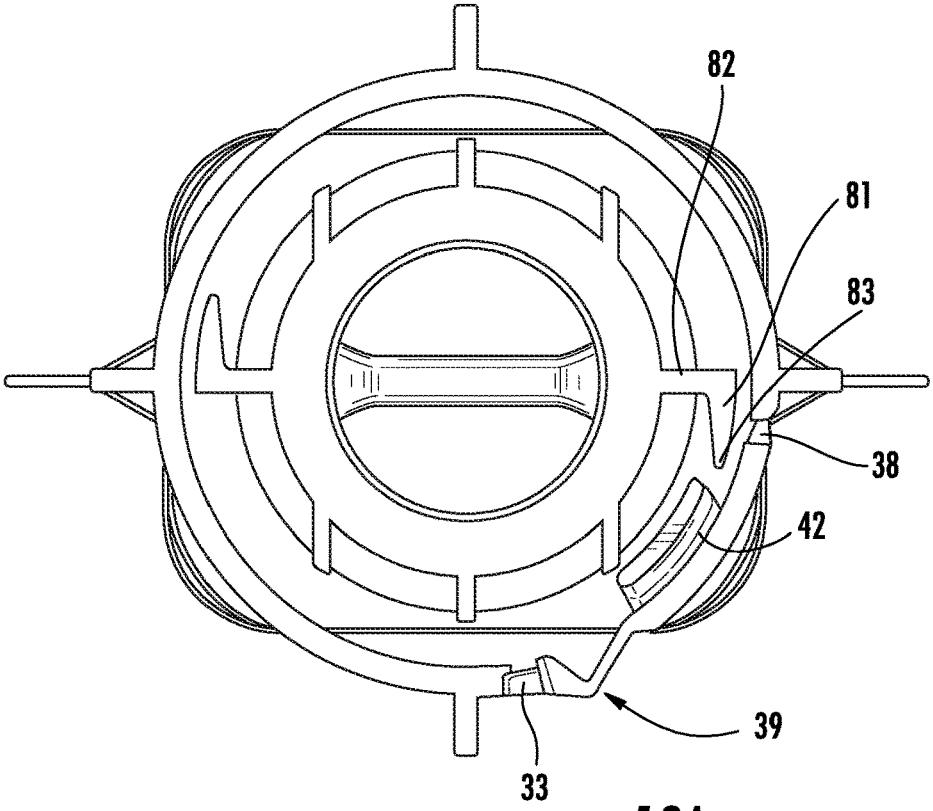
FIGS. 13A-13D show a cross-sectional view of the closure of FIG. 3A at various stages of engagement with the spout FIG. 7A, as taken along lines 13-13 of FIG. 3B and FIG. 7A, during initial removal of the closure from the spout according to one embodiment.
Figure 13B:
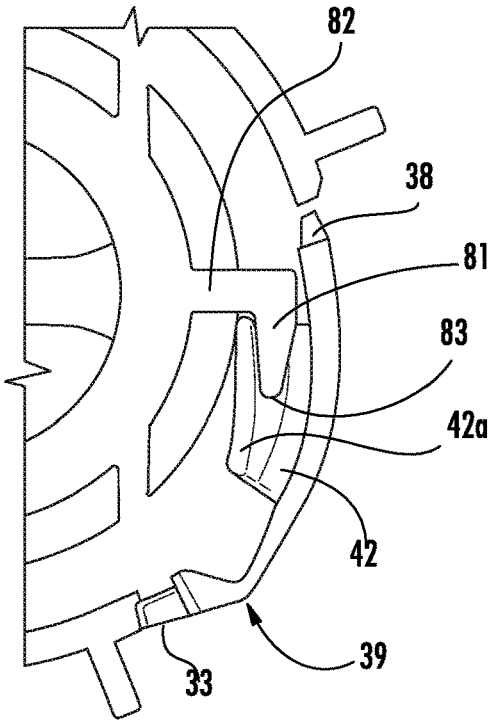

Referring to FIG. 13B, the relative arrangement of the closure 12 and spout 14 following approximately 30° of rotation of the closure 12 is shown. As illustrated in FIG. 13B, the engagement surface 83 of hook 81 is wider than the gap extending between the outer surface of the leg 42*a* of J-band 42 and the inner surface of tamper band 32. Accordingly, as the closure is rotated to the 30° position illustrated in FIG. 13B, the movement of J-band 42 about hook 82 forces the J-band 42 apart.

Furthermore, as the closure 12 is rotated into the 30° position shown in FIG. 13 B, after between approximately 15° to 20° of rotation, the outer surface of the leg 42*a* of J-band 42 comes into contact with the engagement surface 83 of hook 81. During and after the initial engagement of the outer surface of the leg 42*a* of J-band 42 with the engagement surface 83 of hook 81, the engagement of these elements as the closure 12 continues to rotate creates a downwards and inwards force on the leading counterclockwise end of the leg 42*a* of J-band 42, which in turn creates stress and tension in the bridges 38. Accordingly, by the time the J-band 42 has travelled 30° into the position illustrated in FIG. 13B, the forces imparted onto the inner leg 42*a* of J-band 42 contribute not only to the breakage of bridges 38, but the forces imparted onto the J-band 42 by the engagement surface 83 also begin to contribute to the distortion and deflection of the tamper band 32.

As also illustrated in FIG. 13B, the width of the gap 75 defined between the outermost surface of support wall 63 and the innermost surface of hook 81 at the intersection between the hook 81 and arm 82 is less than the width of the leg 42*a* of J-band 42. Accordingly, once the leg 42*a* of the J-band 42 has moved into gap 75, compression of the leg 42*a* of the J-band 42 within the gap 75 temporarily causes the J-band to become stuck within the gap 75 while the closure 12 continues to rotate.

Figure 13C:
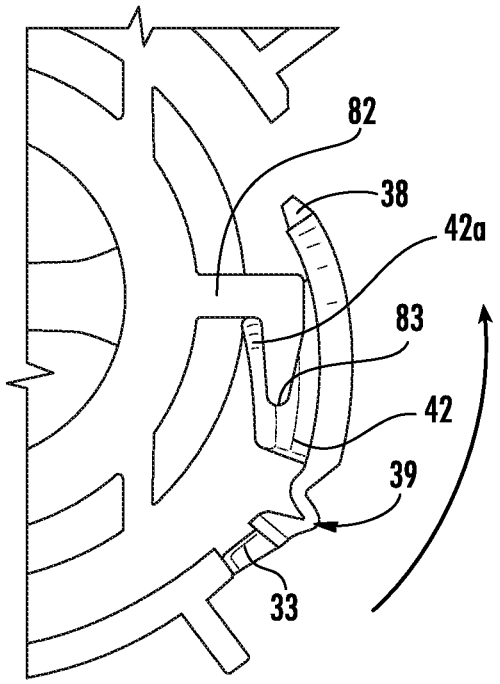
Figure 13D:
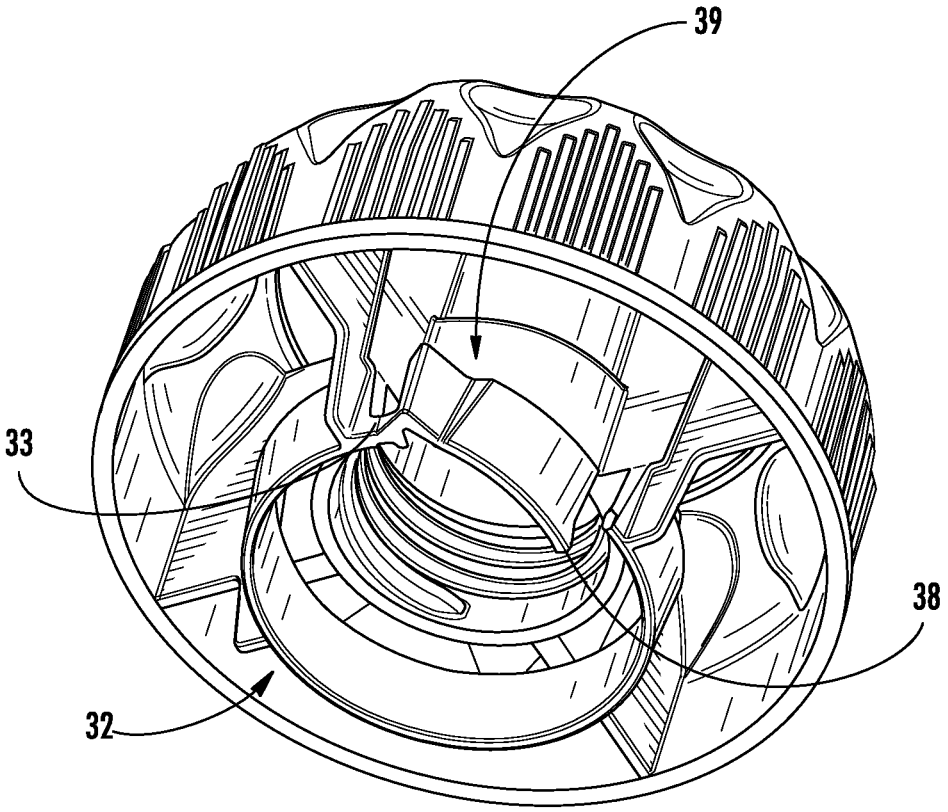

Referring to FIG. 13C, as a result of the non-J-band containing portions of the tamper band 32 rotating while the J-band 42 containing portion of the tamper band 32 is trapped in the gap 75, the tamper band 32 begins to distort as the knuckle 39 continues to collapse and the hinge 33 continues to deflect outwards. Furthermore, as the closure 12 continues to move upwards relative to the spout 14, the continued downward and inward force imparted onto the leg 42*a* of J-band 42 as the J-band is trapped within the gap 75 (resulting from the engagement of the bottom surfaces of the hook 81 with the interior surfaces of the J-band 42 and/or engagement of the upper surfaces 47 of the J-band 42 with the lower surface of upper flange 63) results in the additional distortion of the tamper band 32 in a vertical direction. Eventually, once the closure 12 has been rotated sufficiently, the trapped J-band 42 begins to snake out of engagement with the gap 75. By the time the closure 12 has been removed from the spout 14, the tamper band 32 has been deflected and distorted in such a manner as generally illustrated in FIG. 13D.

Figure 14A:
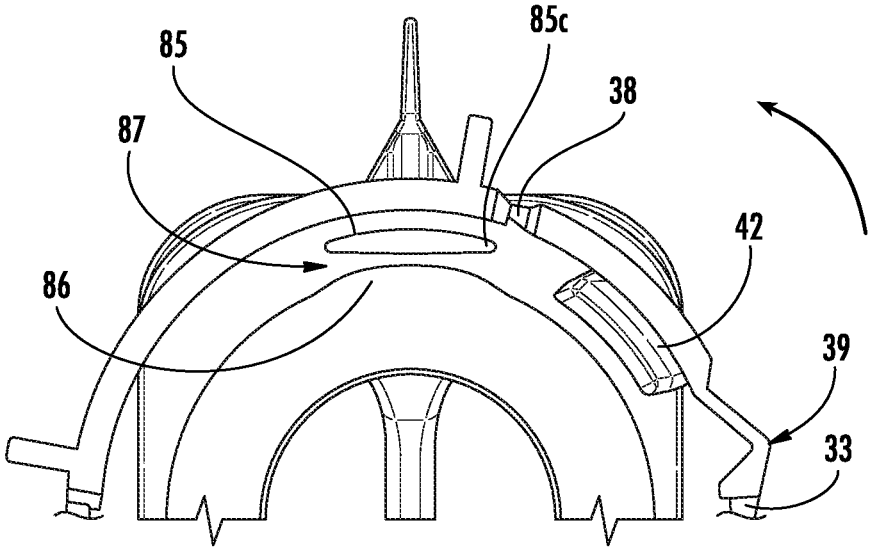
FIGS. 14A-14D show a cross-sectional view of the closure of FIG. 3A or FIG. 4A at various stages of engagement with the spout FIG. 8A, as taken along lines 14-14 of FIG. 3B or FIG. 4B and FIG. 8A, during initial removal of the closure from the spout according to one embodiment.

Turning to FIGS. 14A-14D, the progression of the interaction of the spout engagement structures of a tamper band 32 according to an embodiment of closure 12 shown in either FIGS. 3A-3D or FIGS. 4A-4D with the tamper band engagement structures of the embodiment of spout 14 of FIGS. 8A-8C is shown. Shown in FIG. 14A is the configuration of closure 12 and spout prior to initial removal of the closure 12. After approximately 20° of rotation, the J-band 42 is brought into initial contact with the wedge 85.

Figure 14B:
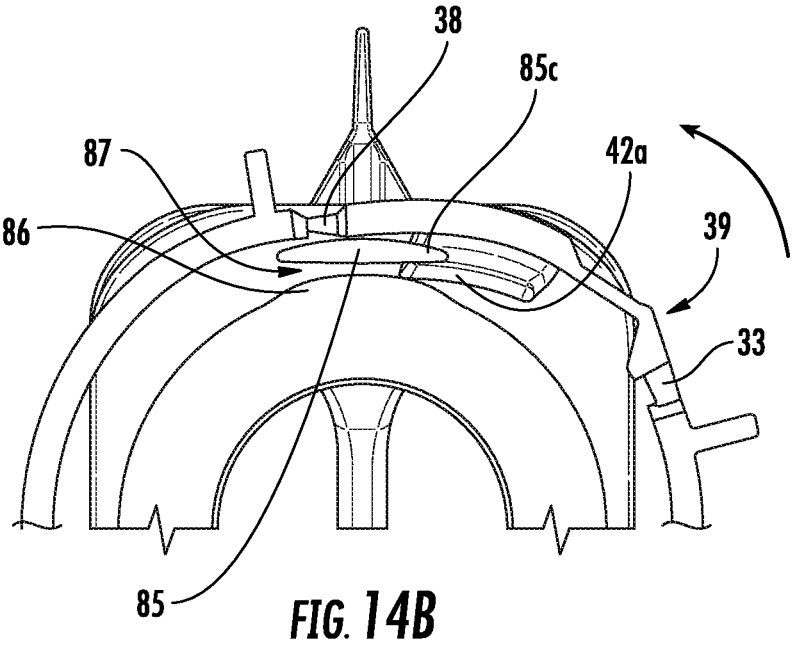

The engagement between the spout 14 and the closure 12 following between approximately 20° and 30° of rotation is illustrated in FIG. 14B. As illustrated in FIG. 14B, as the J-band 42 comes into initial contact with the leading edge 85*c* of the wedge 85, the linearly extending inner surface 85*b* configuration of the wedge 85 results in the leading edge 85*c* engaging the outer surface of the leg 42*a* of J-band 42. This contact between the leading edge 85*c* and the inner leg 42*a* of the J-band 42 pivots the leading end of J-band 42, and the portion of the tamper band 32 to which it is attached, radially inwards about the contact point.

Figure 14C:
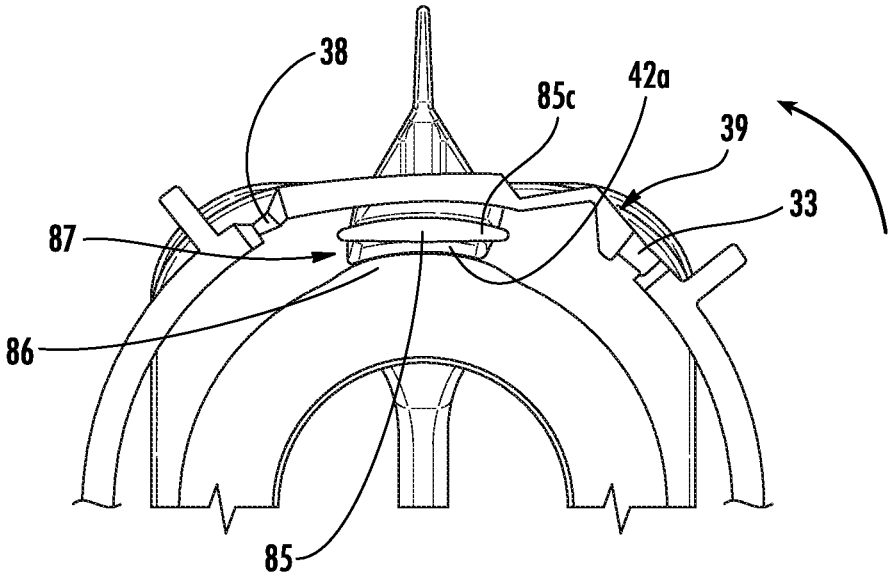

As shown in FIG. 14C, as the tamper band 42 continues to be rotated (FIG. 14C illustrating a rotation of between approximately 25° and 45° of the closure 12 relative to the spout 14), the liner configuration of the inner surface 85*b* of the wedge 85 causes the J-band 42 and the portion of the tamper band 32 to which J-band is attached to be pushed further radially inwards in a linear manner relative to the original circular configuration of the tamper band 32 as the J-bands 42 rotates past wedge 85.

As the J-band 42 and the portion of the tamper band 32 to which the J-band is attached (and to which bridge 38 is attached at a leading end) travels through keyway 87, a force resulting from the inwards linear deflection of the J-band 42 is transmitted to the bridge 38. Additionally, as the closure 12 continues to move upwards relative to the spout, the downward forces imparted onto J-band 42 resulting from the interaction of the bottom surfaces of wedge 85 interacting with the inner surfaces of J-band 42 and/or the engagement of the upper surfaces 47 of the J-band with the lower surface of the upper flange 60 are also transmitted to and imparted onto bridge 38.

Referring further to FIG. 14C, because the keyway 87 defined between the inner surface 85*b* of the wedge 85 and the outer surface of the support element 83 defines a narrowed path through which the J-band 42 must pass, as the closure 12 is removed from the spout 14, the narrowed width of the keyway 87 acts to slow the rotation of the J-band 42 (and the corresponding portion of the tamper band 42 to which the J-band 42 is attached) as the J-band passes through the keyway 87. As illustrated in FIG. 14C, by the time the closure 12 has been rotated approximately 45° and 55° This slowed movement of the J-band 42 through the keyway 75 provides sufficient time for the forces acting on bridges 38 in both the horizontal and vertical directions to result in breakage of bridges 38.

Figure 14D:
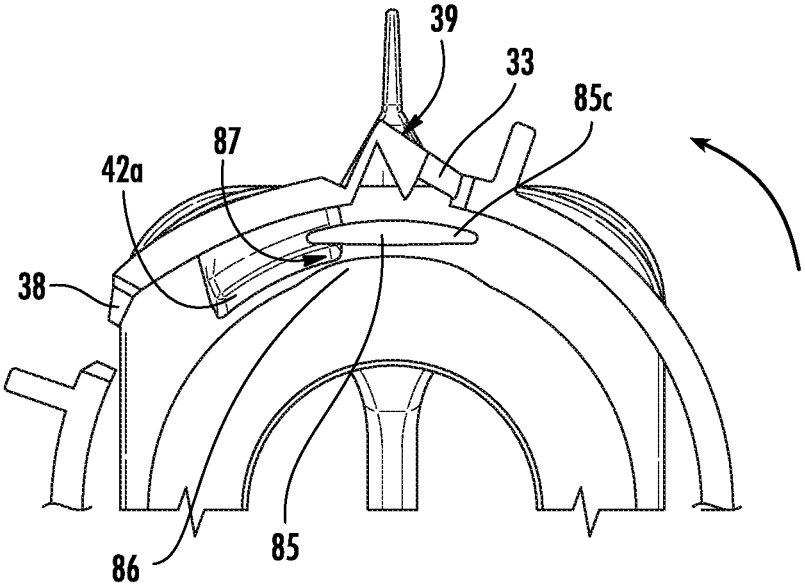

In addition to causing the bridges 38 to break, the movement of the J-band through the key 87 also causes distortion of the tamper band 32 from its original generally circular configuration. As shown in FIGS. 14C and 14D, the slowed and distorted movement of the J-band 42 through the keyway 87 results in both the knuckle 39 collapsing and the tamper band 32 being twisted and rotated about the hinge 33.

Figure 15:
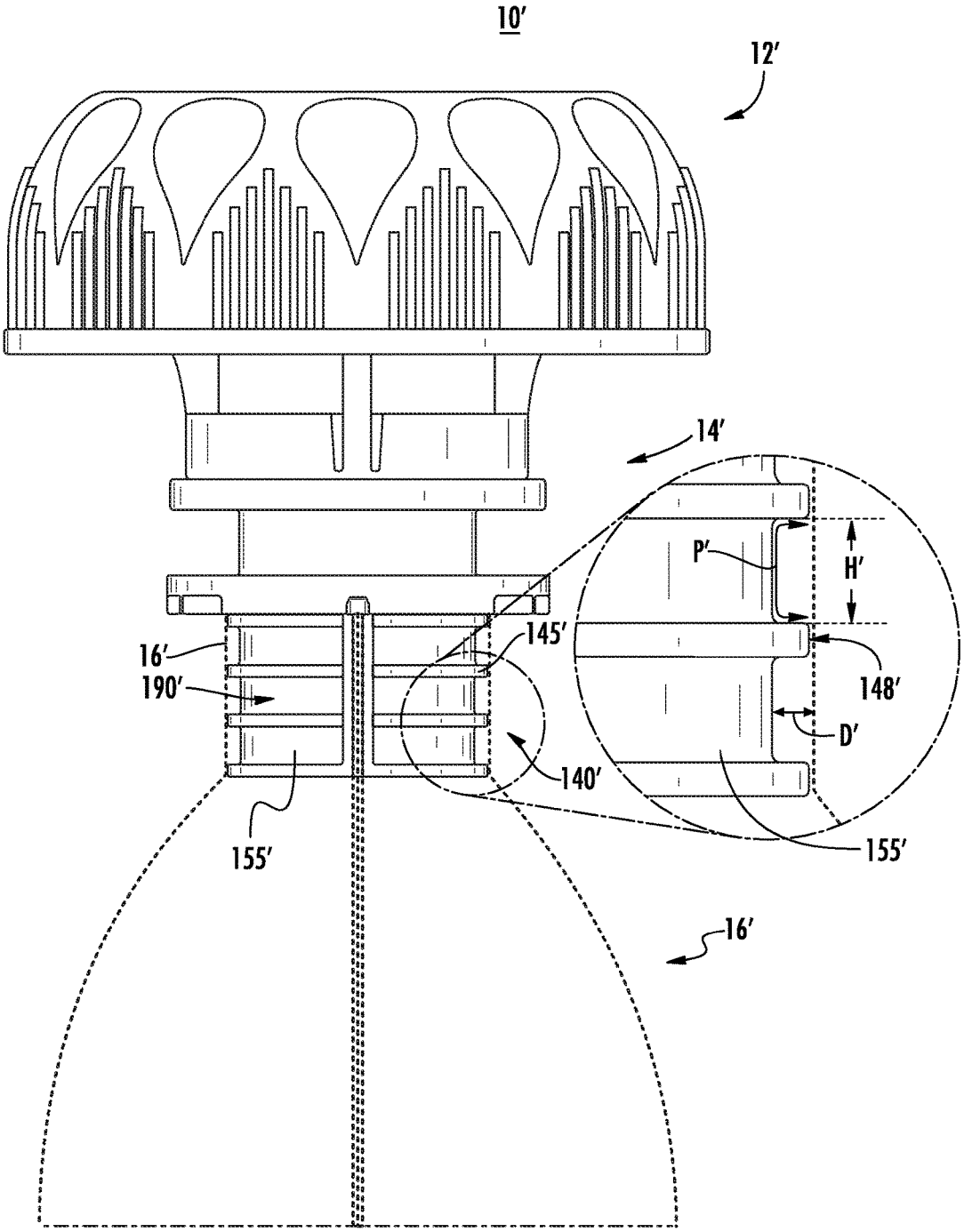
FIG. 15 is a side view of a container assembly having a spout with a conventional mounting portion prior to undergoing high pressure processing.

Shown in FIG. 15 is one embodiment of a container assembly 10' comprising a spout 14' having a conventional mounting portion 140'. As illustrated in FIG. 15, conventional mounting portion 140' includes a central structure 155' surrounding a central channel 152' that fluidly connects the contents of the interior of the pouch 16' with the exterior environment when the pouch 16' and spout 14' are attached.

Extending radially outwards from the central structure 155' is a bottom sealing wall 143'. Also extending radially outwards from the central structure 155' and located above bottom sealing wall 143' are a plurality of horizontally spaced ribs 145'. As shown in FIG. 15, the outermost peripheries of bottom sealing wall 143' and ribs 145' are defined by generally identical geometries and dimensions. Defining the outermost peripheries of ribs 145' and bottom sealing wall 143' are outer surfaces 148' that extend in between and generally perpendicular to the upper and lower surfaces of bottom sealing wall 143' and each of the ribs 145'.

The inner surfaces of pouch 16' are attached to the mounting portion 140' of spout 14' along the outer surfaces 148' of bottom sealing wall 143' and ribs 145' to form container assembly 10'. Once the pouch 16' has been attached to the mounting portion 140', the only fluid communication between the interior of the pouch 16' and the exterior environment is through the central channel 152'.

Referring to FIG. 15, when the pouch 16' is attached to the mounting portion 140' along the outer surfaces 148' of bottom sealing wall 143' and ribs 145', empty spaces or cavities 190' are defined between adjacent ribs 145' and between the bottommost rib 145' and bottom sealing wall 143'.

As shown in FIG. 15, the volume of cavities 190' is defined by the upper and lower surfaces of adjacent ribs 145'; the exterior surface of the central structure 155' extending between the upper and lower surfaces of adjacent ribs 145'; and the interior surface of the portion of the pouch 16' extending between the upper and lower surfaces of adjacent ribs 145'.

Referring to the enlarged portion of FIG. 15, the portion of the outer surface of the mounting portion 140' extending between the outer surfaces 148' of adjacent ribs 145' defines an outer periphery P'. Periphery P' extends along the lower surface of a first rib 145', the outer surface of central structure 155' and the upper surface of a second adjacent rib 145' located below the first 145'. A height H' is defined by the distance between adjacent ribs 145', and also corresponds to the length of the portion of pouch 16' extending between the outer surfaces 148' of adjacent ribs 145'.

Owing to the large spacing D' between the outer surfaces 148' of ribs 145' and the outer surface of the exterior of the central structure 155', as well as the angular, perpendicular arrangement of ribs 145' along central structure 155', the length of the perimeter P' is significantly (i.e. more than 10%) greater than the length H' between adjacent outer surfaces 148'.

When a spout 14' having a conventional mounting portion 140' such as shown in FIG. 15 is sealed, bonded, or otherwise attached to pouch 16', air may become trapped between spaces 190'. As the ambient temperature and/or pressure in which the assembled pouch 16' and spout 14' assembly are stored changes or fluctuates, the pressure within spaces 190' and/or the volume of the air trapped in spaces 190' may also change. These changes in ambient pressure and/or temperature may occur unintentionally, for example during storage or transport. In other embodiments, the changes in ambient pressure and/or temperature may be imparted intentionally, e.g. during preservation of sterilization procedures such as high pressure processing ("HPP") or pascalization.

Figure 16:
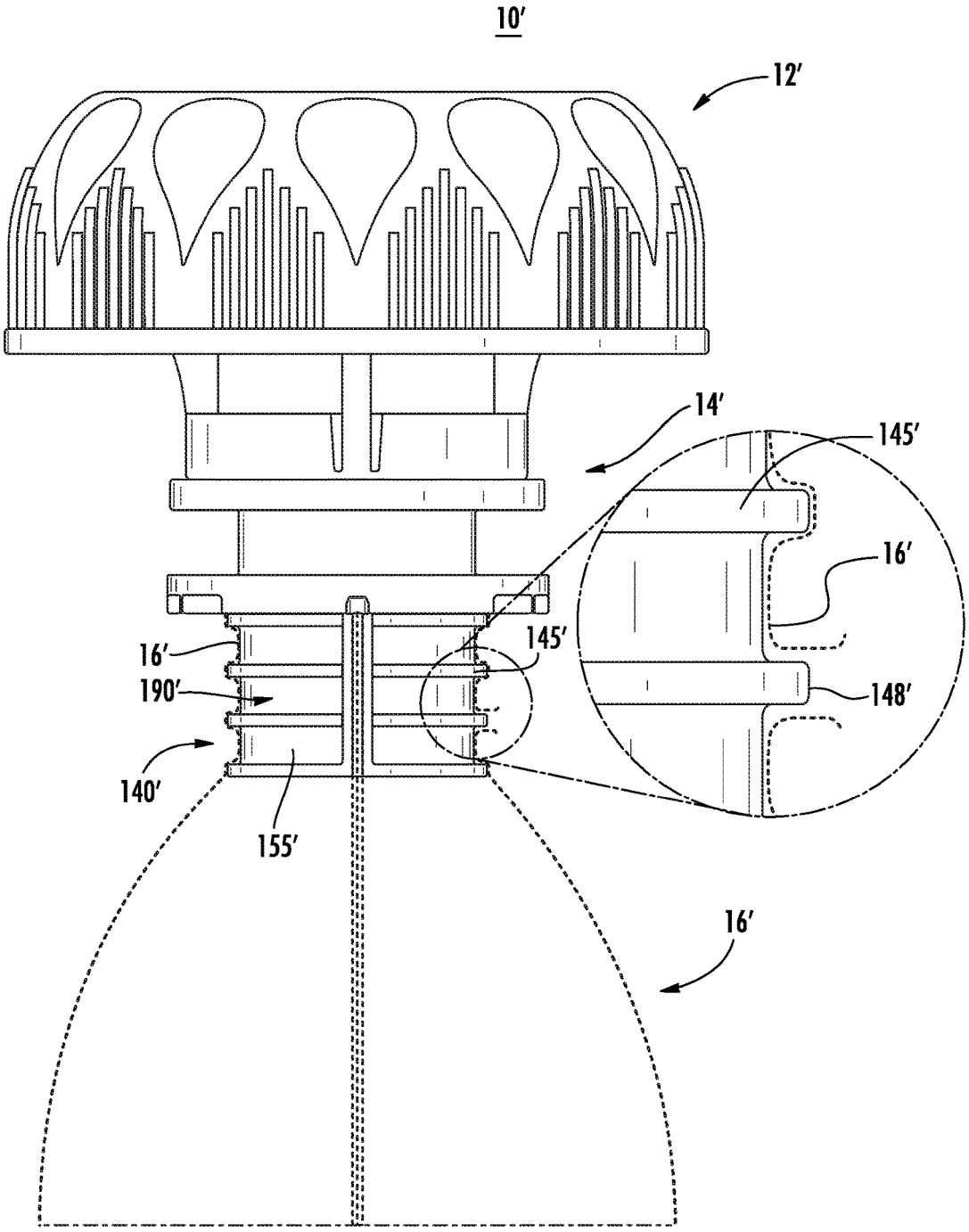
FIG. 16 is a side view of the container assembly of FIG. 15 undergoing high pressure processing, as well as an enlarged view thereof.

Referring to FIG. 16, the container assembly 10' of FIG. 15 is shown undergoing HPP. During the HPP process, such as provided by Avure Technologies, filled containers are placed under pressures of over 80,000 psi using a fluid, such as water. By processing foods at extremely high water pressure (up to 6,000 bar/87,000 psi—more than the deepest ocean), Avure represents that its HPP machines neutralize listeria, salmonella, E. coli and other deadly bacteria that may be present in the contents of the containers prior to the HPP process. Unlike thermal, chemical and other high-heat treatments, HPP runs at cold temperatures to reduce altering food taste, texture or quality, or the requirement of adding of chemicals to maintain freshness or to exceed shelf-life.

During the HPP process, the ambient pressure surrounding the container assembly 10' is increased. As the ambient pressure surrounding the container 10' increases, increasing forces are exerted on the outer surfaces of the sidewalls of pouch 16'. However, despite the changing external pressure, because cavities 190' are sealed from the ambient environment (i.e. there is no fluid communication between the cavities 190' and the ambient environment) the pressure within cavities 190' remains unchanged. Because the pressure within cavities 190' remains unchanged, the forces exerted on the inner surfaces of the sidewalls of pouch 16' remain unchanged during HPP.

As the ambient pressure continues to increase during HPP, the forces exerted on the outer surfaces of the sidewalls pouch 16' also increase, thereby causing an imbalance between the forces applied to the exterior surfaces of the pouch 16' and the forces applied to the interior surfaces of the pouch 16', with the forces acting on the exterior surfaces of the pouch 16' being greater than the forces acting on the inner surfaces of the pouch 16'. As the difference in the pressure outside of the container assembly 10' and pressure within cavities 190' continues to increase, the greater forces acting on the exterior surfaces of the pouch 16' begin to push the pouch 16' into cavities 190'.

Given the structure of the conventional mounting portion 140', the imbalance between the forces acting on the exterior surfaces of the pouch 16' and those acting on the interior surfaces of the pouch 16' may result in damage to the attachment/bond between the pouch 16' and spout 14' and/or damage to the material forming the pouch 16'. Specifically, the large ratio (i.e. greater than 10% difference) between the length of the perimeter P' of the portion of the outer surface of the mounting portion 140' extending between the outer surfaces 148' of adjacent ribs 145' and the height H' of the portion of the pouch 16' extending between adjacent ribs 145' as well as the corresponding large volume defined by cavities 190', provide a large surface area and volume along which/into which the pouch 16' may increasingly be pushed into.

Because the configuration and structure of the conventional mounting portion 140' defines a large area and space, as increasing forces push the pouch 16' inwards, the large surface area P' and the large volume of spaces allow the pouch 16' to be collapsed/forced further and further into cavities 190'. As the pouch 16' continues to be forced farther inwards, the material forming the pouch 16' is stretched and may begin to deform, resulting in permanent deflection of the material of the pouch 16'. In some circumstances, such as illustrated in the enlarged section of FIG. 16, this stretching of the pouch may eventually cause the pouch 16' to tear, rupture or otherwise fail.

Additionally, as pouch 16' is pushed further into spaces 190', increasing amounts of stress and strain are imparted onto the interface/attachment/bond between the pouch 16' and the conventional mounting portion 140'. These imparted forces may act to adversely affect, deteriorate, detach, or otherwise impair the initial fluid-tight sealing engagement formed between the pouch 16' and the conventional mounting portion 140' of spout 14'.

Moreover, the sharp, angled edges of ribs 145' may further damage the pouch as the pouch 16' is forced inwards. As pouch 16' is pushed into spaces 190', the material of the pouch 16' is increasingly deflected as it is stretched over the sharp, angled edges of ribs 145'. In some circumstances, such as e.g. shown in the enlarged portion of FIG. 16, this deflection or stretching of the pouch 16' over the edges of ribs 145' may result in a large enough concentration of stress on the material of the pouch 16' to contribute to and eventually lead to the material failure of the pouch 16', e.g. resulting in tearing or rupturing of the pouch 16'.

As illustrated by FIGS. 15 and 16, one of challenges of using container assemblies 10 in situations where the container assembly 10 may be subject to changes in pressure and/or temperature and/or other external forces (such as, e.g. during HPP), is the development of pouches 16, spouts 14, and/or pouch 16/spout 14 interfaces that can withstand such changes without negatively affecting the container assembly 10. Shown is FIGS. 17-48 are various embodiments of spout 14 and/or pouch 16 features that may be incorporated into a container assembly 10 and which are configured to prevent or limit the tearing, detachment, rupturing, degradation, deformation and/or other damage of the pouch 16 and/or the attachment between the spout 14 and pouch 16 that container assembles 10' having conventional mounting portions 140' are normally susceptible to.

As illustrated in and described with references to FIGS. 17-25, in various embodiments spout 14 may comprises a mounting portion 40 configured to minimize the spaces 190 formed between the inner surfaces of pouch 16 and the exterior surfaces of mounting portion 40 when pouch 16 and spout 14 are attached. In various embodiments, the mounting portion 40 may also be configured to be defined by generally smoothly transitioning external surfaces having large radii of curvature and formed free of, or with minimal amounts of angled portions so as to avoid stress concentrations. The incorporation of such features in the mounting portion 40 minimizes or prevent the material of the pouch 16 from permanently deflecting, tearing, rupturing or otherwise failing in the event the pouch 16 is stretched across the exterior surfaces of the mounting portion 40, such as may occur, for example during HPP.

In other embodiments, such as e.g. illustrated in and described with reference to FIGS. 26-46, one or more vent features may be incorporated into the spout 14 and/or pouch 16 of container assembly 10. The vents may be configured to allow for fluid communication between the spaces 190 defined by mounting portion 140 and the ambient environment. By providing a path for air to pass between the ambient environment and cavities 190, pressure within spaces 190 is allowed to equalize with that of the ambient pressure such that the pouch 16 is not collapsed into spaces 190 when the ambient pressure changes.

In yet other embodiments, such as illustrated in the exemplary embodiment of FIGS. 47 and 48, the container assembly 10 may include both a spout 14 having a modified mounting portion 40 such as described with reference to FIGS. 17-25 as well as one or more vent structures formed in the pouch 16 and/or spout 14, such as described with reference to FIGS. 26-46.

Figure 17:
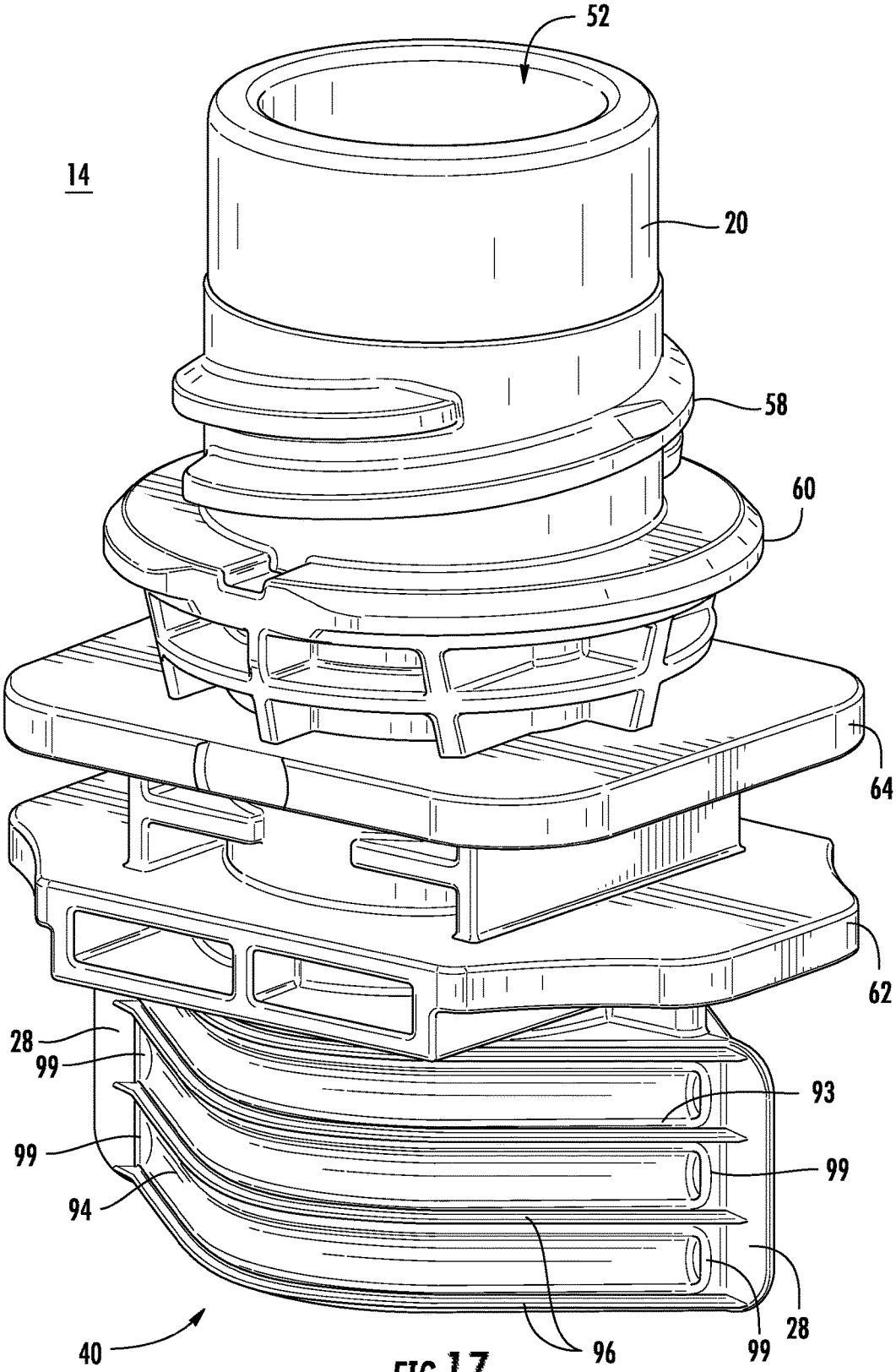
FIG. 17 is a top perspective view of a spout having a mounting portion according to an exemplary embodiment.
Figure 18:
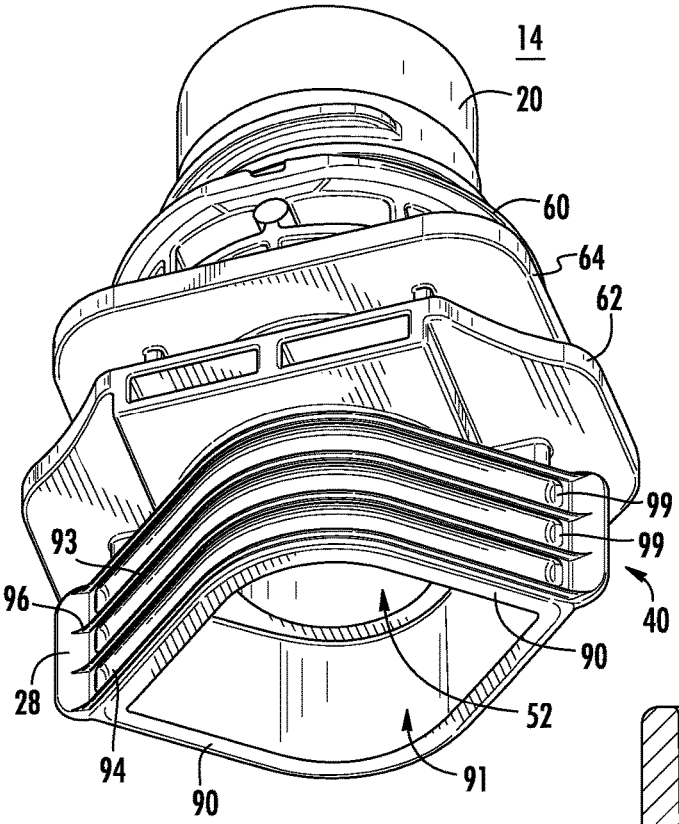
FIG. 18 is a bottom perspective view of the spout of FIG. 17.

Referring to FIG. 17, located below lower flange 62 of spout 14 is a mounting portion 40. As shown in FIGS. 17 and 18, in some embodiments mounting portion 40 may have a generally trapezoidal shape, e.g. a rhomboid shape, with rounded vertices, such as the canoe-shape defined by first and second walls 90. As shown in FIGS. 17 and 18, the side edges of the first and second walls 90 may be joined, with the interior surfaces of the first and second walls 90 defining an opening 91 which is in fluid communication with the central channel 52. In other embodiments, the bottom of mounting portion 40 may be sealed by an end wall extending between first and second walls 90, with an opening being provided in the end wall that provides fluid communication between the interior of the pouch 16 and the central channel 52.

Figure 19:
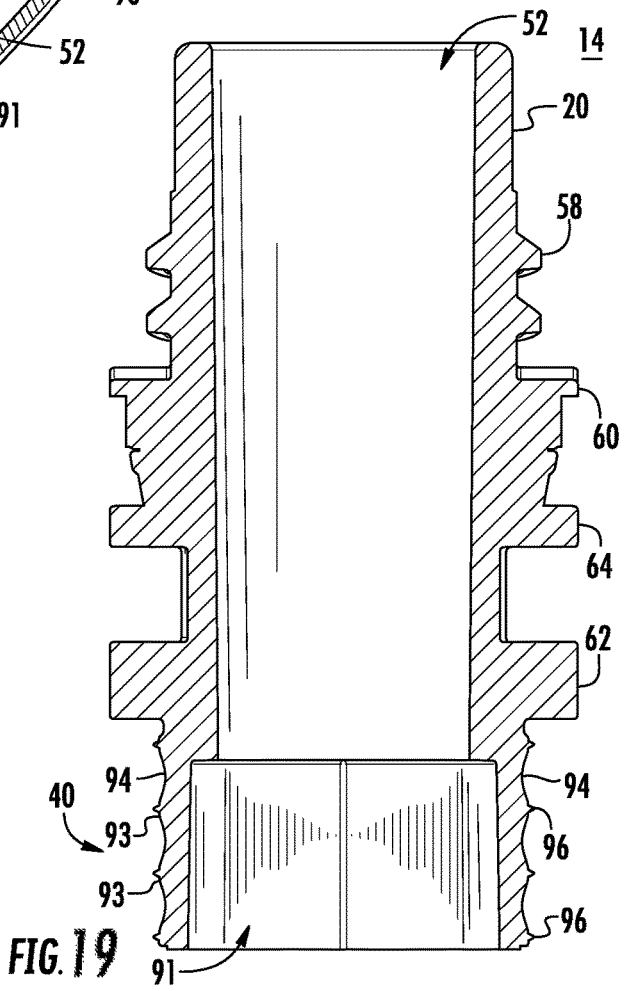
FIG. 19 is a cross-sectional view of the spout of FIG. 17.

In some embodiments, such as illustrated by the embodiment of FIGS. 17-19, the ends of the first and second walls 90 may be joined along outwardly extending wings 28 located at each of the first and second ends of the walls 90. As shown in FIG. 17, wings 28 are formed of generally flat, smooth planar structures that extend from the bottom to the top ends of walls 90. When the spout 14 is attached to the pouch 16, the wings 28 extend within the pouch 16 and are attached to the inner surfaces of the sidewalls of the pouch 16, such that spout 14 is supported from the pouch 16 as shown in FIG. 1. The fluid-tight attachment or bonding between the pouch 16 and the wings 28 may involve an adhesive, a melted thermoplastic, heat welding, ultrasonic welding, or other means for sealing the structures together.

The outer surfaces of walls 90 are formed with a mounting structure to which the pouch 16 may be attached. Along with wings 28, mounting structures provide surfaces to which the inner surfaces of pouch 16 may be connected to the spout 14 via a fluid-tight attachment.

Referring to FIGS. 17-19, in one embodiment mounting structure comprises a smoothly undulating, generally sinusoidal, wave-like pattern formed on/defined by the exterior surface of each of the first and second walls 90. Wave-like pattern extends along the height of the mounting portion 40 from the bottom to the top ends of walls 90.

As shown in FIGS. 17-19, the wave-like pattern formed on the exterior of walls 90 may include one or more peaks 93 that extend between wings 28, from the first edge to the second edge of each of the first and second walls 90. Adjacent peaks 93 are vertically separated from one another by troughs 94, which also extend between wings 28, from the first edge of the second edge of each of the first and second walls 90.

In some embodiments, walls 90 may be molded or otherwise formed such that the peaks 93 and troughs 94 defining the wave-like pattern are formed integrally and monolithically with the walls 90, with the wave-like pattern defining the exterior surfaces of walls 90. In other embodiments, discrete elements formed separately from the walls 90 may be attached to the exterior surfaces of walls 90 to form the wave-like pattern on the exterior surfaces of the walls 90.

Figure 20:
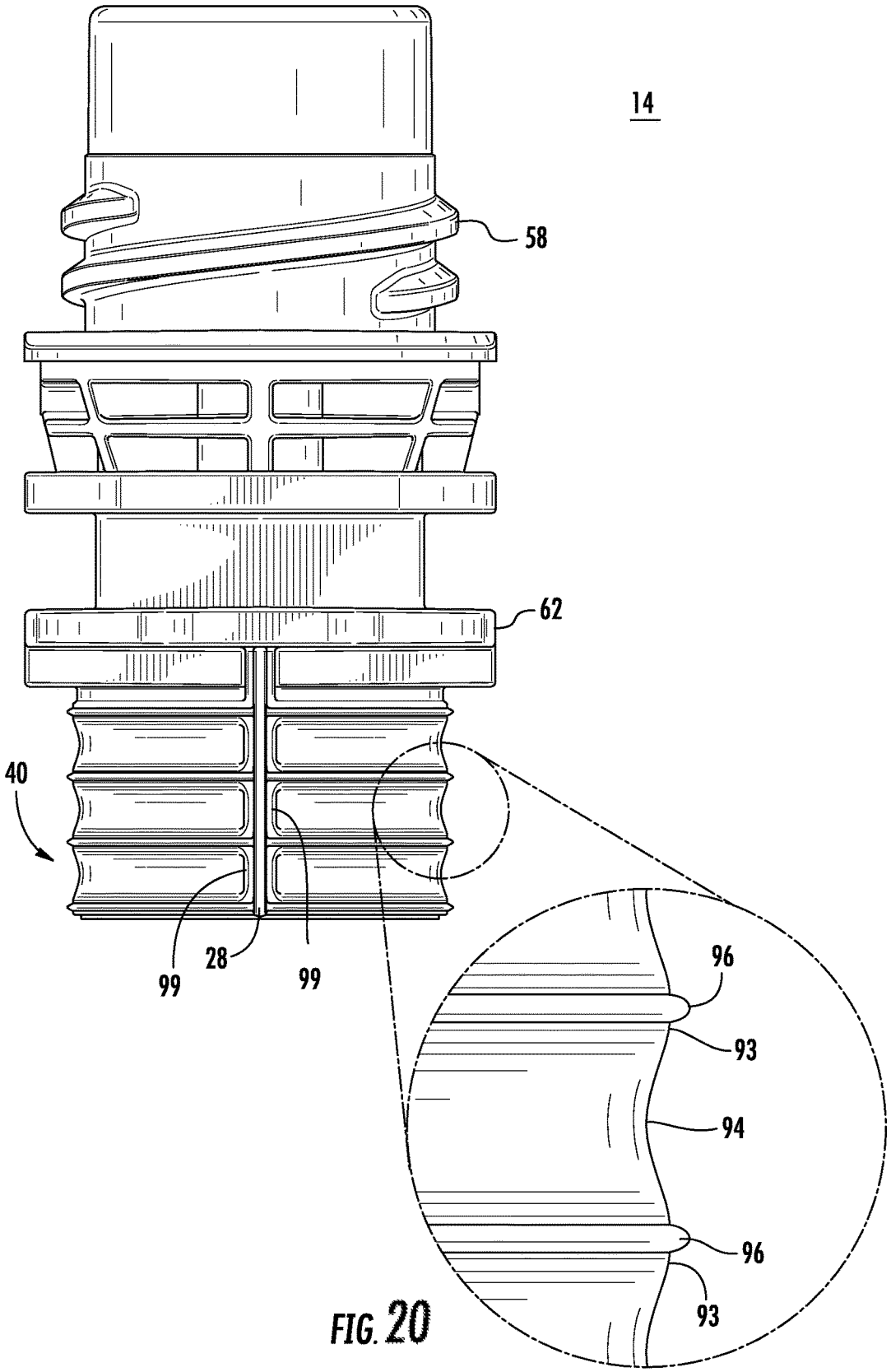
FIG. 20 is a side view of the spout of FIG. 17, as well as an enlarged view thereof.

In some embodiments, such as the embodiment of FIGS. 17-21, in which the pouch 16 and spout 14 are to be attached via welding, weld ribs or energy directors 96 may be provided along the crests of one or more peaks 93. Illustrated in FIG. 20 is an enlarged view of an embodiment of a mounting portion 40 formed with weld ribs 96 prior to attachment of the pouch 16 to the spout 14.

Figure 21:
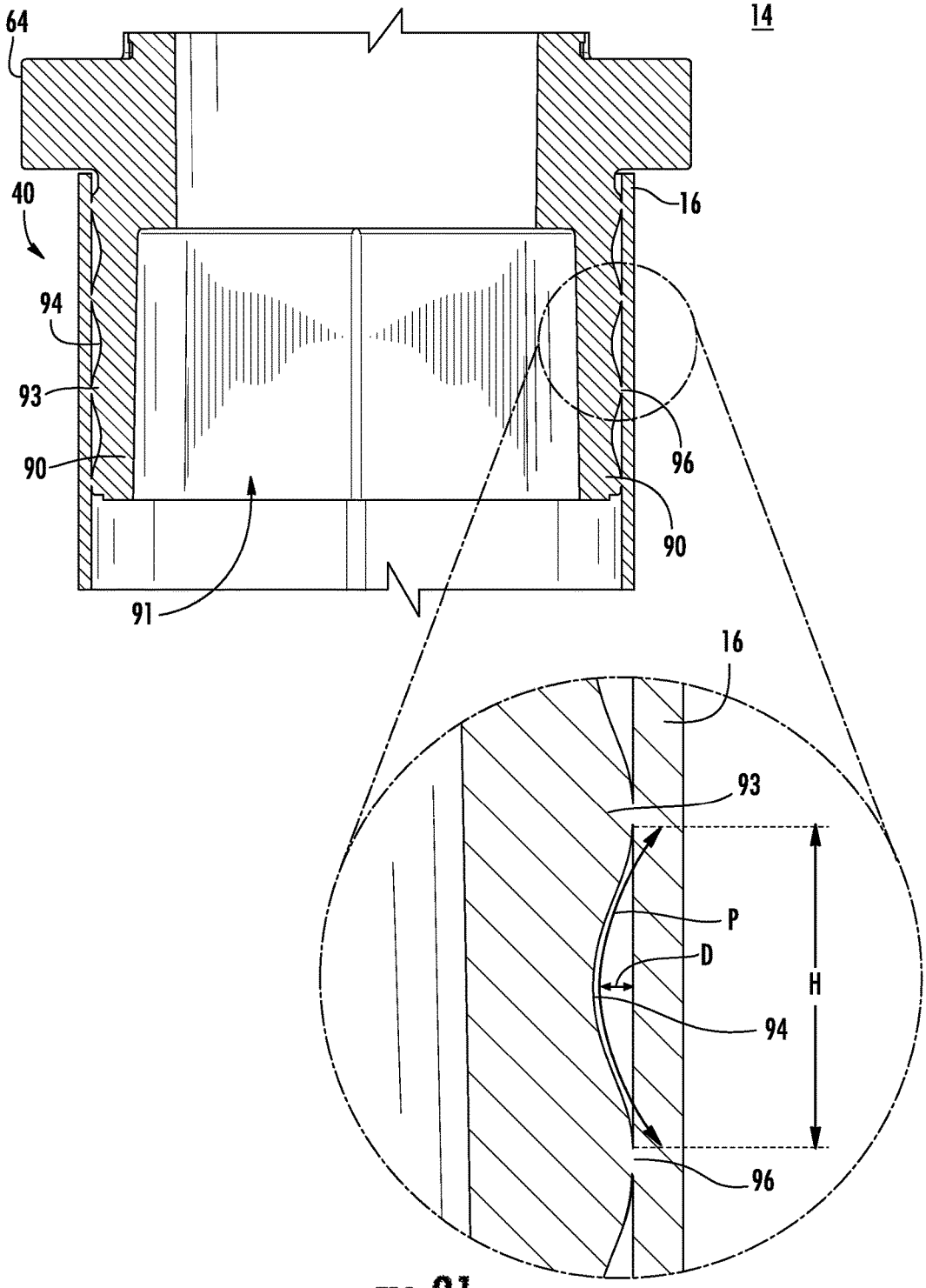
FIG. 21 is a cross-sectional side view of the spout of FIG. 17 attached to a pouch, as well as an enlarged view thereof.

As shown in FIG. 20, prior to attachment of the pouch 16 to the spout 14, weld ribs 96 protrude outwards from peaks 93. However, as shown in FIG. 21, once the pouch 16 has been welded to spout 14, the outwardly protruding structure of weld ribs 96 no longer defines a portion of the outer surface of walls 90. Instead, as illustrated in FIG. 21, once mounting portion 40 and pouch 16 have been welded together the walls 90 extend along a curved, generally sinusoidal wave-like pattern defined by peaks 93 and troughs 94 and which extends along the height of mounting portion 40.

Figure 22A:
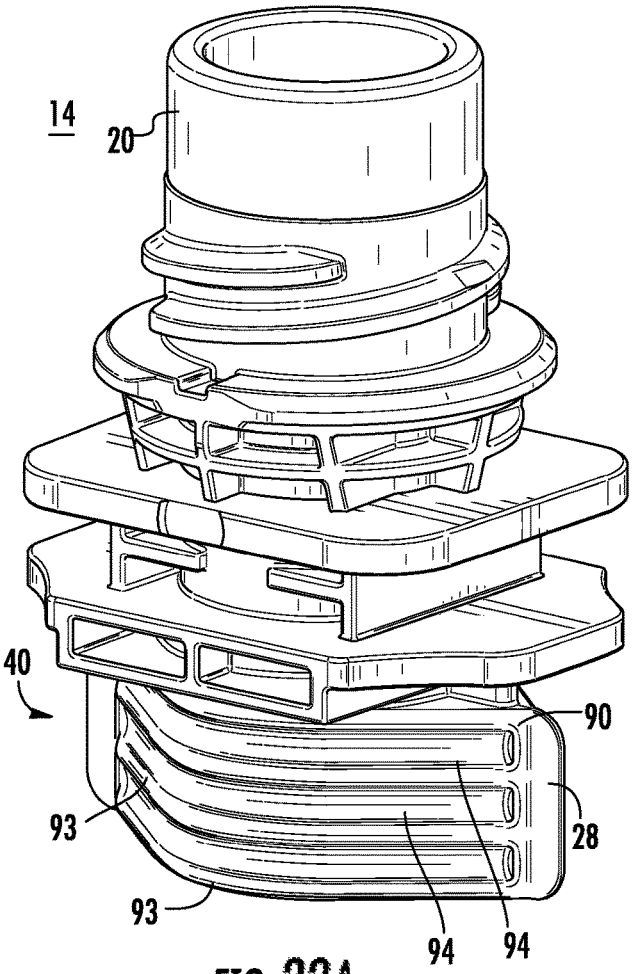
FIG. 22A is a top perspective view of a mounting portion of a spout according to an exemplary embodiment.

In other embodiments, pouch 16 and spout 14 may be attached via other connections besides welding. In embodiments which do not require weld ribs 96 to attach pouch 16 to spout 14, mounting portion 40 can be formed without weld ribs 96, e.g. as illustrated in the embodiment shown in FIGS. 22A and 22B. In some embodiments, e.g. where spout 14 and pouch 16 are to be attached via an adhesive connection, the crests of peaks 93 may be slightly flattened, such as illustrated in the embodiment of FIGS. 23A and 23B so as to provide a mounting surface 97 to which pouch 16 may be securely adhered.

When spout 14 and pouch 16 are assembled, pouch 16 is attached to the mounting portion 40 along the crests of peaks 93. Similar to a conventional mounting portion 140' (such as shown in FIGS. 15 and 16), once spout 14 and pouch 16 are assembled, spaces or cavities 190 are defined between the exterior surface of walls 90 of mounting portion 40 and the inner surfaces of pouch 16.

Similar to a container assembly 10' having a conventional mounting portion 140' (and as discussed with reference to FIGS. 15 and 16 above), under certain circumstances (e.g. changes in pressure) the pouch 16 may be forced inwards into cavities 190 defined by the mounting portion 40 of spout 14. As also described with reference to FIGS. 15 and 16, in some circumstances, such as e.g. during HPP, where the change in pressure is very large, the pouch 16 may be pushed so far into cavities 190 that the inner surface of pouch 16 is forced up against a majority or entirety of the exterior surface P of the mounting portion extending between adjacent points of attachment of the pouch 16 to the mounting portion.

However, in contrast to the damage that the cavities 190' of a conventional mounting portion 140' may cause when the forces acting on the outer surfaces of the pouch 16' exceed the forces acting on the inner surfaces of pouch 16', the cavities 190 of a mounting portion 40 according to any of FIGS. 17-25 do not result in similar stretching, distortion, or other damage to the pouch 16 and/or the attachment between the pouch 16 and spout 14 under similar conditions. Specifically, the wave-like pattern formed along the exterior surfaces of walls 90 of mounting portion 40 is configured to prevent or minimize any damage, stretching and/or other distortion of the pouch 16 in the event that external forces acting on the outer surfaces of the pouch 16 become greater than the forces acting on the inner surfaces of the pouch 16, e.g. such as would occur during HPP.

As noted above, when pouch 16 and spout 14 are attached, the pouch 16 is attached to mounting portion 40 along the crests of peaks 93. As shown in FIG. 21, the distance between crests of adjacent peaks 93 is defined by a height H. This distance H also corresponds to the length of the portion of the pouch 16 that extends between crests of adjacent peaks 93. With further reference to the enlarged portion of FIG. 21, the portion of the exterior surface of the wall 90 that extends from the crest of a first peak 93 along trough 94 to the crest of an adjacent peak 93 is defined by a length P.

In order to minimize possible damage to the pouch 16, the depth D of troughs 94 and the curvature of the wave-like pattern defined by peaks 93 and troughs 94 is configured such that the length P of the perimeter of the exterior surface of the mounting portion 40 extending between crests of adjacent peaks 93 is no more than 10% greater than the length H of the portion of the pouch 16 extending between adjacent peaks 93. More specifically, in one embodiment, the mounting portion 40 is configured such that the length of the perimeter P of the curve extending between crests of adjacent peaks 93 is only between 4 and 6% greater than the length H of the portion of pouch 16 extending between adjacent crests, and more specifically no more than 5% greater than H.

By limiting the ratio of the dimensions of P to be no greater than 10%, and more specifically between 4-6%, e.g. no more than 5% greater than the dimensions of H, the amount of the deformation or stretching of the pouch 16 and/or the damage to the attachment between spout 14 and pouch 14 that may occur under circumstances where the pouch 16 is forced inwards into cavities 190 are minimized.

In addition to the minimized P:H ratio, the mounting portion 40 may also include other features configured to minimize the risk of the pouch 16 being torn, ruptured, or otherwise deformed in the event that the sidewalls of the pouch 16 are collapsed into or occlude spaces 190.

In contrast to the angled, perpendicular configuration of ribs 145' as well as the arrangement of ribs 145' along the central structure 152' of a conventional mounting portion 140', the wave-like pattern extending along and defining outer surfaces of walls 90 of the mounting portion 40 of the various embodiments of FIGS. 17-25 provides a smooth, curved mounting portion 40 outer surface that is formed with minimal or no edges formed with sharp angles or small radii of curvature. As shown in FIGS. 17-19, the radii of curvature of the various structures formed on, defined by or extending from the mounting portion 40, such as e.g. peaks 93, are formed having relatively large radii of curvature.

Figure 22B:
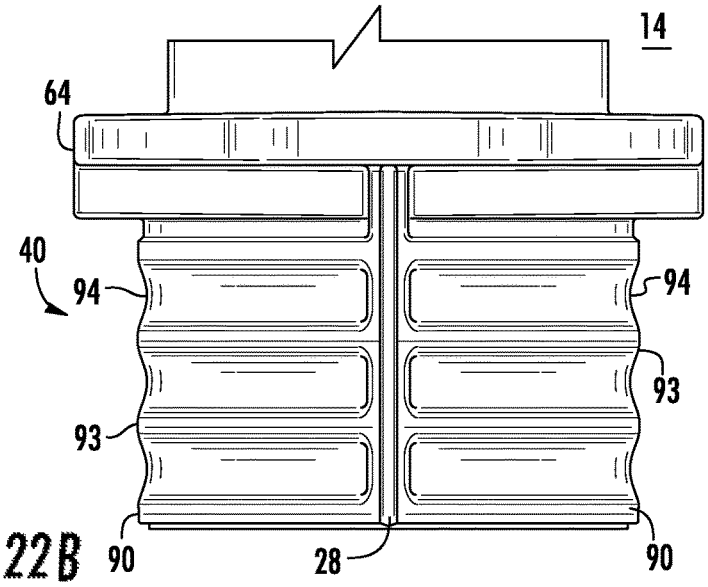
FIG. 22B is side view of the mounting portion of FIG. 22A.
Figure 23A:
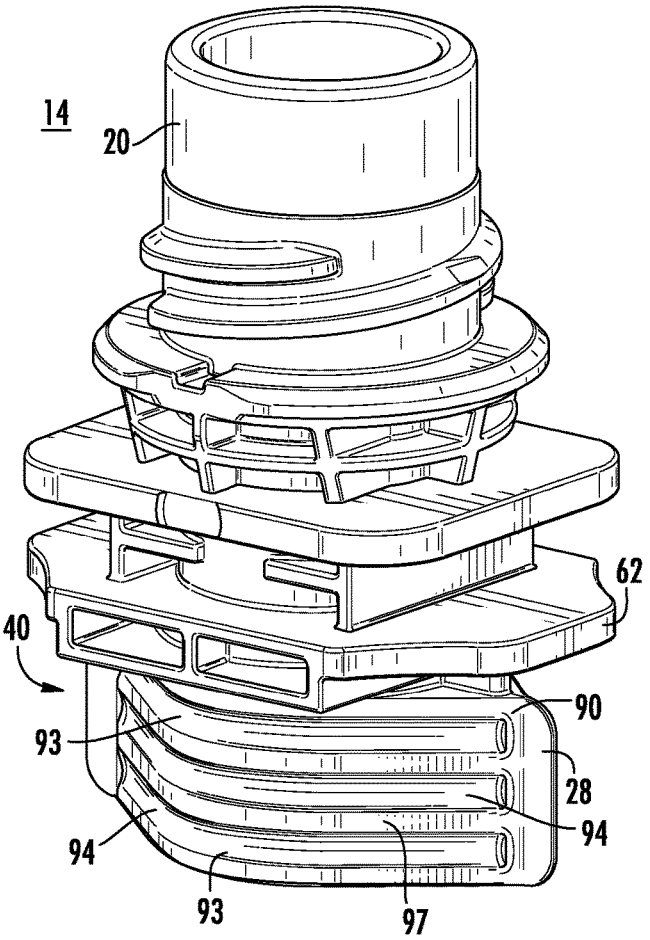
FIG. 23A is a top perspective view of a mounting portion of a spout according to an exemplary embodiment.
Figure 23B:
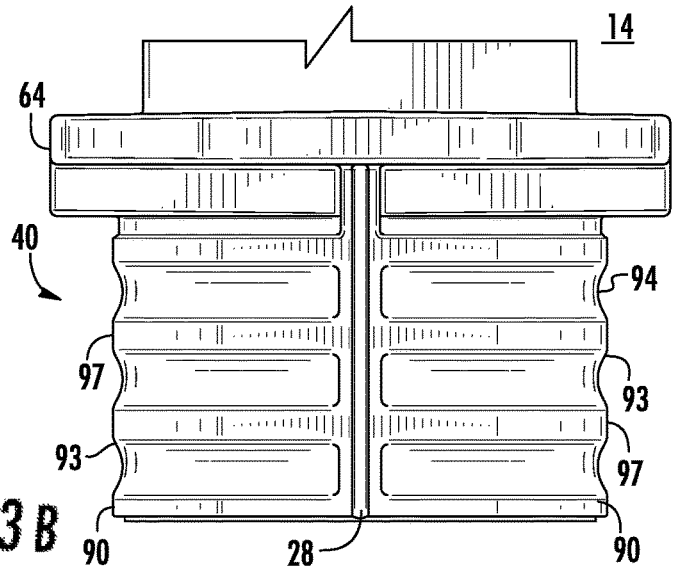
FIG. 23B is side view of the mounting portion of FIG. 23A.

As illustrated by the exemplary embodiments of FIGS. 21 and 22B, adjacent peaks 93 and troughs 94 forming the wave-like pattern of walls 90 transition between one another along the height of the mounting portion 40 along continuous, smooth, gently curved surfaces having relatively large radii of curvature. Even in embodiments, such as e.g. shown in FIG. 23B, where the peaks 93 of mounting portion 40 may include flat vertical portions (e.g. mounting surfaces 97), such flat portions transition into the adjoining curved vertical surfaces along gentle curves instead of along sharp angles. Similarly, as shown in FIGS. 18, 22A and 23A, the horizontally spaced ends 99 of peaks 93 and troughs 94 transition into the wings 28 of mounting portion 40 along smooth, generally curved surfaces.

By minimizing or eliminating sharp edges and angled structures and/or edges or structures having small radii of curvature from the structure of the mounting portion 40, potential stress concentrations along the mounting portion 40 are minimized. As such, the risk of elastic or permanent deflection of the material of the pouch 16, as well as the risk that the pouch 16 will snag, rupture, tear or otherwise fail as the pouch 16 moves relative the outer surface of mounting portion 40 is minimized or even prevented. Thus, in the event that pouch 16 may be forced into cavities 190 (such as may occur, e.g. during HPP), the geometry and configuration of the exterior of mounting portion 40 will minimize or prevent any damage that might otherwise occur if the pouch 16 were stretched across stress raisers, such as e.g. the angled surfaces or edges of a conventional mounting portion 140'. As such, the mounting portion 40 is configured to prevent damage such as illustrated for example in the enlarged view of FIG. 16.

Figure 24:
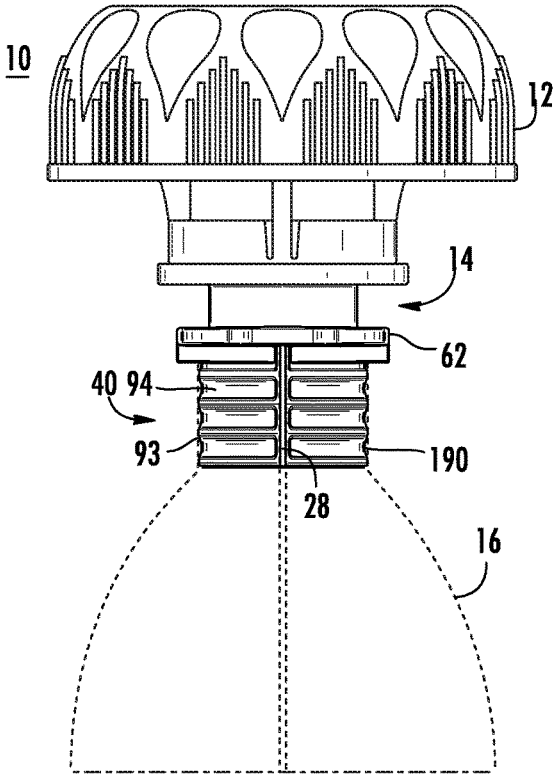
FIG. 24 is a side view of a container assembly having a spout as shown in FIG. 17; prior to undergoing high pressure processing, according to an exemplary embodiment.
Figure 25:
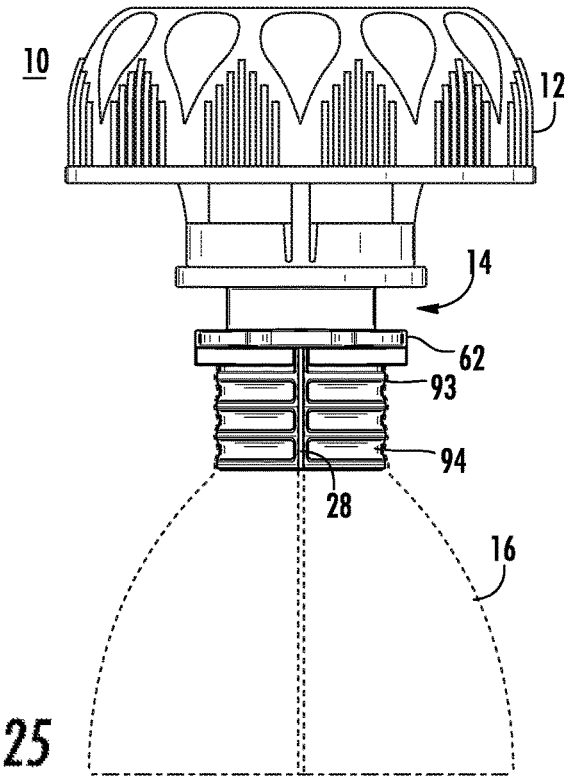
FIG. 25 is a side view of the container assembly of FIG. 24 undergoing high pressure processing, as well as an enlarged view thereof.

Shown in FIG. 24 is a container assembly 10 having a mounting portion 40 as described with reference to FIGS. 17-23B in an initial, unstressed state. In FIG. 25, the container assembly of FIG. 24 is shown undergoing HPP. As seen in FIG. 25, the increased pressure of the HPP process may result in the pouch 16 being pushed inwards into cavities 190. However, because of the minimal P:H ratio, the amount that the pouch 16 is stretched as it is collapsed by the increased pressure into cavities 190 is limited to no more than 10%, and more preferably no more than 4-6%, or more specifically no more than 5%, thereby limiting damage to the pouch 16. Furthermore, because of the curved exterior surface of mounting portion 40, no tearing or rupturing of the pouch 16 occurs as the pouch 16 is pushed into cavities.

In contrast to the damage to the pouch 16' and attachment between the pouch 16' and spout 14' that occurs to a container assembly 10' having a conventional mounting portion 140' during HPP as a result of the sharp, angled exterior surfaces and the large P':H' ratio of the conventional mounting portion 140' (as illustrated e.g. in FIG. 16), as shown in FIG. 25, the distortion to pouch 16 and the attachment of the pouch 16 to spout 14 of a container assembly 10 having a modified mounting portion 40 formed with no or minimal structures that may act as stress raisers is minimal, even during HPP.

As discussed above, in additional to incorporating a modified mounting portion 40 such as described with reference to FIGS. 17-25, container assembly 10 may also comprise one or more vents configured to prevent damage to the pouch 16 and/or the connection between the pouch 16 and spout 14 resulting from changes in temperature and/or pressure and/or from external forces that may be applied to the container assembly 10. Referring to FIGS. 26-46, various embodiments of such vents that may be incorporated into container assembly 10 are shown. The vent configurations illustrated in and described with reference to FIGS. 26-46 are shown as being incorporated into mounting portions 140 instead of being incorporated into modified mounting portions 40 such as shown in and described with reference to FIGS. 17-25. However, it is to be understood that the vent structures shown in any of FIGS. 26-46 may similarly be incorporated into a modified mounting portion 40 as shown in as described with reference to FIGS. 17-25.

As shown in FIGS. 26-46, a container assembly 10 formed with vent features may include a mounting portion 140 having a structure that in many ways is similar to the structure of a conventional mounting portion (e.g., the mounting portion 140' illustrated in and described with reference to FIGS. 15 and 16). For example, similar to the conventional mounting portion 140' of FIGS. 15 and 16, mounting portion 140 may comprise a plurality of ribs 145 and a bottom sealing wall 143 extending horizontally and radially outwards from a central structure 152. The ribs 145 and bottom sealing wall 143 have outer surfaces 148 to which the inner surfaces of a pouch 16 are sealed to form container assembly 10.

As described above with reference to FIGS. 15 and 16, in container assemblies 10' having conventional mounting portions 140', when the pouch 16' and conventional mounting portion 140' are assembled, cavities 190' are defined between adjacent ribs 145'; bottommost rib 145' and bottom sealing wall 143; exterior of central structure 152' and the interior surface of pouch 16'. In such container assemblies 10' having conventional mounting portions 140', there is no fluid communication between the interior of the cavities 190' and the exterior environment. Thus, when there are differences between the pressure within cavities 190' and the pressure of the ambient environment, damage to the pouch 16' and/or the connection between spout 14' and pouch 16' may occur as a result of pouch 16' being pushed into cavities 190'.

Similar to container assemblies 10' having conventional mounting portions 140', cavities 190 are also defined between adjacent ribs 145; bottommost rib 145 and bottom sealing wall 143; exterior of central structure 152 and the interior surface of pouch 16. However, in contrast to container assemblies 10', the vents of container assemblies 10 incorporating vents (such as, e.g. those described in the exemplary embodiments of FIGS. 26-46) provide fluid communication between the interiors of cavities 190 and the exterior environment. As the vents allow air to travel between the cavities 190 of the mounting portion 140 and the ambient environment, the internal pressure within spaces 190 may be equalized with the pressure external to the container assembly 10.

By allowing for the pressure inside the spaces 190 to be substantially the same as the pressure external to the container assembly 10, the vents are configured to prevent pouch 16 from occluding cavities 190. Thus, even though the structure (e.g. spacing of ribs 145 and the angled, sharp edges of ribs 145) of mounting portion 140 may be similar to the structure of conventional mounting portion 140', because the vents prevent pouch 16 from being pushed into cavities 190 and/or stretched over the edges of ribs 145, these similar mounting portion 140 structures do not result in the damage to the container assembly 10 that would otherwise occur in a non-vented container assembly 10' having a conventional mounting portion 140' (e.g. as shown in FIG. 16).

Figure 26:
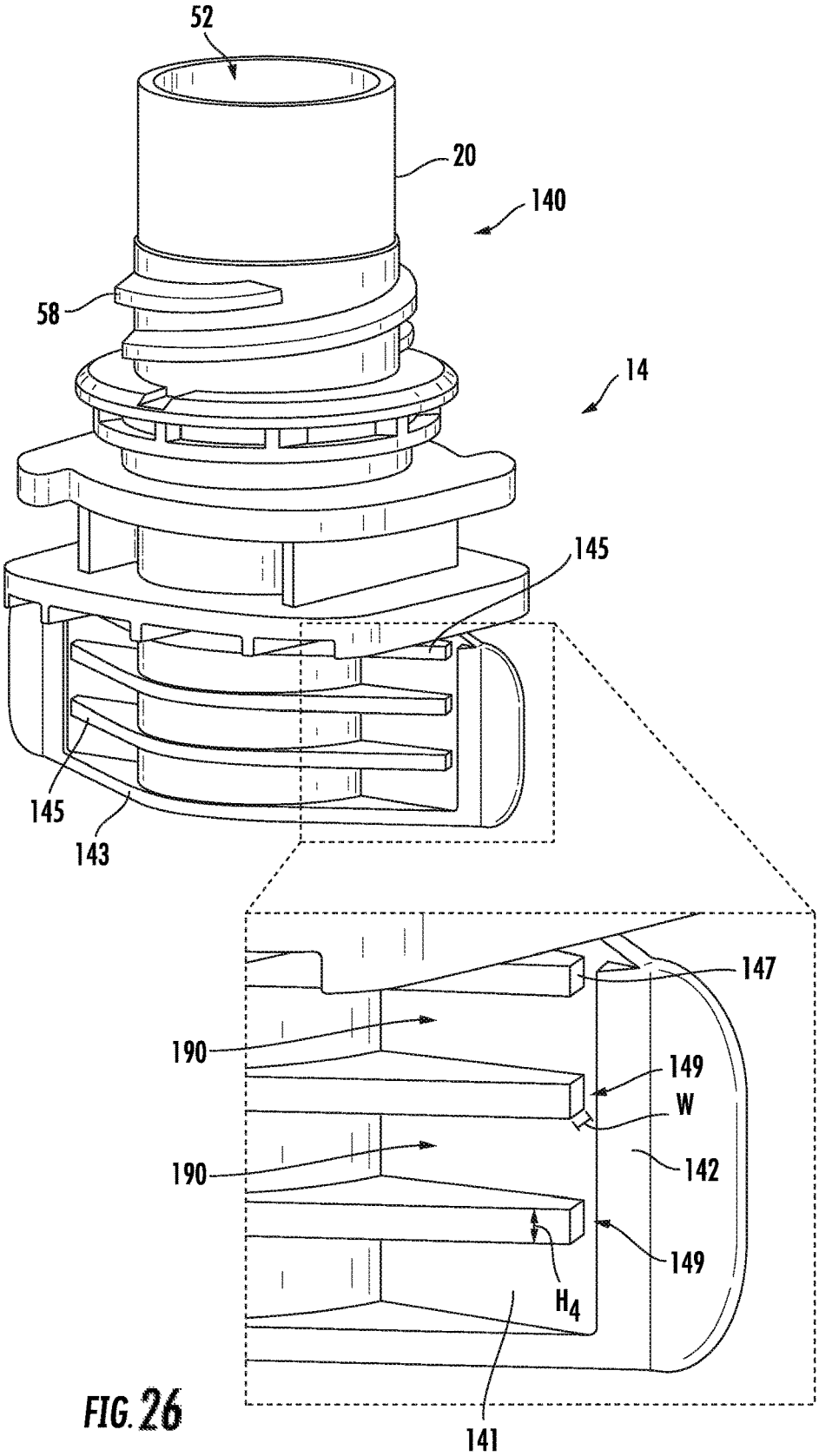
FIG. 26 is a perspective view of a spout including a mounting portion having a vent according to an exemplary embodiment, as well as an enlarged view thereof.
Figure 27:
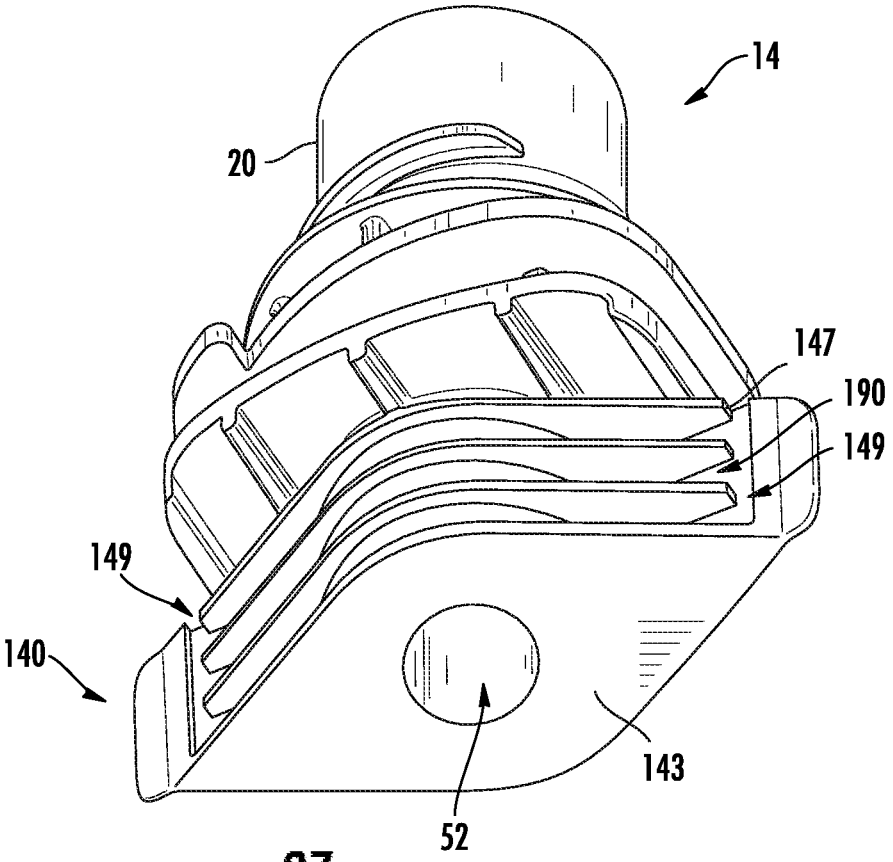
FIG. 27 is bottom perspective view of the spout of FIG. 26.
Figure 28:
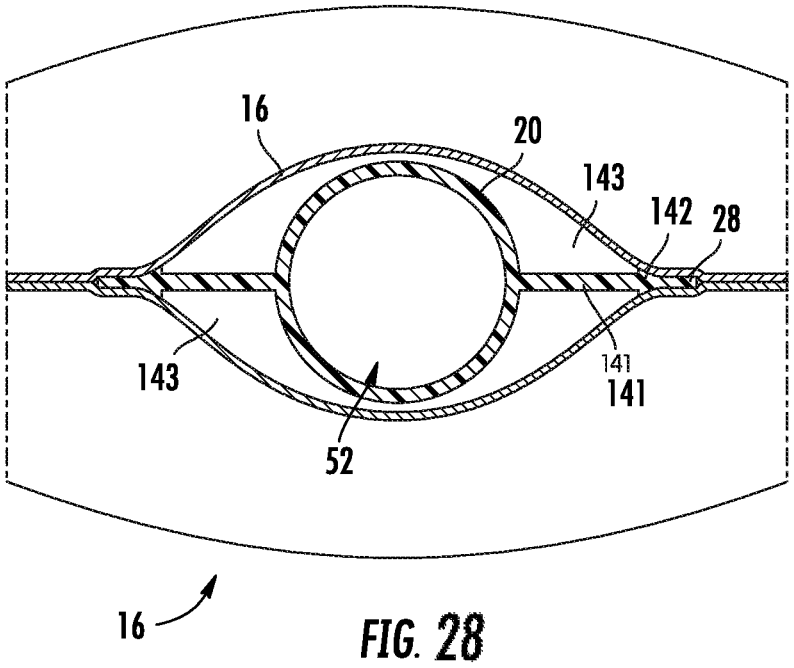
FIG. 28 is a sectional view from above taken along line 28-28 of FIG. 1 according to one embodiment.
Figure 30:
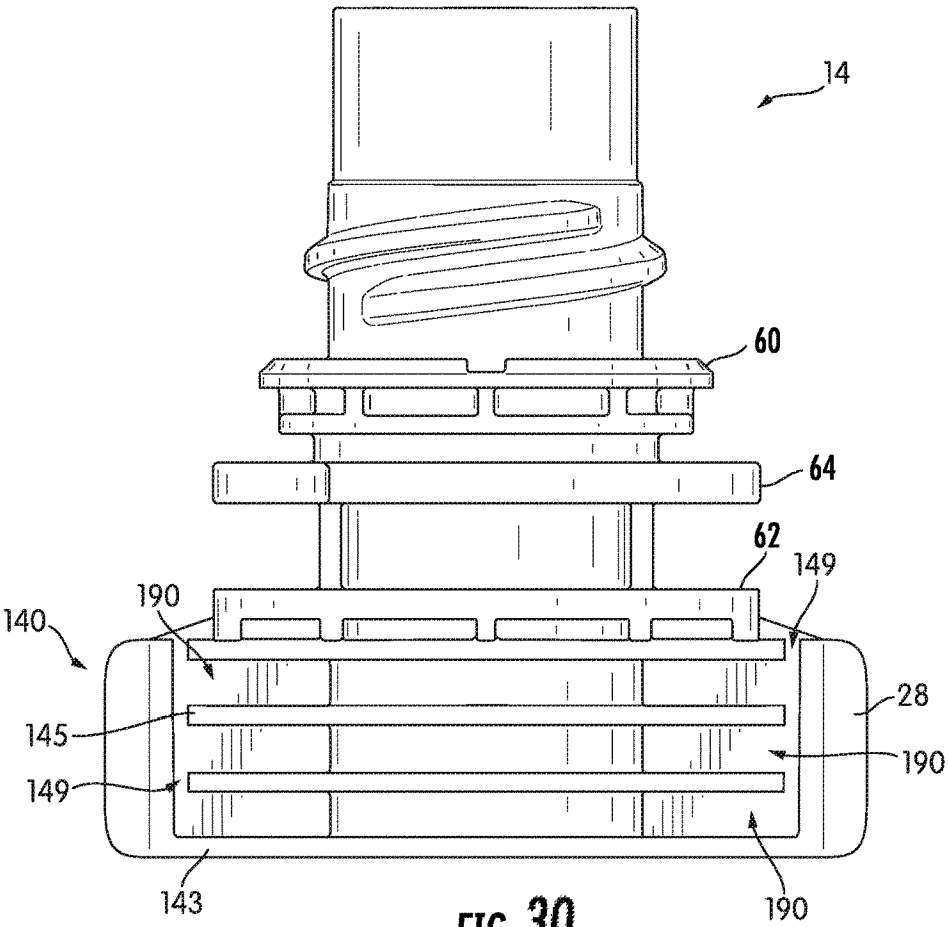
FIG. 30 is a front view of the spout of FIG. 26.
Figure 29:
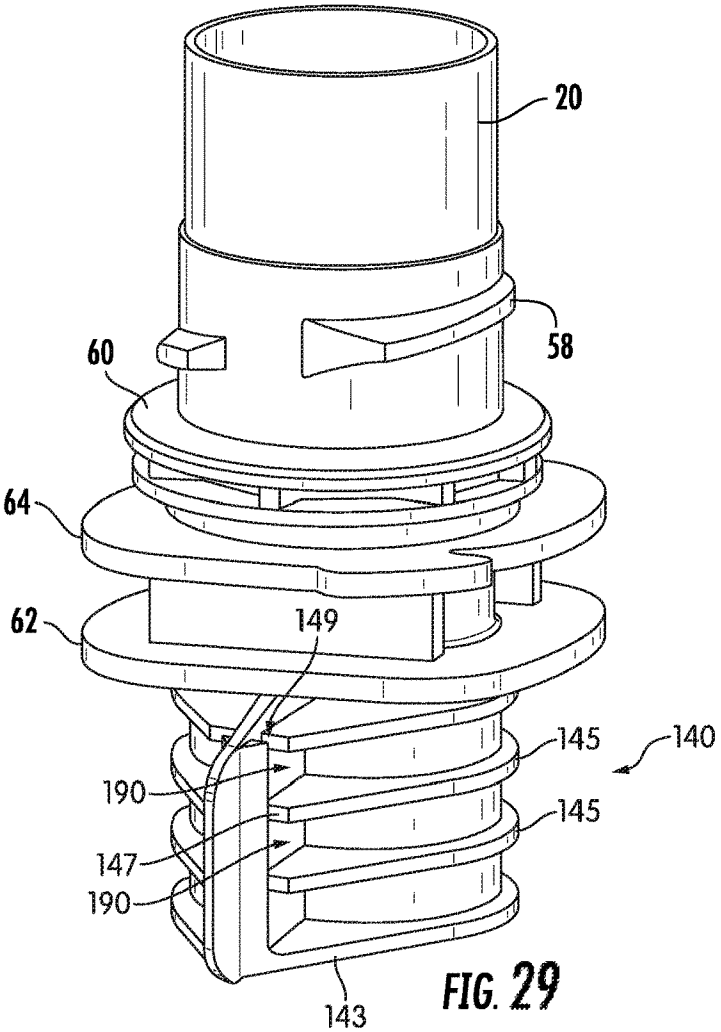
FIG. 29 is a perspective view of the spout of FIG. 26.
Figure 31:
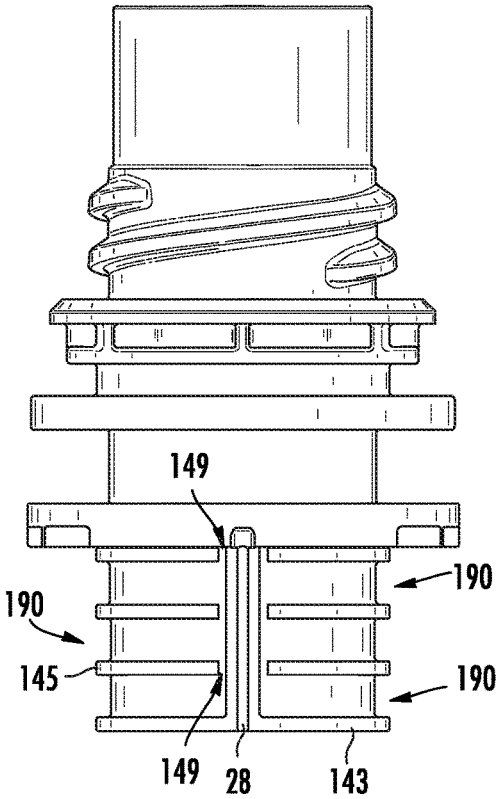
FIG. 31 is a side view of the spout of FIG. 26.

Referring to FIGS. 26-33, one embodiment of a spout 14 incorporating vents is shown. As shown in FIGS. 26 and 27, the shape, size and configuration of ribs 145 generally mirrors the shape and configuration of bottom sealing wall 143. However, whereas the bottom sealing wall 143 extends from one wing 28 to opposite wing 28, such as illustrated in FIG. 28, the ends of ribs 145 are cut short, creating a gap 149 between end portions 147 of ribs 145 and the wings 28 to ribs 145. Because the ribs 145 are cut short, end portions 147 are defined by rectangular faces having a height H4 and width W.

Figure 32:
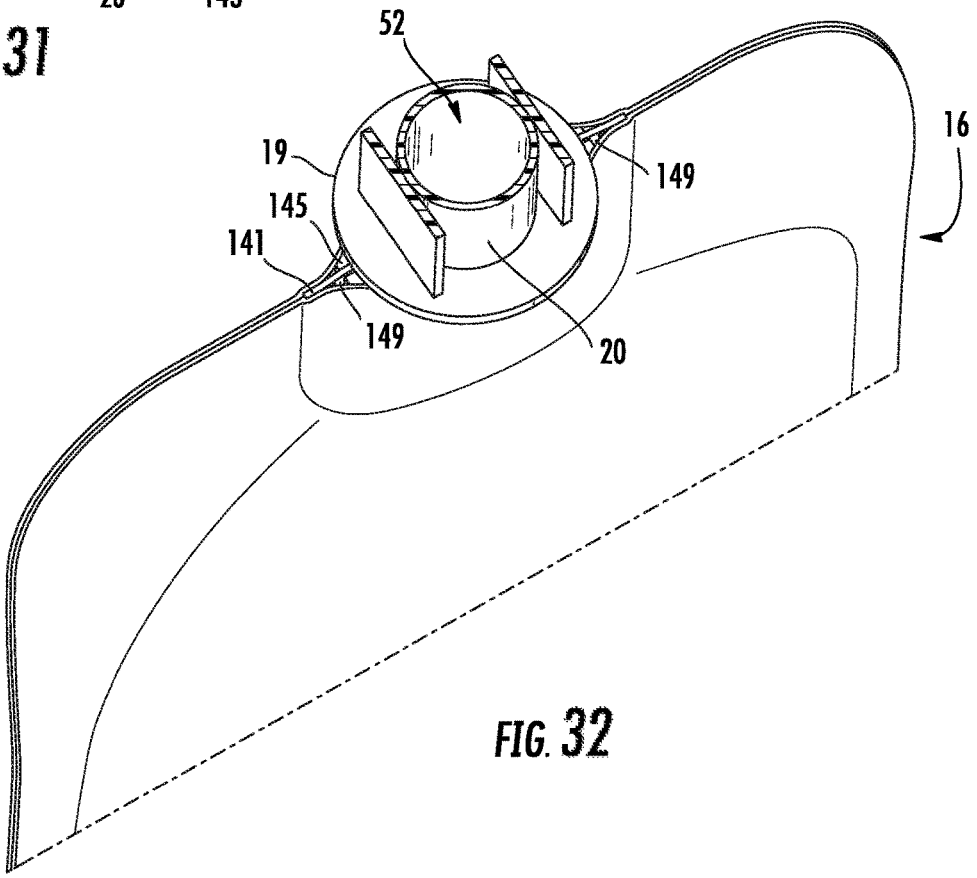
FIG. 32 is a perspective sectional view from above taken along line 32-32 of FIG. 1 according to an exemplary embodiment.
Figure 33:
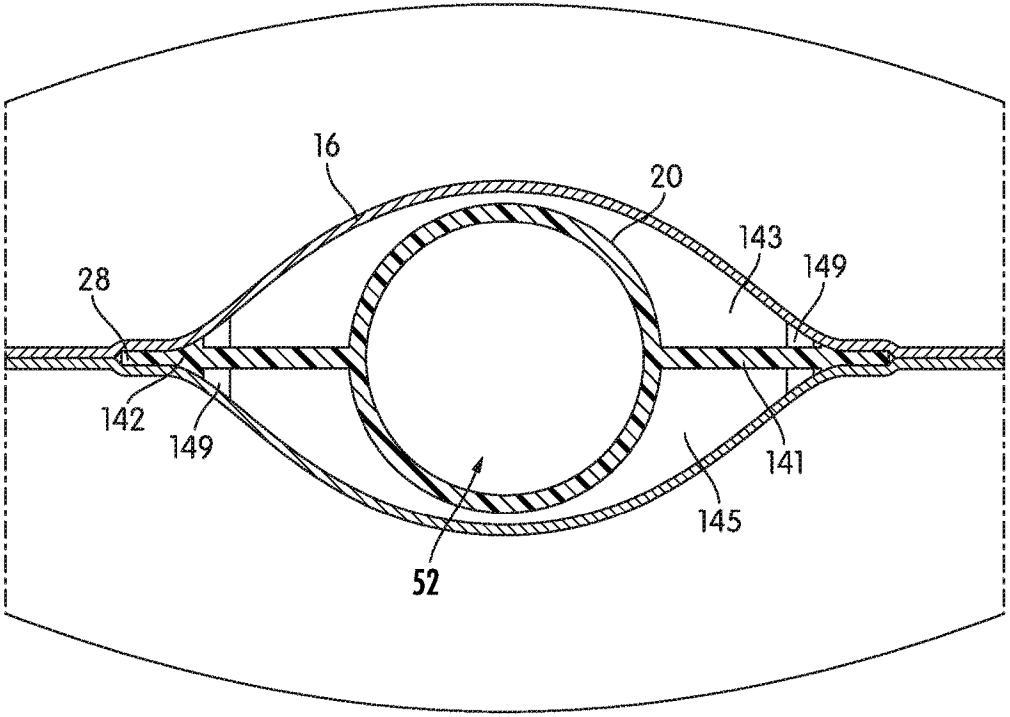
FIG. 33 is a sectional view from below taken along line 33-33 of FIG. 1 according to one embodiment.

As shown in FIGS. 32 and 33, when the pouch 16 and spout 14 are attached, gaps 149 define vents through which the spaces 190 are in fluid communication with the outside environment. As shown in FIGS. 27, 28 and 33, wings 28 may optionally include transition portions 142 that extend along a curve from the flat portion of wings 28. The outer perimeters of ribs 145 are configured to form a fluid-tight interface with the pouch 16 when the pouch 16 is attached to the ribs 145 of mounting portion 140. This fluid-tight attachment or bonding between the pouch 16 and the ribs 145 may involve an adhesive, a melted thermoplastic, heat welding, ultrasonic welding, or other means for sealing the structures together.

As shown in FIG. 33, the outer perimeter of each rib 145 is configured to form an uninterrupted fluid-tight interface along the entire length of each rib 145 with the inner surfaces of the sidewalls of pouch 16 when the pouch 16 and spout 14 are attached. The structure of the end portions 147 and the curve of the transition portion 142 are configured such that when the pouch 16 and spout 14 are sealed together, the pouch 16 lays taut against the outer perimeter of the mounting portion 140 and the pouch is prevented from occluding gaps 149.

Figure 34:
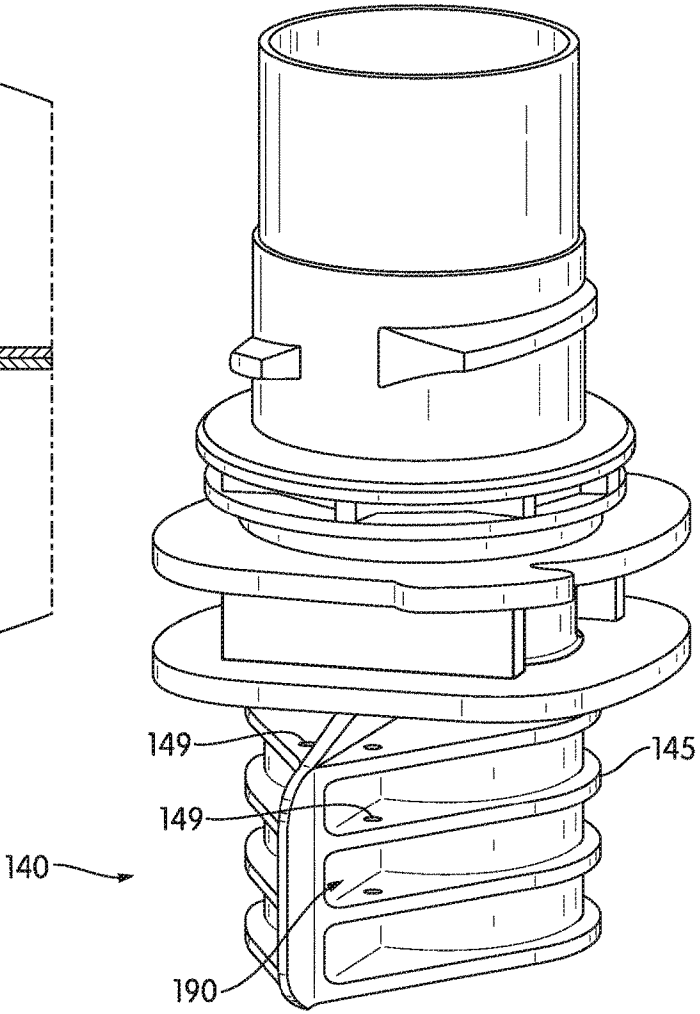
FIG. 34 is a perspective view of a spout including a mounting portion having a vent according to an exemplary embodiment.
Figure 35:
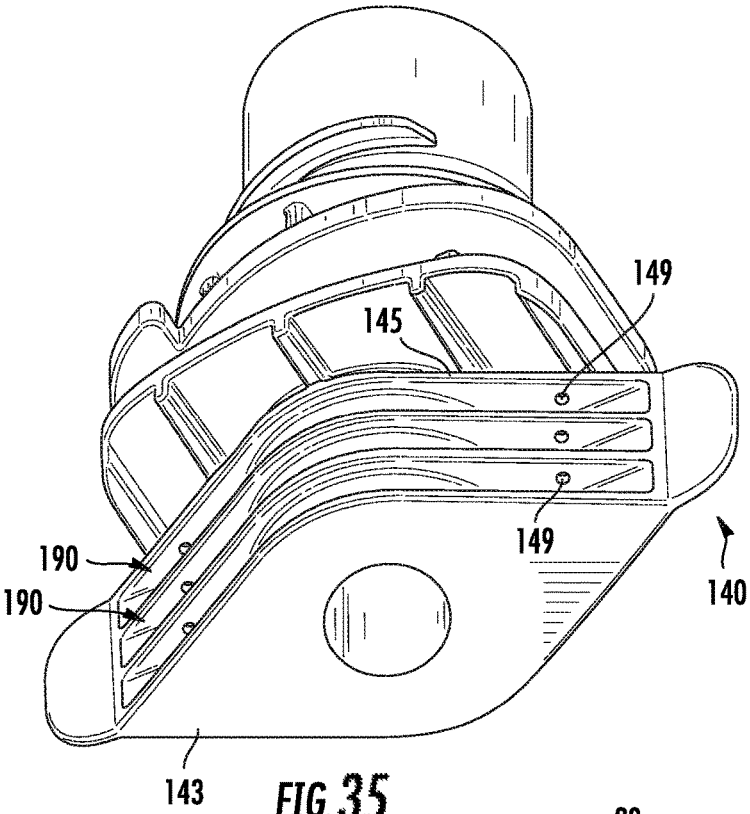
FIG. 35 is a bottom perspective view of the spout of FIG. 34.
Figure 36:
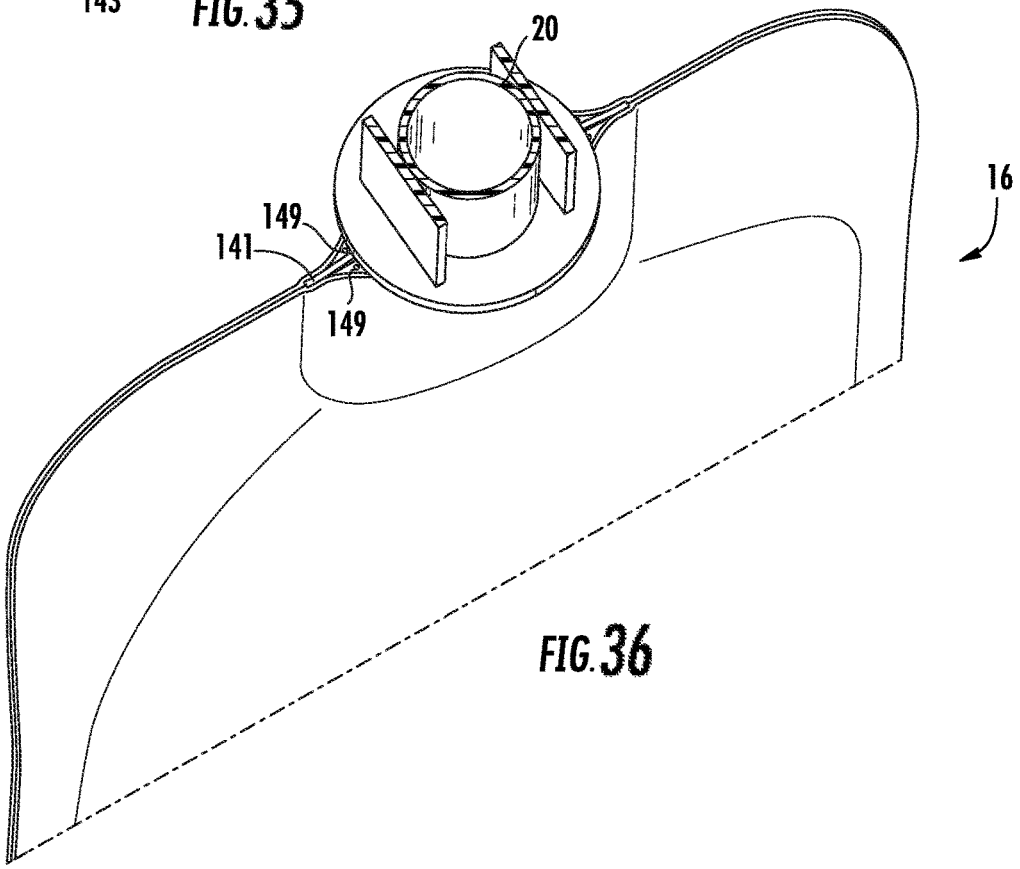
FIG. 36 is a perspective sectional view from above taken along line 36-36 of FIG. 1 according to one embodiment.
Figure 37:
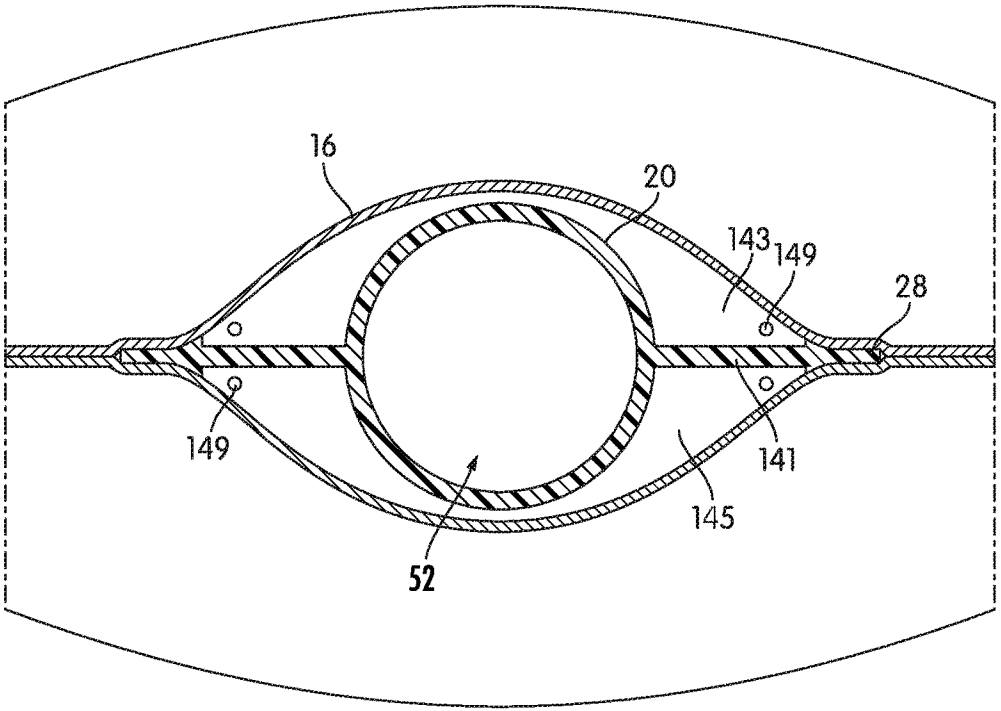
FIG. 37 is a sectional view from below taken along line 37-37 of FIG. 1 according to one embodiment.

Referring to FIGS. 34-37, another embodiment of a spout incorporating a venting feature is shown. As shown in FIG. 34 the shape, size and configuration of ribs 145 generally mirrors the shape, size and configuration of bottom sealing wall 143. Also, as seen in FIG. 37, similar to the uninterrupted perimeter of the bottom sealing wall 143, the perimeter of the ribs 145 is uninterrupted, allowing the pouch 16 to form an uninterrupted fluid tight seal along the entirety of the perimeter of the ribs 145 from one wing 28 to opposite wing 28. This fluid-tight attachment or bonding between the pouch 16 and the ribs 145 may involve an adhesive, a melted thermoplastic, heat welding, ultrasonic welding, or other means for sealing the structures together.

As shown in FIG. 35, extending through each rib 145 from a top surface to a bottom surface of each rib 145 is a gap 149, formed as a hole or aperture extending from a top surface of each rib 145 to a bottom surface of each rib. As shown in FIG. 35, gaps 149 define vents which permit fluid communication between inner spaces 190 and the outside environment after the pouch and mounting portion 140 have been attached. The holes or apertures in ribs 145 forming gaps 149 can be formed in ribs 145 prior to attachment of spout 14 to pouch 16. In other embodiments, gaps 149 can be formed in ribs 145 after spout 14 and pouch 16 have been attached. Although in FIGS. 34-37 gaps 149 are illustrated as round holes, gaps 149 may have any shape or cross-section and the dimensions of gaps 149 may vary from those shown in the figures.

Figure 38:
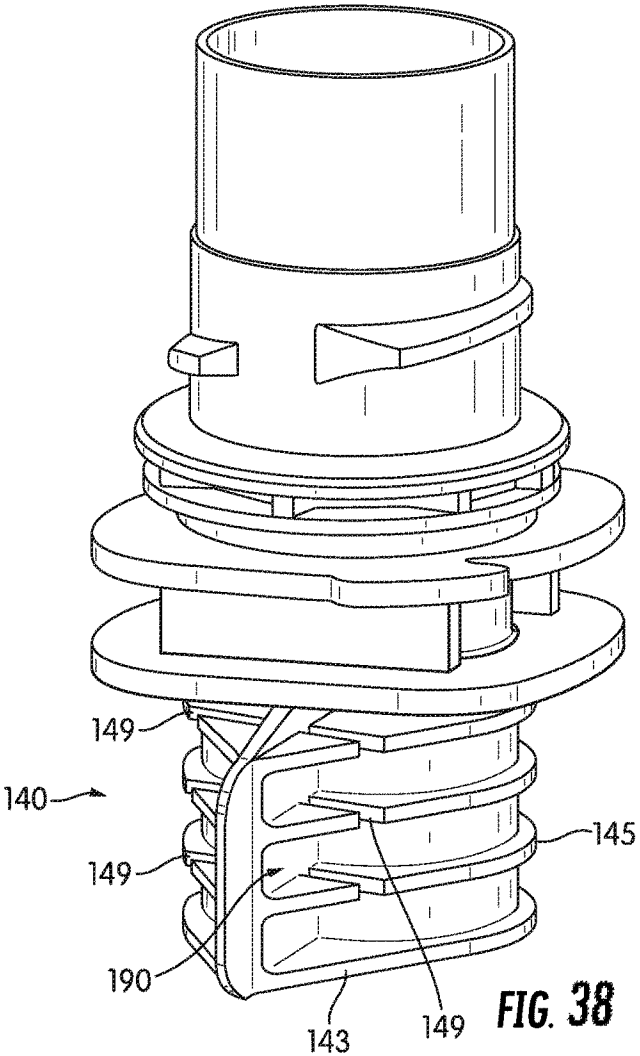
FIG. 38 is a perspective view of a spout including a mounting portion having a vent according to an exemplary embodiment.
Figure 39:
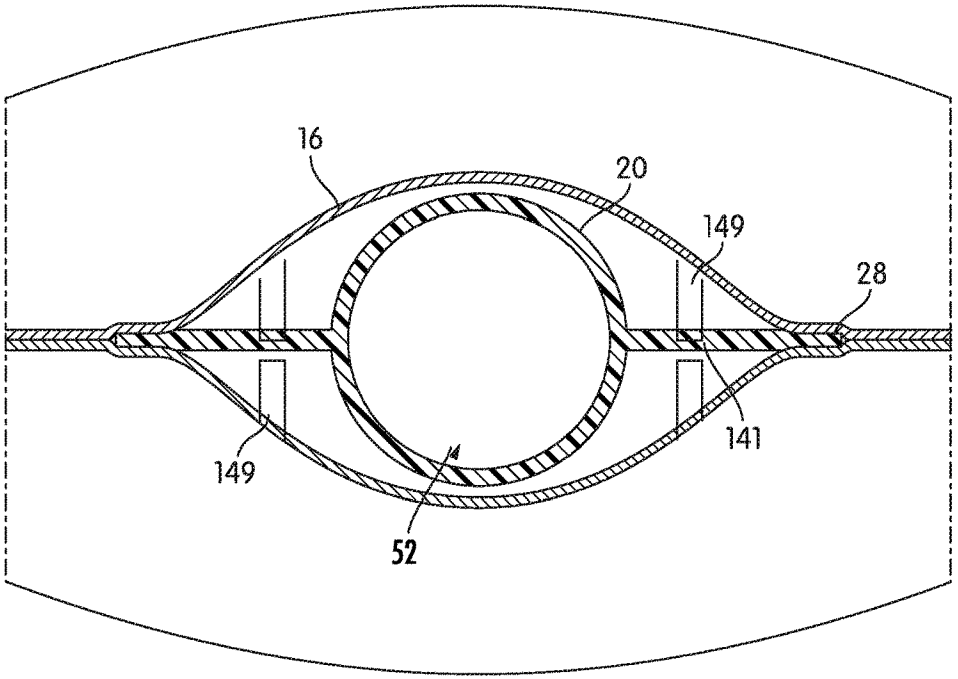
FIG. 39 is a sectional view from below taken along line 39-39 of FIG. 1 according to one embodiment.

Referring to FIGS. 38 and 39, another embodiment of a spout 14 incorporating a vent is shown. As shown in FIG. 38, the shape, size and configuration of ribs 145 generally mirrors the shape, size and configuration of bottom sealing wall 143. As illustrated by FIG. 38, in this embodiment ribs 145 extend between wings 28, similar to bottom sealing wall 143. However, as shown in FIG. 36, unlike the bottom sealing wall 143, which has an uninterrupted outer perimeter (as shown in FIG. 38), the outer perimeter of ribs 145 is interrupted by gaps 149. The gaps 149 formed in the perimeter of ribs 145 extend from a bottom surface to a top surface of each rib 145. In FIG. 38 and FIG. 39 gaps 149 are shown as extending through the ribs 149 from the outer perimeter of ribs 145 to the support wall 141. However, in other embodiments gaps 149 may extend through the ribs 145 from the outer perimeter of ribs 145 to a depth that does not extend all the way to support wall 141. Gaps 149 may be formed along any portion of ribs 145 between first and second wings 28. Also, although in FIGS. 38 and 39 gaps 149 are illustrated as having a generally rectangular shape, gaps 149 may have any shape or cross-section and the dimensions of gaps 149 may vary from those shown in the figures.

As seen in FIG. 39, because gaps 149 are formed in the outer perimeter of ribs 145, the interface between the inner surfaces of the sidewalls of the pouch 16 and the ribs 145 is interrupted along those portions of the length of the ribs 145 at which gaps 149 are formed in the ribs 145. As also seen in FIG. 39, at those portions at which the outer perimeter of ribs 145 is in contact with the inner surfaces of the sidewalls of pouch 16, the outer perimeters of ribs 145 are configured to form a fluid-tight interface with the inner surfaces of the sidewalls of pouch 16. This fluid-tight attachment or bonding between the pouch 16 and the ribs 145 may involve an adhesive, a melted thermoplastic, heat welding, ultrasonic welding, or other means for sealing the structures together.

As seen in FIG. 39, at those portions along the length of ribs 145 at which gaps 149 are formed, the pouch 16 is attached to mounting portion 140 such that the pouch 16 lays taut against the outer perimeter of the mounting portion 140 so as to prevent the pouch from occluding gaps 149 and to allow for fluid communication between spaces 190 and the outside environment.

Figure 40:
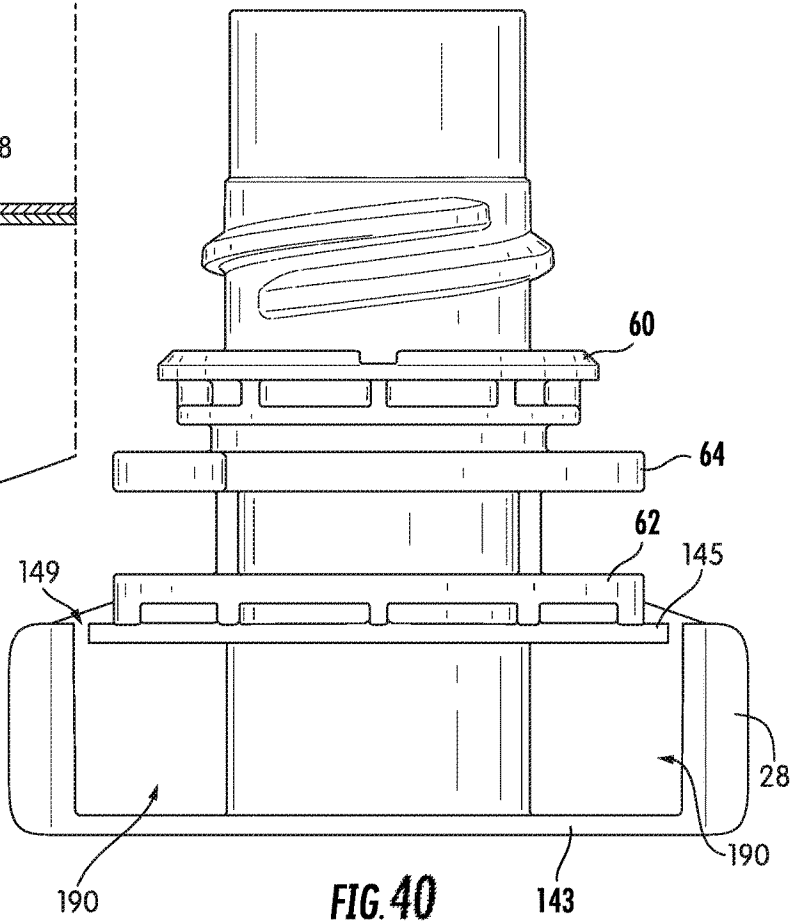
FIGS. 40 is a front perspective view of a spout including a mounting portion having a vent according to an exemplary embodiment.

As illustrated by the various embodiments discussed above, spout 14 may include multiple ribs 145. Alternatively, in other embodiments, a spout 14 incorporating vents as shown in any of these embodiments may include only a single rib 145. Shown in FIG. 40 is one embodiment of a spout 14 including a single rib 145. The structure and configuration of the rib 145 and the corresponding vent formed by gaps 149 in the embodiment shown in FIG. 40 is similar to the structure and configuration of the ribs 145 and the corresponding vents formed by gaps 149 in the embodiment shown in FIG. 26. However, whereas in FIG. 26 the mounting portion 140 is illustrated as including three ribs, as seen in FIG. 40, the mounting portion includes a single rib 145. Although FIG. 40 illustrates an embodiment of a spout having only a single rib 145 and having a mounting portion 140 including a vent structure similar to the vent structure disclosed with reference to the embodiment of FIG. 26 discussed above, the use of a single rib 145 may be incorporated into any of the embodiments of the mounting portion 140 having a vent structure as discussed herein.

Figure 41:
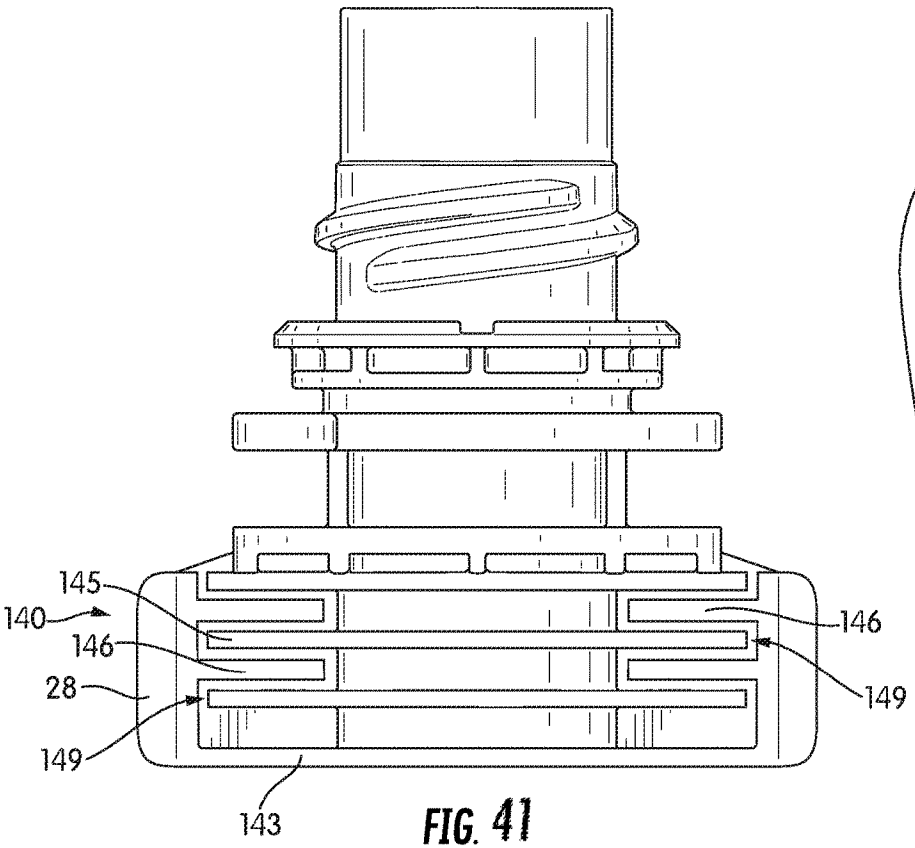
FIGS. 41 is a front perspective view of a spout including a mounting portion having a vent according to an exemplary embodiment.

As shown in FIG. 41, a spout 10 incorporating a venting feature as shown in any of the embodiments disclosed herein may also include one or more side projections 146. Although FIG. 41 illustrates an embodiment of a spout incorporating side projections 146 having a mounting portion 140 including a vent structure similar to the vent structure disclosed with reference to the embodiment of FIG. 26 discussed above, side projections 146 may be incorporated into any of the embodiments of a mounting portion 140 having a vent structure as discussed herein.

Referring to FIG. 41, side projections 146 may be configured to provide a greater surface area against which to seal the pouch 16, allowing for a more secure attachment of the spout 14 to the pouch 16. Also, side projections 146 may be configured to strengthen and prevent distortion and/or damage to the spout 14 and to prevent damage to or accidental rupturing of the pouch 16 after the pouch 16 and spout 14 have been attached.

As shown in FIG. 41, in some embodiments side projections 146 project inwardly from wings 28. In other embodiments, side projections 146 may extend perpendicularly outward from support wall 141 or radially outward from tube 20. Side projections 146 may be spaced in between adjacent ribs 145, and the outer perimeter of the side projections 146 may generally mirror the shape, size and configuration of the bottom sealing wall 143 and/or the ribs 145. Although two side projections 146 are shown extending from each surface of both wings 28 in the embodiment shown in FIG. 41, in other embodiments the number and positioning of side projections 146 may vary.

In one embodiment, not shown, side projection 146 may include a single side projection 146 having a height substantially similar to the height of wings 28 and extending from one wing 28 to the opposite wing 28 on both the front and rear sides of the mounting portion 140. In such an embodiment, the side projection 146 may form an annular wall which circumferentially surrounds the entire outer perimeter of ribs 145 around both the front and rear of the mounting portion 140. In such an embodiment, the side projection 146 may be configured to maximize the surface area of the mounting portion 140 to which the pouch 16 may be sealed. In some embodiments, the entirety of the bottom perimeter of the side projection may be attached to and circumferentially surround the upper surface of bottom sealing wall 143. In other embodiments, the side projection 146 may be attached to the mounting portion 140 only at wings 28. A mounting portion 140 having such a side projection 146 may be incorporated into the structure of any of the mounting portions 140 disclosed herein.

Figure 42:
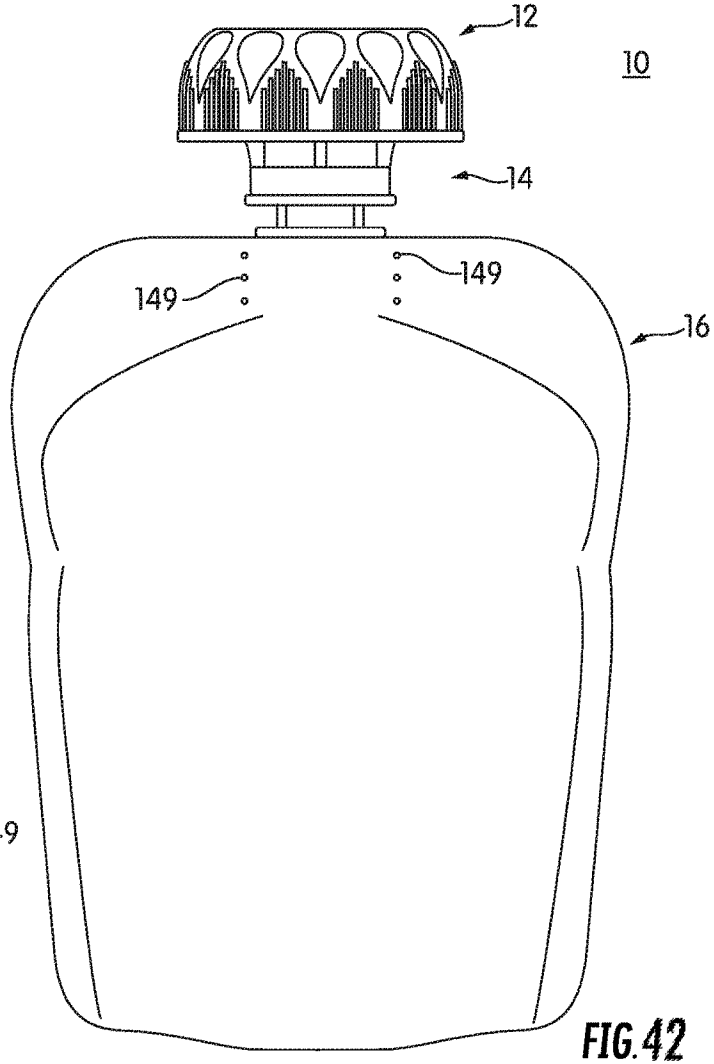
FIG. 42 shows a container assembly including a pouch having a vent feature according to an exemplary embodiment.
Figure 43:
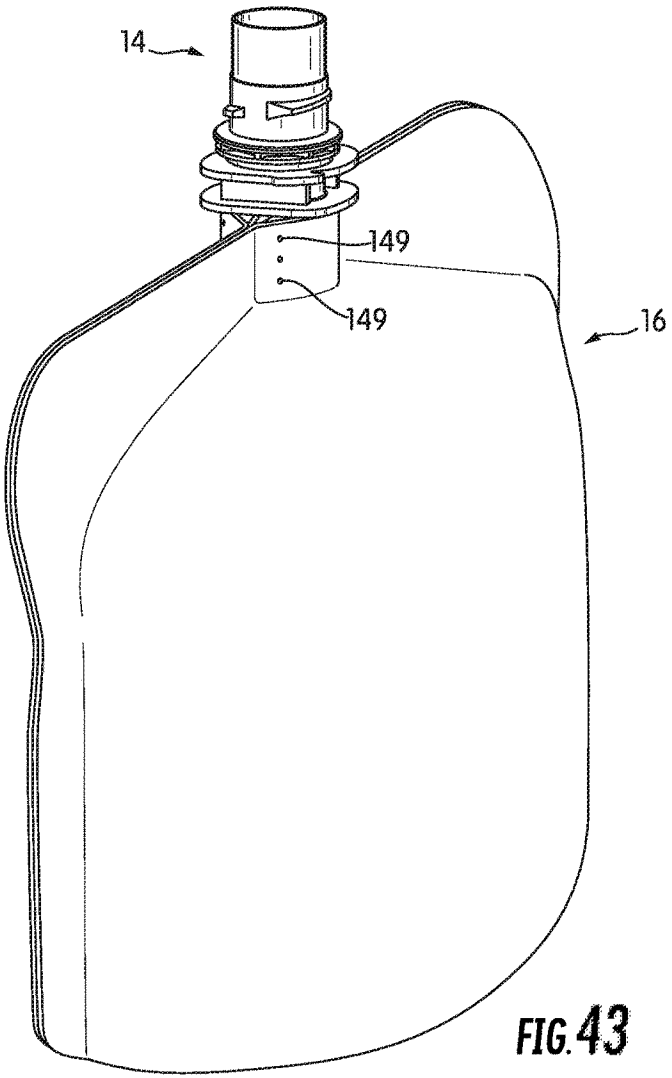
FIG. 43 is a perspective view of the container assembly of FIG. 42.

Referring to FIGS. 42-43, another embodiment of a container assembly 10 including vents that allow for fluid communication between the external environment and cavities (such as, e.g. spaces 190) formed between the inner surfaces of the sidewalls of pouch 16 and the external surfaces of mounting portion 140 when the mounting portion 140 and pouch are attached, is shown. As shown in FIGS. 42 and 43, gaps 149 are formed in the upper portion of pouch 16. Gaps 149 are formed as holes or apertures that extend from an outer surface of the sidewalls of pouch 16 to an inner surface of the sidewalls of pouch 16, creating a passageway through which fluid, such as, e.g., air, may pass. The holes or apertures in pouch 16 forming gaps 149 can be formed in pouch 16 prior to attachment of spout 14 to pouch 16. In other embodiments, gaps 149 can be formed in pouch 16 after spout 14 and pouch 16 have been attached. Although gaps 149 are illustrated as round holes, gaps 149 may include any shape or cross-section and the dimensions of gaps 149 may vary from those shown in the figures.

Figure 44:
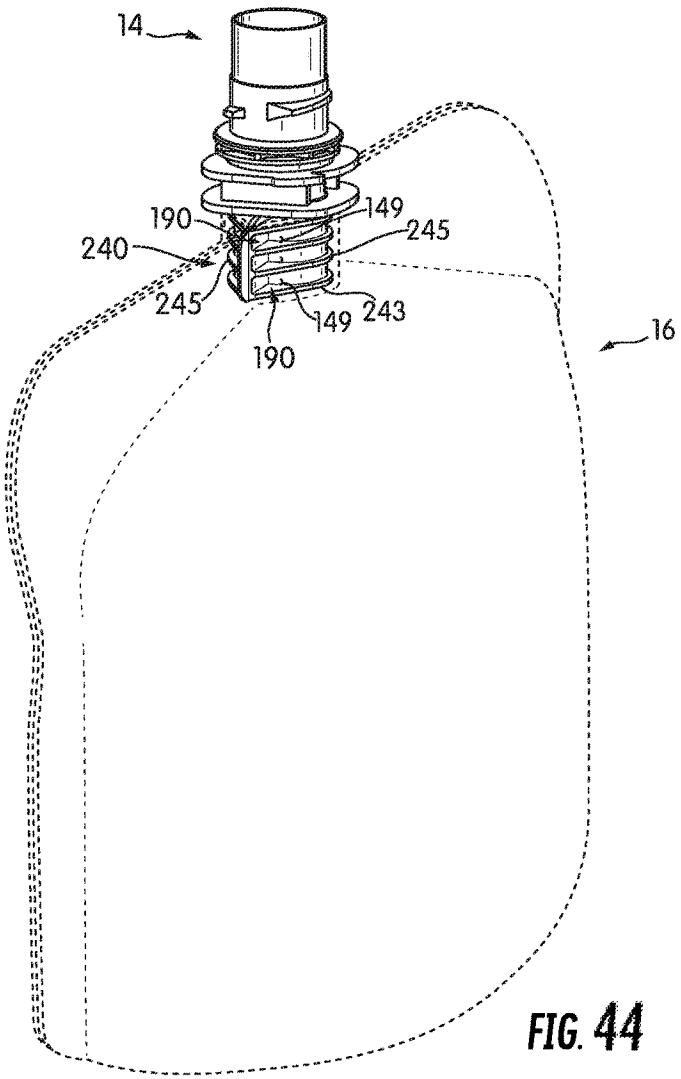
FIG. 44 is a perspective view of the container assembly of FIG. 42 according to an exemplary embodiment.
Figure 45:
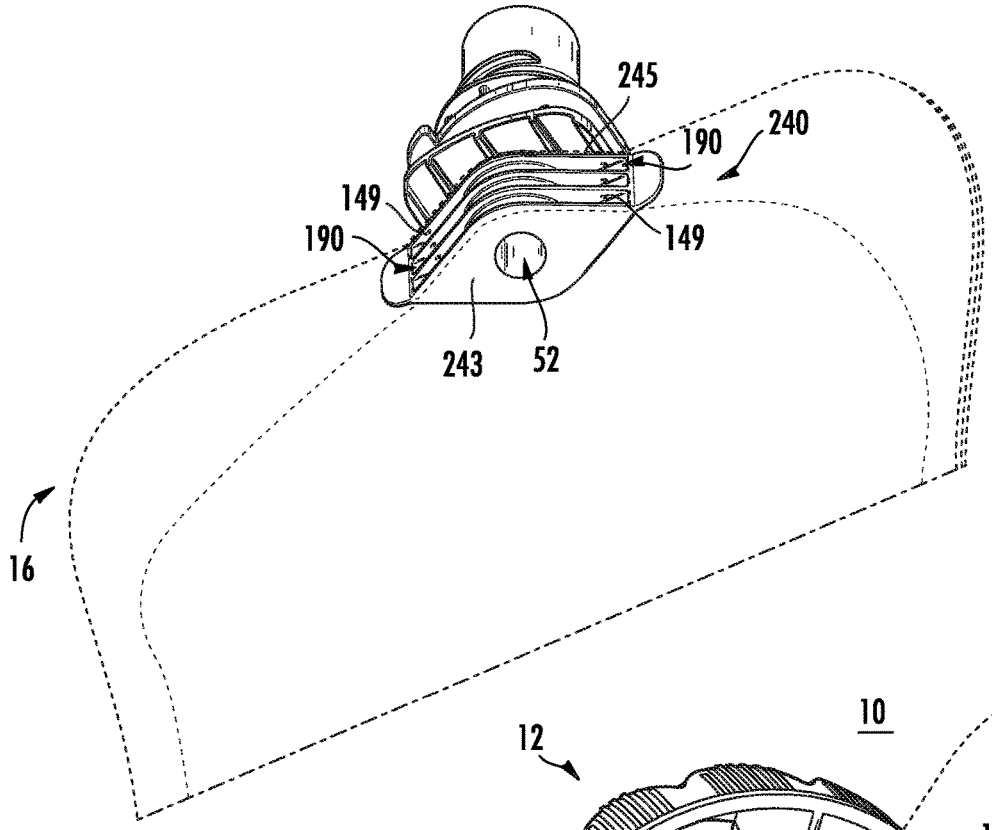
FIG. 45 is a bottom perspective view of the container assembly of FIG. 44.

As shown in FIGS. 44 and 45, in one embodiment a pouch including gaps 149 is configured to be attached to a mounting portion 240 which does not include any vent structures, similar to the conventional mounting structure 140' shown in FIGS. 15 and 16. As shown in FIGS. 44 and 45, the mounting portion 240 may include a bottom sealing wall 243 and ribs 245 whose outer perimeters are configured to form an uninterrupted, fluid-tight interface with the inner surfaces of the sidewalls of pouch 16 when the pouch 16 and spout 14 are attached. Additionally, the bottom sealing wall 243 and ribs 245 each include a solid structure that, with the exception of an opening through which tube 20 passes, includes no apertures or holes that pass from a bottom surface to a top surface. The openings in the bottom sealing wall 243 and ribs 245 through which tube 20 passes are attached to the exterior surface of tube 20 via a fluid-tight attachment.

Referring to FIGS. 44 and 45, gaps 149 are arranged on the pouch 16 such that when pouch 16 and spout 14 are attached, the gaps 149 are aligned in between adjacent ribs 245 such that gaps 149 provide a vent that allows for fluid communication between spaces 190 formed between adjacent ribs 245 and between bottommost rib 245 and bottom sealing wall 243 and the outside of the pouch 16.

Although in the embodiment of FIGS. 44 and 45 a pouch 16 including gaps 149 is shown attached to a mounting portion 240 that does not include vent structures, the pouch 16 shown in the embodiment of FIGS. 42 and 43 may be used with and attached to a mounting portion 140 including vents according to any of the embodiments disclosed herein. Similar to the embodiment shown in FIGS. 44 and 45, in such embodiments in which a mounting portion 140 including vents is attached to a pouch 16 also having vents, pouch 16 is attached to spout 14 such that the gaps 149 of pouch 16 are aligned and positioned in between ribs 145 of the mounting portion 140, such as illustratively shown in FIGS. 44 and 45.

Figure 46:
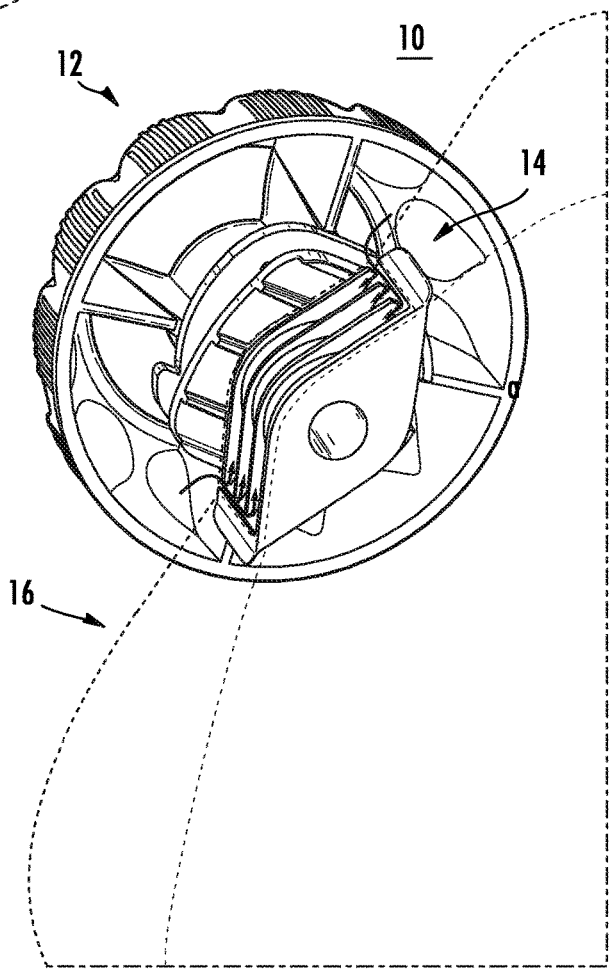
FIG. 46 illustrates a container assembly including a vent structure undergoing high pressure processing; according to an exemplary embodiment.

Referring to FIG. 46, a container assembly 10 including vent features as discussed in detail above with reference to FIGS. 26-33 is shown as the container assembly 10 undergoes HPP. As shown by the arrows in FIG. 46, as the ambient pressure surrounding the container assembly 10 increases, gaps 149 in the container assembly 10 allow for fluid communication between the outside of the container assembly 10 and spaces 190. By providing for fluid communication between the spaces 190 and the environment surrounding the outside of the container assembly 10, the pressure inside spaces 190 is able to equalize relative to the ambient pressure. Therefore, as the ambient pressure increases during HPP, the pressure inside spaces 190 is also able to correspondingly increase. As a result, the increasing forces acting on the external surface of the sidewalls of the pouch 16 resulting from the increased ambient pressure are counteracted by equal but opposite forces acting on the internal surface of the sidewalls of the pouch 16 resulting from the correspondingly increased pressure inside spaces 190. Because the forces acting on the external surface of the sidewalls of the pouch 16 are counteracted by the forces acting on the internal surfaces of the sidewalls of the pouch 16, the changing pressure occurring during HPP does not result or cause the deterioration, deformation, or other impairment of the pouch 16 and/or the attachment between the pouch 16 and mounting portion 140, which would normally occur in a container assembly formed without vents (e.g., such as shown in FIGS. 15 and 16).

Although FIG. 46 illustrates a container assembly 10 including a vent structure similar to the vent structure disclosed with reference to the embodiment of FIG. 26 undergoing HPP, a container assembly 10 including a vent structure according to any of the embodiments discussed with reference to FIGS. 26-45 above would allow for a similar equalization of internal and ambient pressures during HPP.

Figure 48:
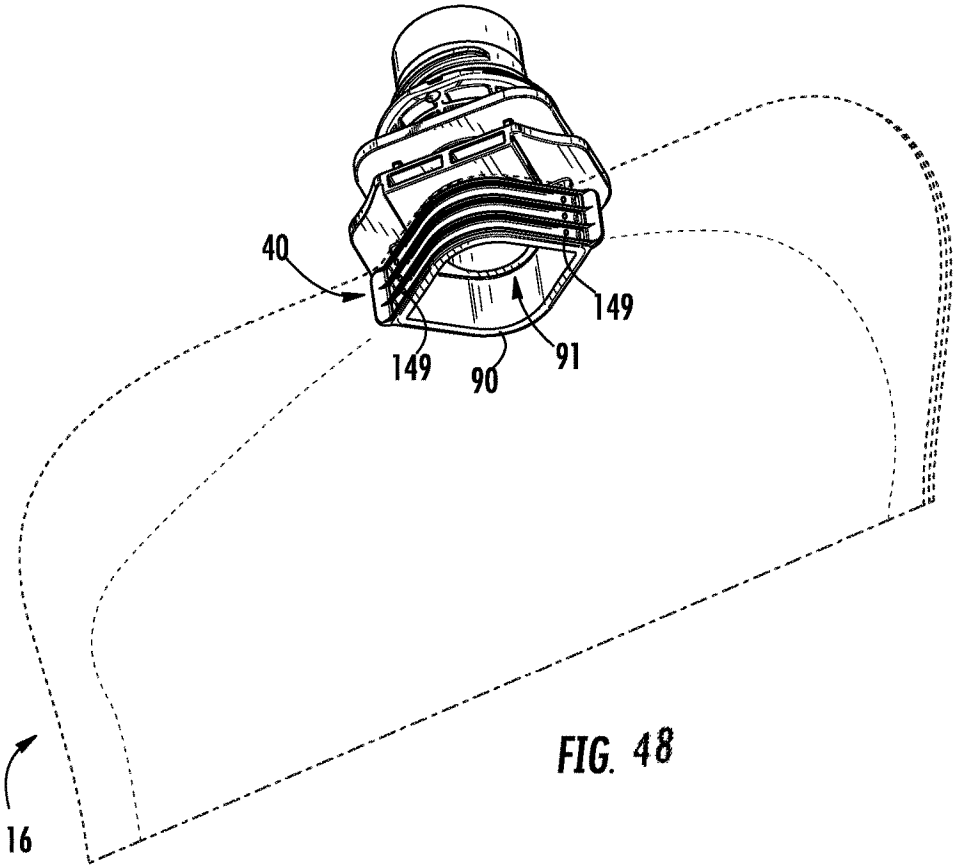
FIG. 48 is a bottom perspective view of the container assembly of FIG. 47.
Figure 47:
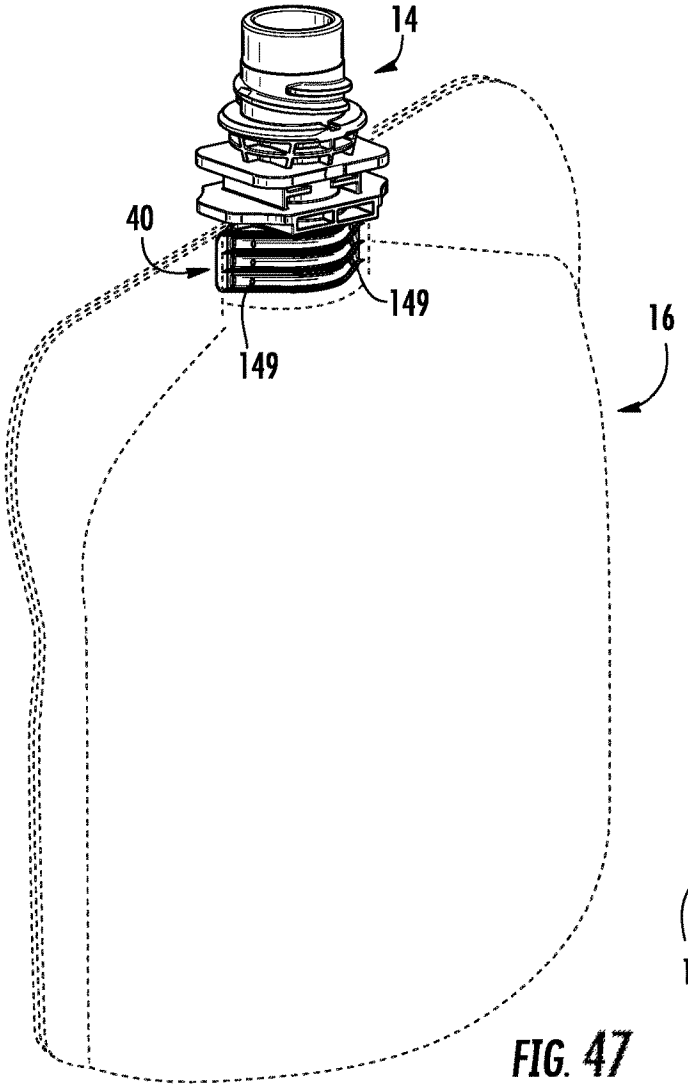
FIG. 47 is a perspective view of the container assembly of FIG. 42 having a mounting portion as shown in FIG. 17 according to an exemplary embodiment.

One example of a container assembly 10 incorporating both a modified mounting portion 40 and vent structures is illustrated in FIGS. 47 and 48. As shown in FIGS. 47 and 48, in one embodiment, the container assembly 10 may include a spout 14 with a modified mounting portion 40 such as shown and described in FIG. 17 attached to a pouch 16 having vents such as shown in and described with reference to FIGS. 42 and 43.

Although the spout 14 and pouch 16 of the embodiments illustrated in FIGS. 17-25 are not shown as including vent structures, and the spouts 14 of the embodiments of FIGS. 26-46 are not shown as having modified mounting portion 40 features as shown in and described with reference to FIGS. 17-25, it is understood that in some embodiments the spout 14 and/or pouch 16 of the embodiments of FIGS. 17-25 may be modified to include vent structures such as those described with reference to FIGS. 26-46. Similarly, it is understood that the mounting portion 140 of the spouts 14 of the embodiments of FIGS. 26-46 may be modified to include the features of the modified mounting portion 40 described with reference to FIGS. 17-25. Such container assemblies 10, having both a modified mounting portion 40 and vent features, may provide increased resistance to deformation, damage, and/or other degradation of the pouch 16 and/or pouch 16 and spout 14 interface that may result from changes in temperature and/or pressure and/or from forces being imparted onto the container assembly 10.

Furthermore, although the various spout 14 and/or pouch 16 embodiments illustrated FIGS. 17-48 and/or described according to the preceding paragraph are not shown as incorporating one or more tamper band engagement structures on the spouts 14 and/or a spout 14 having a tamper band engagement structure and/or are not shown as being used with closures 12 having tamper bands 42 as illustrated in or discussed with reference to any of FIGS. 2-14 above it is to be understood that any of the spouts 14 and/or pouches 16 illustrated in the various embodiments of FIGS. 17-48 and/or described in the preceding paragraph may be modified to include a tamper band engagement structure as illustrated in and/or discussed with reference to any of FIGS. 7-10 and/or may be used with a spout 14 having a tamper band engagement structure as illustrated in and/or described with reference to any of FIGS. 7-10 and/or may be used with a closure 12 having a tamper band 32 as illustrated in and/or discussed with reference to any of FIG. 2-6. Moreover, a spout 14 having a tamper band engagement structure as illustrated in and/or discussed with reference to FIGS. 7-10 above may be modified to include any of the spout 14 modifications/interfaces and/or may be used with a pouch 16 as described with reference to any of the spout 14 and/or pouch 16 embodiments illustrated in or described with reference to FIGS. 17-48 or in the preceding paragraph Also, a closure 12 having a tamper band 32 as illustrated in and/or discussed with reference to any of FIGS. 2-6 above may be used with any of the spout 14 and/or pouch 16 embodiments as described with reference to any of the spout 14 and/or pouch 16 embodiments illustrated in or described with reference to FIGS. 17-48 or in the preceding paragraph.

In various embodiments, the closure 12 and/or spout 14 may be formed from a molded plastic material. In various embodiments, closure 12 and/or spout 14 may be polyethylene, polypropylene, polyethylene terephthalate, or any other suitable plastic material. In various embodiments, the closure 12 and/or spout 14 may be formed through any suitable molding method including, injection molding, compression molding, etc.

Further modifications and alternative embodiments of various aspects of the invention will be apparent to those skilled in the art in view of this description. Accordingly, this description is to be construed as illustrative only. The construction and arrangements, shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. Other substitutions, modifications, changes and omissions may also be made in the design, operating conditions and arrangement of the various exemplary embodiments without departing from the scope of the present invention.

For purposes of this disclosure, the term "coupled" or "attached to" means the joining of two components directly or indirectly to one another. Such joining may be stationary in nature or movable in nature. Such joining may be achieved with the two members and any additional intermediate members being integrally formed as a single unitary body with one another or with the two members or the two members and any additional member being attached to one another. Such joining may be permanent in nature or alternatively may be removable or releasable in nature.

In various exemplary embodiments, the relative dimensions, including angles, lengths and radii, as shown in the Figures are to scale. Actual measurements of the Figures will disclose relative dimensions, angles and proportions of the various exemplary embodiments. Various exemplary embodiments extend to various ranges around the absolute and relative dimensions, angles and proportions that may be determined from the Figures. Various exemplary embodiments include any combination of one or more relative dimensions or angles that may be determined from the Figures. Further, actual dimensions not expressly set out in this description can be determined by using the ratios of dimensions measured in the Figures in combination with the express dimensions set out in this description. It should also be understood that the terminology is for the purpose of description only and should not be regarded as limiting.

While the current application recites particular combinations of features in the claims appended hereto, various embodiments of the invention relate to any combination of any of the features described herein whether or not such combination is currently claimed, and any such combination of features may be claimed in this or future applications. Any of the features, elements, or components of any of the exemplary embodiments discussed above may be used alone or in combination with any of the features, elements, or components of any of the other embodiments discussed above in the implementation of the teachings of the present disclosure.

What is claimed is:

1. A spout and closure assembly comprising:

a spout comprising:

a central channel extending through a wall portion between an inlet opening and an outlet opening, the channel surrounding a central axis of the spout;

an attachment portion located about a lower outer surface of the wall portion, the attachment portion configured for attaching the closure assembly to a container;

a thread located about an upper outer surface of the wall portion;

an annular flange extending about the upper outer surface of the wall portion at a location below a lower end of the thread;

a support structure extending about the upper outer surface of the wall portion at a location below a lower surface of the annular flange, the diameter of the annular flange being greater than the diameter of the support structure; and a wall structure extending downwards from and along a portion of the lower surface of the annular flange adjacent the outer periphery of the outer flange;

at least a portion of an inner surface of the wall structure positioned opposite at least a portion of an outer surface of the support structure;

a keyway defined between the portions of the inner surface of the wall structure and the portions of the outer surface of the support structure positioned opposite one another;

wherein a width of the keyway as measured in a radial direction at a point along the wall structure located between a first end of the wall structure and a second end of the wall structure is less than a width of the keyway as measured in a radial direction at the first end of the wall structure; and a closure configured to be attached to the spout, the closure comprising:

a central wall having an inner surface and an outer surface;

a thread formed on the inner surface configured to engage the thread of the spout; and a tamper-indicating band extending from a lower surface of the central wall, the tamper band comprising:

an outer wall portion extending downwardly from the central wall;

a frangible bridge attaching a first end of the outer wall portion to a portion of the tamper band adjacent the first end of the outer wall portion; and an engagement wall having a bottom end and a top end extending between the first end and a second end of the outer wall portion, the bottom end of the engagement wall attached to and extending radially inward and upward from a lower portion of the outer wall portion, wherein the top end of the engagement wall defines an upper engagement surface;

wherein a width of the engagement wall as measured in a radial direction is substantially the same as the width of a narrowest portion of the keyway;

wherein, in an initial, assembled configuration, the threads of the closure engage the threads of the spout to seal the inlet opening of the spout, and the engagement wall of the tamper band is located below the annular flange and radially outwards relative to the support structure, such that the upper engagement surface of the engagement wall is spaced opposite the lower surface of the upper flange;

wherein, upon initial removal of the closure from the spout, as the closure is rotated relative to the spout a first end of the engagement wall enters into the keyway, the upper engagement surface of the engagement wall is brought into contact with the lower surface of the annular flange, and the frangible bridge is broken.

2. The spout and closure assembly of claim 1, further comprising a container filled with contents attached to the spout along the attachment portion.

3. The spout and closure assembly of claim 1, wherein, upon initial removal of the closure from the spout, the engagement wall encounters both radial and axial resistance to movement of the engagement wall as the closure is rotated relative to the spout.

4. The spout and closure assembly of claim 1, further comprising a hinge, the hinge attaching the second end of the outer wall portion to a portion of the tamper band adjacent the second end of the outer wall portion.

5. The spout and closure assembly of claim 1, further comprising an arm element extending generally perpendicularly outwards along the lower surface of the annular flange from the outer surface of the wall portion to the outer periphery of the annular flange, an outermost end of the arm element attached to the second end of the wall structure.

* * * * *